US007878956B2

(12) United States Patent
Kadar et al.

(10) Patent No.: US 7,878,956 B2
(45) Date of Patent: Feb. 1, 2011

(54) EXERCISE APPARATUS

(75) Inventors: Michael Shannon Kadar, Pittsburgh, PA (US); Kregg Akan Koch, Aliso Viejo, CA (US)

(73) Assignee: Core Stix Fitness, LLC, Manhattan Beach, CA (US)

( * ) Notice: Subject to any disclaimer, the term of this patent is extended or adjusted under 35 U.S.C. 154(b) by 47 days.

(21) Appl. No.: 12/249,884

(22) Filed: Oct. 10, 2008

(65) Prior Publication Data

US 2009/0054214 A1 Feb. 26, 2009

Related U.S. Application Data

(63) Continuation-in-part of application No. 11/533,766, filed on Sep. 21, 2006, now Pat. No. 7,704,199.

(60) Provisional application No. 60/721,669, filed on Sep. 29, 2005, provisional application No. 60/979,768, filed on Oct. 12, 2007.

(51) Int. Cl.
*A63B 21/04* (2006.01)
*A63B 21/02* (2006.01)

(52) U.S. Cl. ..... 482/129; 482/121; 482/130

(58) Field of Classification Search ..... 482/121, 482/122, 123, 128, 18, 92, 129, 130
See application file for complete search history.

(56) References Cited

U.S. PATENT DOCUMENTS

| | | | | |
|---|---|---|---|---|
| 3,345,067 | A | 10/1967 | Smith | |
| 3,567,219 | A | 3/1971 | Foster | |
| 3,587,319 | A * | 6/1971 | Andrews | 2/112 |
| 3,802,701 | A | 4/1974 | Good | |
| 3,807,727 | A | 4/1974 | Ferguson | |
| 4,332,399 | A | 6/1982 | Kepple | |
| 4,494,662 | A | 1/1985 | Clymer | |
| 4,620,704 | A | 11/1986 | Shifferaw | |
| 4,625,963 | A | 12/1986 | Lancellotti | |
| 4,725,057 | A | 2/1988 | Shifferaw | |
| 5,013,034 | A | 5/1991 | March et al. | |

(Continued)

FOREIGN PATENT DOCUMENTS

| | | |
|---|---|---|
| WO | WO 82/00100 | 1/1982 |

OTHER PUBLICATIONS

International Search Report and Written Opinion for International Application No. PCT/US2006/36639, date of mailing: Sep. 25, 2007, in 10 pages.

(Continued)

*Primary Examiner*—Loan Thanh
*Assistant Examiner*—Sundhara M Ganesan
(74) *Attorney, Agent, or Firm*—Knobbe, Martens, Olson & Bear LLP

(57) ABSTRACT

An exercise apparatus comprising a base that can be oriented at any angle and that defines a plurality of connection interfaces, each of which can be designed to support one end of a resilient member in a cantilevered disposition. The connection interfaces can be positioned at or adjusted to a widely varying range of locations and angular orientations with respect to the base. Each resilient members can be configured to support one or more removable stiffening members that provide a resistance force when a force is exerted thereon so as to bend the resilient member.

54 Claims, 29 Drawing Sheets

U.S. PATENT DOCUMENTS

| | | | | |
|---|---|---|---|---|
| 5,064,190 | A | 11/1991 | Holt | |
| 5,123,886 | A | 6/1992 | Cook | |
| 5,403,256 | A * | 4/1995 | Squires | 482/91 |
| 5,522,783 | A | 6/1996 | Gordon | |
| 5,524,893 | A | 6/1996 | McGinnis et al. | |
| 5,755,649 | A | 5/1998 | Bimby | |
| 5,759,139 | A * | 6/1998 | Wright | 482/128 |
| 5,860,897 | A | 1/1999 | Gilbert et al. | |
| 5,913,754 | A * | 6/1999 | Lochbaum | 482/111 |
| 5,971,891 | A * | 10/1999 | Humphrey | 482/51 |
| 6,406,410 | B1 * | 6/2002 | Lochbaum | 482/111 |
| 6,676,579 | B1 * | 1/2004 | Lin | 482/146 |
| 6,964,636 | B2 | 11/2005 | Verheem et al. | |
| 7,041,041 | B1 * | 5/2006 | Evans | 482/126 |
| 2003/0186792 | A1 | 10/2003 | Keeler | |
| 2007/0072752 | A1 | 3/2007 | Koch et al. | |

OTHER PUBLICATIONS

Supplementary European Search Report from the European Patent Office for Application No. 0680391438/ Publication No. 1928561, document mailed on Jan. 5, 2009 in 8 pages.

Video showing two of Applicant's prototypes, disclosed to third parties, earliest USPS mailing label date for mailing of such video is Oct. 18, 2007 (3 pages containing multiple still images from video is filed herewith).

Image of Applicant's prototype that was located in Los Angeles Kings private training facility prior to Oct. 12, 2007, but after Sep. 21, 2006, as described more fully in the cover sheet accompanying this form.

Image of Applicant's prototype that was located in Los Angeles Kings private training facility prior to Oct. 12, 2007, but after Sep. 21, 2006, as described more fully in the cover sheet accompanying this form.

European Patent Office Action, European Application No. 06803914.8, date of mailing Mar. 29, 2010, in 4 pages.

European Patent Office Action, European Application No. 06803914.8, date of mailing Apr. 15, 2009, in 1 page.

Chinese Patent Office Action, Chinese Application No. 200680036255.7, date of mailing Aug. 21, 2009, in 2 pages.

Canadian Patent Office Action, Canadian Application No. 2,623,744,date of mailing Nov. 20, 2009, in 3 pages.

U.S. Appl. No. 12/767,767, filed Apr. 26, 2010, Kadar et al.

* cited by examiner

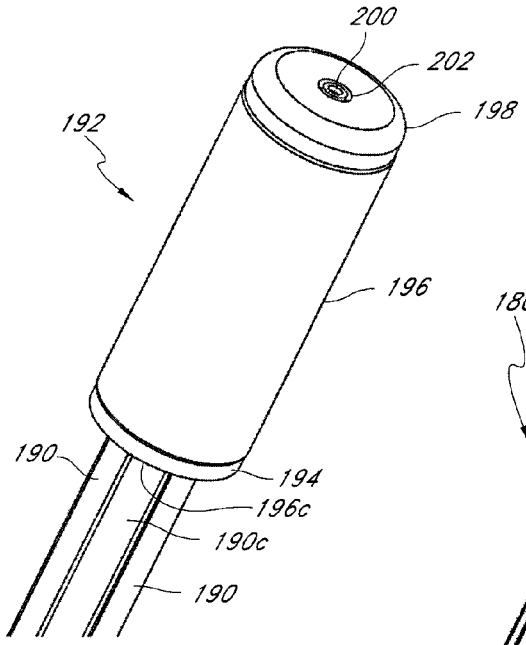
FIG. 15B
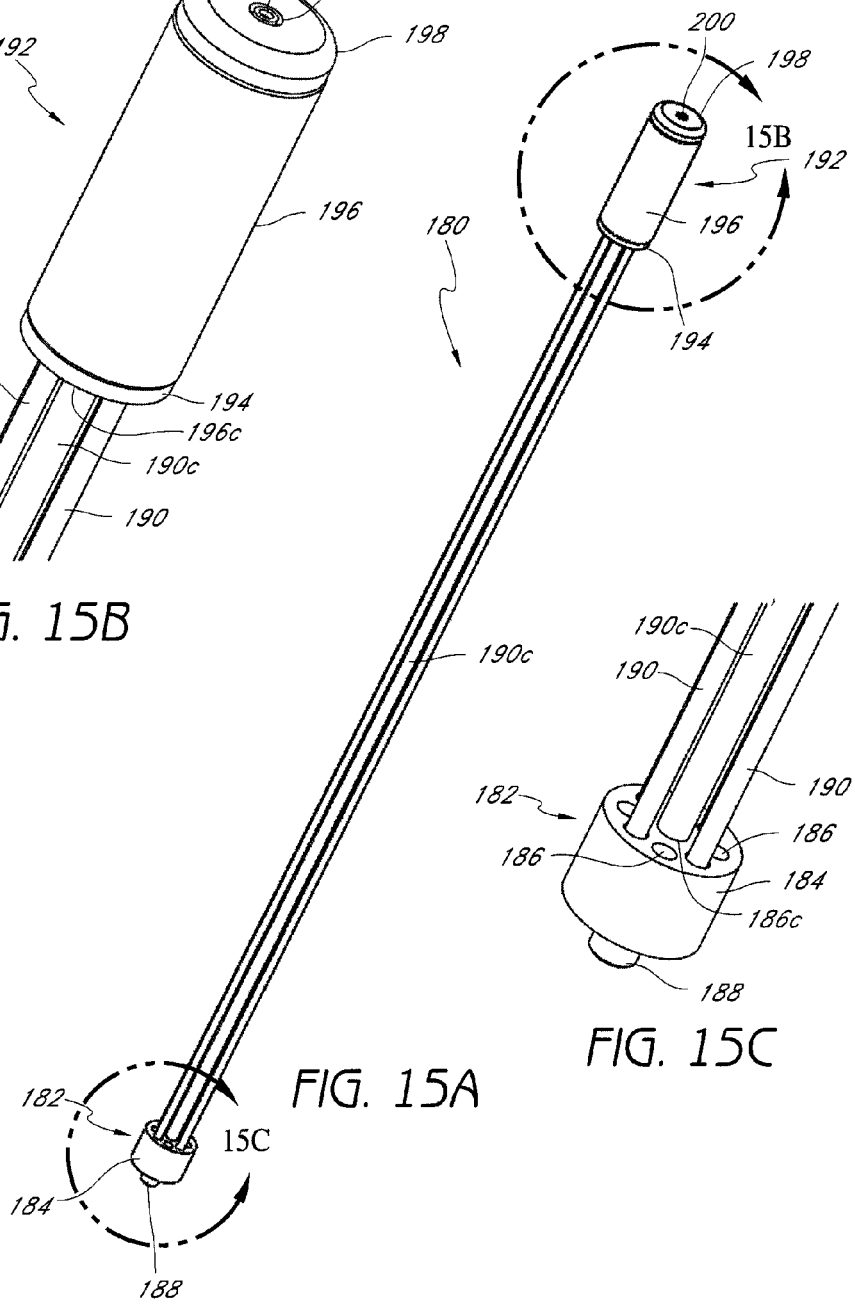
FIG. 15A
FIG. 15C

EXERCISE APPARATUS

PRIORITY INFORMATION

This application is a continuation in part of U.S. patent application Ser. No. 11/533,766, filed Sep. 21, 2006 (titled "Exercise Apparatus"), which claims priority to U.S. Provisional Application 60/721,669, filed Sep. 29, 2005. This application also claims priority benefit under 35 U.S.C. §119 (e) of Provisional Application 60/979,768 filed Oct. 12, 2007. Each of the three above-listed applications are hereby incorporated by reference as if fully set forth herein.

BACKGROUND

1. Technical Field

This disclosure relates to the field of exercise equipment utilizing deflectable resilient members.

2. Description of the Related Art

Without limitations, in general, the exercise apparatus or device of this disclosure relates to the use of deflectable resilient members for exercising the muscles of one's body. There are presently several known types of exercise machines and devices available on the market utilizing resilient members to provide resistance training. One such device, the Isotonic-Isometric Device for Exercise and Physical Therapy, comprises a single elongated exercise rod attached to a socket that is mounted to a metal base. Different forms of the mounting apparatus permit the metal base supporting the single resistance rod to be mounted to a floor, a desk, a table, a cabinet, a wall, a door, or a door frame. These various mounting applications are achieved by the use of a vacuum cup for surface mounting, a clamp for table or desk edge mounting, or a special mounting assembly for doorway mounting.

The Isotonic-Isometric Device for Exercise and Physical Therapy is limited to a single resistance rod and is not self-contained in that the utilization of this device depends upon the availability of a suitable mounting surface or object. Additionally, the amount of resistance that can be achieved by the Isotonic-Isometric Device for Exercise and Physical Therapy appears to be directly dependant on the robustness of the mounting apparatus and the surface or object that this device is mounted to. Furthermore, a device of this type cannot be easily configured to modify the orientation of the resistance member. It requires the user to disconnect the base from the surface or object that it is mounted to and remount the base to another surface or object that can provide for the desired orientation, if such a surface or object is available.

Another device that utilizes resilient members to provide resistance training, albeit through a cable pulley system, is the Universal Exercising Machine. This device is comprised of many components that, in essence, include a collapsible rigid frame, a plurality of cantilevered resilient members, two cables connecting a user selected handle attachment to the cantilevered resilient members, and a sliding bench. The cables are necessary components to operate this device. To utilize this device, the user grips the chosen handle attachment and exerts a force on the cables causing the cantilevered resistance members to bend. Thus, resistance is generated by the cantilevered, resilient rods when the cables are pulled by the user. Because the cables cannot withstand compressive forces, the resistance force generated by the cantilevered resistance members can only be generated uni-directionally. Further, the overall size, complexity, and number of components comprising this device makes it large, expensive, difficult to manufacture and more difficult to assemble.

SUMMARY OF SOME EMBODIMENTS

Certain embodiments described herein are directed to exercise devices and resilient members for exercising the muscles of one's body. However, it will be appreciated that the exercise devices and resilient members may have application to other fields. In some embodiments, a resilient member for fitness related exercise can be provided that can comprise one or more stiffening members (which can be axially resilient or axially rigid but bendable), a first member, and a second member. As used in this document, any reference to "some embodiments" or to any embodiment or component disclosed "herein" is meant to refer to any embodiments or components set forth explicitly or implicitly herein, and/or any embodiments or components incorporated by reference herein. In some embodiments, the first member can be positioned at a first portion of the resilient member and configured to be supported by a base member, the first member further being configured to support a first portion of the one or more stiffening members such that the one or more stiffening members extend therefrom in a cantilevered disposition. Further, in some embodiments, the second member can be spaced apart from the first member and configured to interact with a second portion of the one or more stiffening members such that, when a user exerts a force on the second member, at least the second portion of each of the one or more stiffening members deflects and a resistance can be provided.

In some embodiments, a resilient member for fitness related exercise can be provided that can comprise a first member configured to be supported by a base member and comprising a plurality of axial openings, a second member spaced apart from the first member and comprising a plurality of axial openings, and one or more stiffening members, wherein the first portion of the one or more stiffening members can be positioned in one or more of the plurality of axial openings in the first member such that the one or more stiffening members extend therefrom in a cantilevered disposition. Further, in some embodiments, the second portion of the one or more stiffening members can be positioned in one or more of the plurality of axial openings in the second member such that, when a user exerts a force on the second member, at least the second portion of each of the one or more stiffening members deflects and a resistance force can be provided.

In some embodiments, a resilient member for fitness related exercise is provided comprising a stiffening member defining a first portion and a second portion, a first member configured to be secured to a base member, comprising a first axial opening positioned near the axial center of the first member and plurality of additional axial openings being spaced apart from the first axial opening of the first member, a second member comprising a first axial opening positioned near the axial center of the second member and plurality of additional axial openings being spaced apart from the first axial opening of the second member, wherein the first portion of the stiffening member can be supported by the first axial opening of the first member so as to extend therefrom in a cantilevered disposition, the second portion of the stiffening member can be positioned in the first axial opening of the second member such that, when a user exerts a force on the second member, at least the second portion of the stiffening member deflects and a resistance force can be provided.

In some embodiments, a resilient member for fitness related exercise can be provided comprising a first stiffening member comprising a first portion and a second portion, a first member positioned at a first portion of the resilient member and configured to be supported by a base member, and a second member, wherein the first member can be further configured to support at least the first portion of the first stiffening member such that the first stiffening member extends therefrom in a cantilevered disposition, the second member can be configured to interact with the second portion of the first stiffening member such that, when a user exerts a force on the second member, at least a second portion of the first resilient member deflects and a resistance force can be provided.

In some embodiments, a resilient member for fitness related exercise is provided comprising one or more stiffening members, each having a first end portion and a second end portion, a first member positioned at a first portion of the resilient member and configured to be secured to a base member and to support the one or more stiffening members, and a second member configured to support the second end portion of each the one or more stiffening members such that, when a lateral force can be exerted on the second member, the second end portion of each of the one or more stiffening members deflects.

In some embodiments, a method of exercising the muscles of one's body is provided, comprising providing a resilient member, supporting the resilient member in a cantilevered disposition so that the first portion of the resilient member can be substantially prevented from pivoting relative to the exercise device base member, exerting a force on the resilient member so as to deflect at least a portion of the resilient member and effect an exercising of one or more muscles in the user's body, and varying the resistance force provided by the resilient member by adding or removing at least one additional stiffening member to the resilient member, wherein each of the at least one additional stiffening members supported by the resilient member can be supported by the resilient member such that at least a first portion of the at least one additional stiffening member extends from the first member in a cantilevered disposition. In some embodiments, the resilient member can comprise at least one stiffening member, a first member positioned at a first portion of the resilient member and configured to be supported by a base member in a cantilevered disposition so that the first portion of the resilient member can be substantially prevented from pivoting relative to the exercise device base member, the first member further configured to support a first portion of the at least one stiffening member such that the at least one stiffening member extend therefrom in a cantilevered disposition, and a second member configured to at least radially support at least a second portion of the at least one stiffening member such that, when a user exerts a force on the second member, at least the second portion of each of the at least one stiffening member deflects from the longitudinal axis of the relaxed position of each of the at least one stiffening member and a resistance is provided. In some embodiments, the resilient member can comprise at least one stiffening member that can be at least axially supported by the first and second members.

In some embodiments, a device for exercising the muscles in one's body is provided that can comprise a base and a resilient member, wherein the base can be configured to provide one or more removable supports for an end portion of the resilient member such that the resilient member extends therefrom in a cantilevered disposition, and the resilient member comprises one or more stiffening members that can be, but are not required to be axially rigid (as with any embodiments described herein), a first member positioned at a first portion of the resilient member and configured to be supported by the base member and to provide a support for the one or more stiffening members such that the one or more stiffening members extend therefrom in a cantilevered disposition, and a second member supported by at least one of the one or more stiffening members and configured such that, when a user exerts a force on the second member, at least a portion of each of the one or more stiffening members deflects and a resistance force can be provided.

BRIEF DESCRIPTION OF THE DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

FIG. 15A is a perspective view of an embodiment of a resilient member.

FIG. 15B is an enlarged perspective view of a portion of the embodiment of the resilient member illustrated in FIG. 15A defined by curve 15B in FIG. 15A.

FIG. 15C is an enlarged perspective view of a portion of the embodiment of the resilient member illustrated in FIG. 15A defined by curve 15C in FIG. 15A.

DETAILED DESCRIPTION OF SOME EMBODIMENTS

The following detailed description is now directed to certain specific embodiments of the present disclosure. In this description, reference is made to the drawings wherein like parts are designated with like numerals throughout the description and the drawings.

Figure 1:
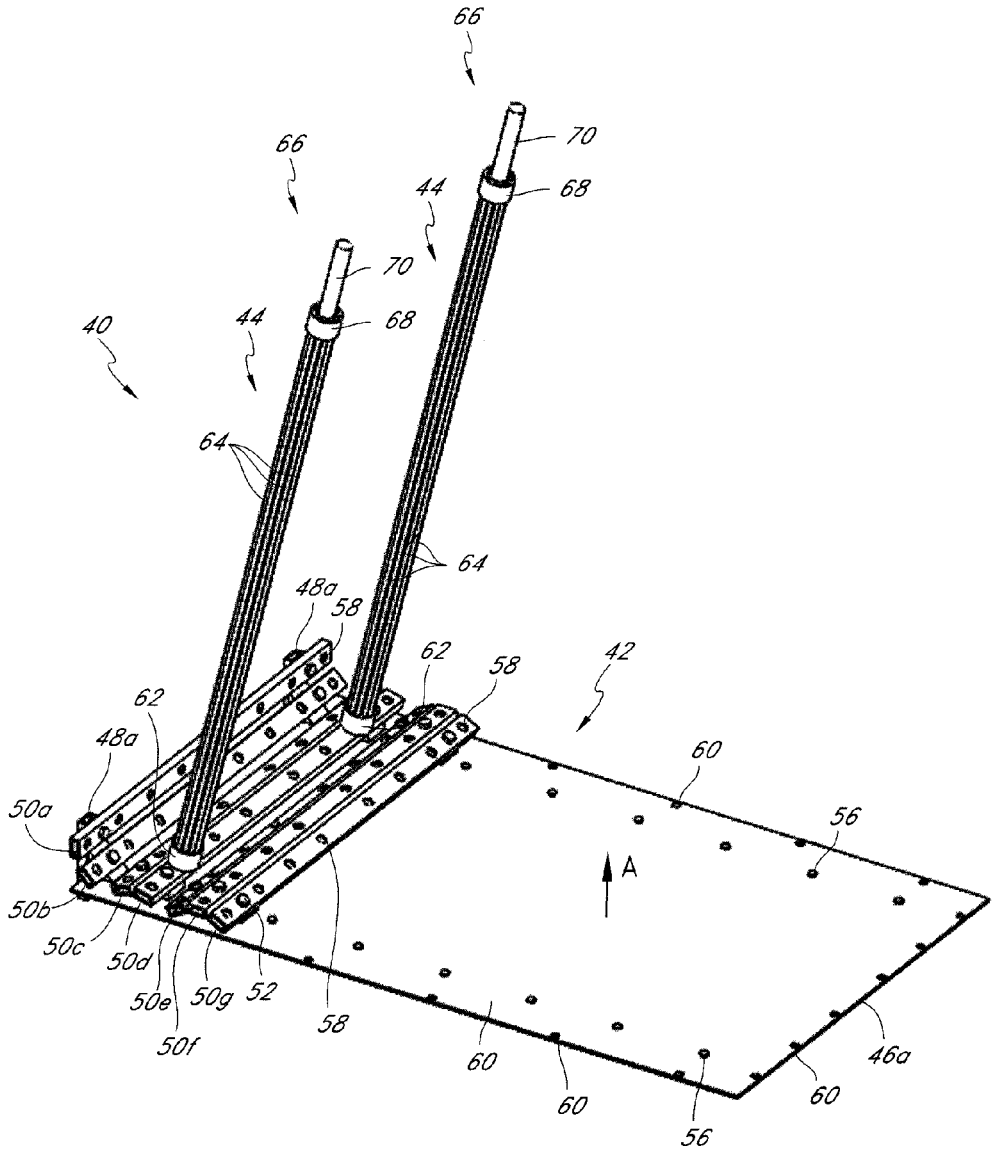
FIG. 1 is a perspective view of an embodiment of an exercise device.

FIG. 1 is a perspective view of an embodiment of an exercise device 40. The exercise device 40 can comprise a base 42 and resilient members 44. In the illustrated embodiment, the base 42 can be configured to be free standing on a generally flat, horizontal surface so as to provide a supporting surface for a user of the exercise device in a standing, sitting, kneeling, or any other desired position. However, the exercise device 40 is not so limited. In some embodiments, the base 42 can be attached to and, hence, supported by a horizontal, vertical or inclined surface, or can be configured to be free standing in a vertical or any angular orientation. As used in this document, any reference to "some embodiments" or to any embodiment or component disclosed "herein" is meant to refer to any embodiments or components set forth explicitly or implicitly herein, and/or any embodiments or components incorporated by reference herein.

Figure 2:
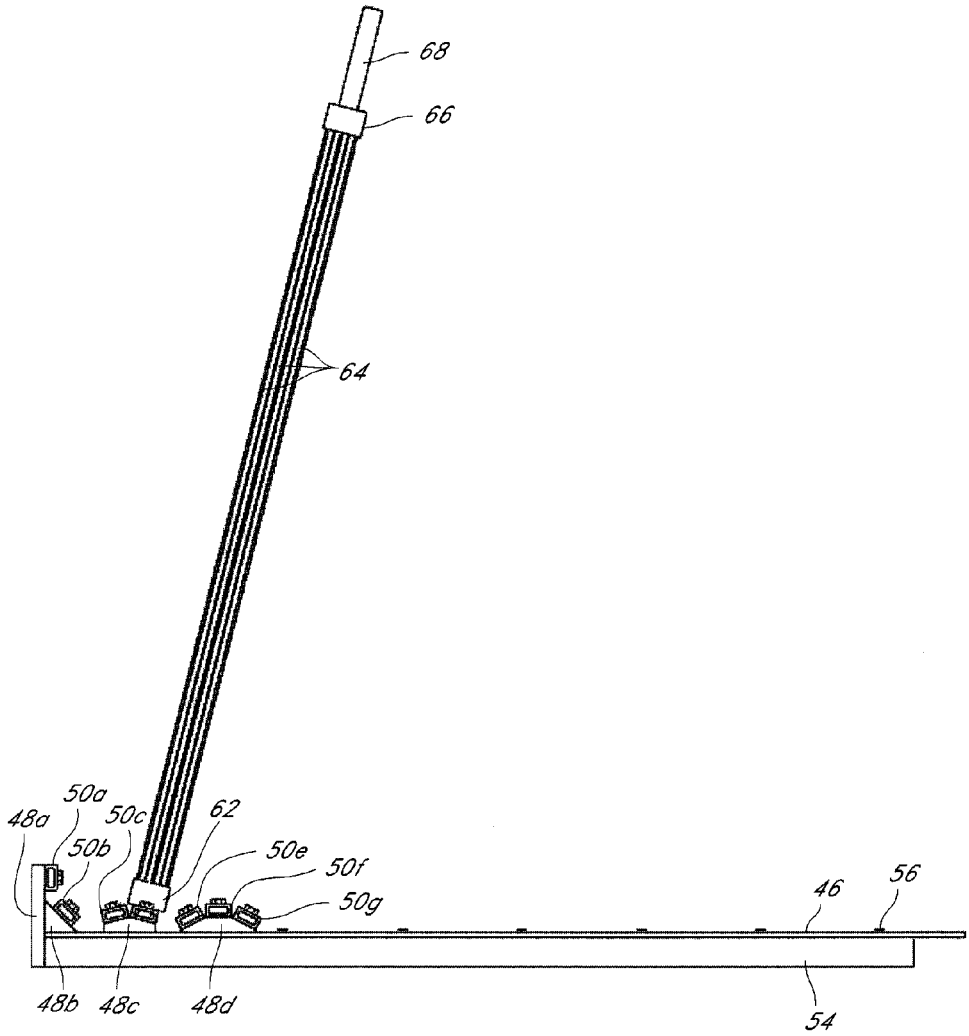
FIG. 2 is a side view of the embodiment of the exercise device shown in FIG. 1.

As illustrated in FIGS. 1-2, the base 42 can comprise a supporting base member 46, a pair of first base interface members 48*a*, a pair of second base interface members 48*b*, a pair of third base interface members 48*c*, a pair of fourth base interface members 48*d*, and a plurality of base connection members 50 can be made from steel, aluminum, or any other suitable rigid material and secured to the base interface members 48*a*-48*d* with a plurality of bolts or screws 52 threadably engaged in the base interface members 48*a*-48*d*. However, the base connection members 50 can be directly or indirectly secured to the base interface members 48*a*-48*d* by any other means, including but not limited to the use of welds, rivets, adhesive, fusion, or by any other suitable method or method known in the art. In addition, the base connection members 50 can be secured directly to the supporting base member 46. Alternatively, any of the base connection members 50 can be integrally formed with one or more of the base interface members 48*a*-48*d*.

In the illustrated embodiment, the base 42 can also comprise support rails 54 can be bolted to the supporting base member 46 with a plurality of bolts or screws 56, as well as cross-members (not shown) spanning substantially laterally between the support rails 54. In the illustrated embodiment, there can be four equally spaced cross-members spanning substantially laterally between the support rails 54 to increase the rigidity of the supporting base member 46. The support rails 54 and cross-members can also be secured to the supporting base member 46 by any other suitable means, including but not limited to the use of welds, rivets, adhesive, fusion, or by any other suitable method or method known in the art. In some embodiments, the base 42 can be sized and configured such that support rails and other supporting components or members can be not needed. The support rails 54 and cross-members can increase the rigidity and support strength of the base 42 to provide a beneficial support surface for the user of the exercise device 40 in a standing, sitting, kneeling, or other position.

The base connection members 50 each can comprise a plurality of connection interfaces 58. In some embodiments, each of one or more connection interfaces 58 can be configured to provide a removable securement for an end portion of a resilient member such that the resilient member extends therefrom in a cantilevered disposition. In some embodiments, each of one or more connection interfaces 58 can be formed of a channel either partially or fully protruding through one or more base connection members 50. In some embodiments, each of one or more connection interfaces 58 can be formed of a channel either partially or fully protruding through the supporting base member 46.

In some embodiments, the connection interfaces 58 can define an inner surface having substantially the same geometrical configuration and size as an outer surface of the portion of the resilient member 44 that can be secured to the connection interface connection interface 58. Alternatively, the connection interfaces 58 can be configured to be protrusions extending from the supporting base member 46 or other intermediary component. Accordingly, another embodiment of a resilient member 44 can be configured to define an opening at or near the bottom thereof such that, when the opening on the resilient member 44 is inserted over the protruding connection interface, the resilient member 44 can be secured thereto in a cantilevered disposition.

Each connection interface connection interface 58 can be configured to at least restrain one end of the resilient member 44 in a cantilevered fashion so that a user can perform exercises by grasping the unrestrained portion of one or more resilient members 44 in his or her hand or hands and, exerting a generally transverse force against the unrestrained portion of the resilient member 44, causes the resilient member 44 to bend in flexure. The stiffness of the resilient member 44 provides the resistance desired for performing the exercises. The resilient member 44 can permit multi-directional resistance and can be used independently or simultaneously, permitting the user to perform multiple different exercises simultaneously.

Figure 3:
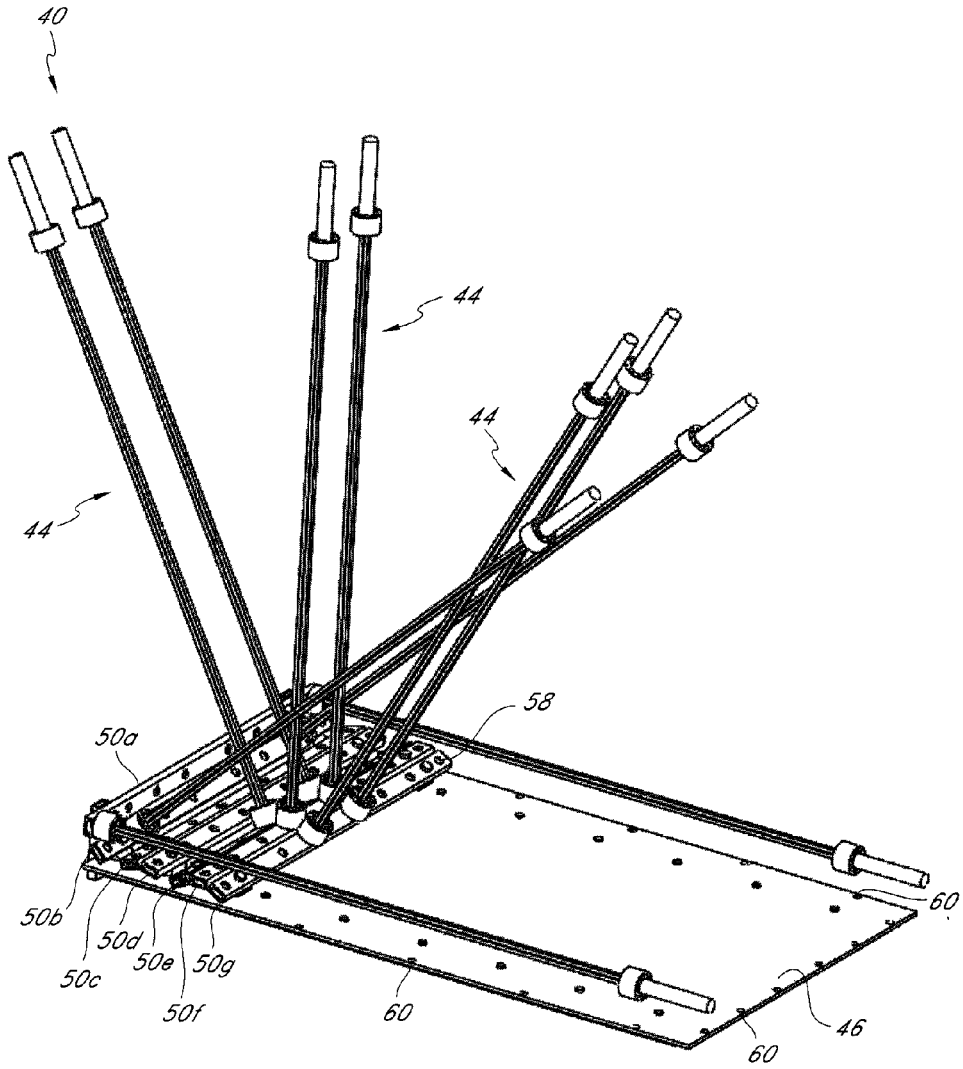
FIG. 3 is a perspective view of an embodiment of an exercise device including a plurality of an embodiment of a resilient member positioned in a variety of locations and angular orientations.

FIG. 3 is a perspective view of an embodiment of an exercise device, including a plurality of an embodiment of a resilient member positioned in a variety of locations and angular orientations. FIG. 3 illustrates the wide ranging variety of locations and angular orientations that each of the resilient members 44 can be positioned in relative to the supporting base member 46. However, the number, location, and orientation of the base connection members 50 and the connection interfaces 58 of the exercise device 40 are not limited to the number, location, and orientation of the base connection members 50 and connection interfaces 58 described or illustrated herein. The exercise device 40 can be configured such that the base connection members 50 and connection interfaces 58 are widely ranging in number, location, and orientation.

In some embodiments, the connection interfaces 58 are arranged so as to by symmetrical about a plane bisecting the supporting base member 46 and perpendicular to the supporting base member front edge 46*a* so that the user can simultaneously perform identical exercise motions on the left and right side of his or her body. However, the exercise device is not so limited. The exercise device can permit a widely variable number of locations and orientations of the connection interfaces 58 relative to the user beyond those described above and illustrated herein. Thus, while the connection interfaces 58 can be symmetrically arranged, the exercise device is not so limited.

In the illustrated embodiment, the exercise device 40 can comprise a base connection member 50*a* having eight connection interfaces 58 each defining a centerline axis (not shown) that can be angled approximately ninety degrees relative to an axis A that can be normal to a top surface of the supporting base member 46, a base connection member 50*b* having eight connection interfaces 58 each defining a centerline axis (not shown) that can be angled approximately forty-five degrees relative to axis A in a direction toward base member front edge 46*a*, a base connection member 50*c* having eight connection interfaces 58, each defining a centerline axis (not shown) that can be angled approximately thirteen degrees relative to axis A in a direction away from base member front edge 46*a*, a base connection member 50*d* having eight connection interfaces 58 each defining a centerline axis (not shown) that can be angled approximately thirteen degrees relative to axis A in a direction toward base member front edge 46*a*, a base connection member 50*e* having eight connection interfaces 58 each defining a centerline axis (not shown) that can be angled approximately twenty-six degrees relative to axis A in a direction away from base member front edge 46*a*, a base connection member 50*f* having eight connection interfaces 58 each defining a centerline axis (not shown) that can be angled approximately parallel to axis A, and a base connection member 50*g* having eight connection interfaces 58 each defining a centerline axis (not shown) that can be angled approximately twenty-six degrees relative to axis A in a direction toward base member front edge 46*a*.

In some embodiments, the exercise device 40 can comprise a base connection member 50 having one or more connection interfaces 58 each defining a centerline axis (not shown) that can be angled from approximately zero to approximately ten degrees relative to axis A in a direction away from base member front edge 46*a*. In some embodiments, the exercise device 40 can comprise a base connection member 50 having one or more connection interfaces 58 each defining a centerline axis (not shown) that can be angled from approximately zero to approximately ten degrees relative to axis A in a direction toward base member front edge 46*a*. In some embodiments, the exercise device 40 can comprise a base connection member 50 having one or more connection interfaces 58 each defining a centerline axis (not shown) that can be angled from approximately ten to approximately twenty degrees relative to axis A in a direction away from base member front edge 46*a*. In some embodiments, the exercise device 40 can comprise a base connection member 50 having one or more connection interfaces 58 each defining a centerline axis (not shown) that can be angled from approximately ten to approximately twenty degrees relative to axis A in a direction toward base member front edge 46*a*. In some embodiments, the exercise device 40 can comprise a base connection member 50 having one or more connection interfaces 58 each defining a centerline axis (not shown) that can be angled from approximately twenty to approximately thirty degrees relative to axis A in a direction away from base member front edge 46*a*. In some embodiments, the exercise device 40 can comprise a base connection member 50 having one or more connection interfaces 58 each defining a centerline axis (not shown) that can be angled from approximately twenty to approximately thirty degrees relative to axis A in a direction toward base member front edge 46*a*. In some embodiments, the exercise device 40 can comprise a base connection member 50 having one or more connection interfaces 58 each defining a centerline axis (not shown) that can be angled from approximately thirty to approximately fifty degrees relative to axis A in a direction away from base member front edge 46*a*. In some embodiments, the exercise device 40 can comprise a base connection member 50 having one or more connection interfaces 58 each defining a centerline axis (not shown) that can be angled from approximately thirty to approximately fifty degrees relative to axis A in a direction toward base member front edge 46*a*.

In some embodiments, the exercise device 40 can comprise a base connection member 50 having one or more connection interfaces 58 each defining a centerline axis (not shown) that can be angled from approximately fifty to approximately seventy degrees relative to axis A in a direction away from base member front edge 46*a*. In some embodiments, the exercise device 40 can comprise a base connection member 50 having one or more connection interfaces 58 each defining a centerline axis (not shown) that can be angled from approximately fifty to approximately seventy degrees relative to axis A in a direction toward base member front edge 46*a*. In some embodiments, the exercise device 40 can comprise a base connection member 50 having one or more connection interfaces 58 each defining a centerline axis (not shown) that can be angled from approximately seventy to approximately ninety degrees relative to axis A in a direction away from base member front edge 46*a*. In some embodiments, the exercise device 40 can comprise a base connection member 50 having one or more connection interfaces 58 each defining a centerline axis (not shown) that can be angled at between approximately seventy and approximately ninety degrees relative to axis A in a direction toward base member front edge 46*a*. In some embodiments, the exercise device 40 can comprise a base connection member 50 having one or more connection interfaces 58 each defining a centerline axis (not shown) that can be angled from approximately ninety to approximately one hundred and twenty degrees relative to axis A in a direction away from base member front edge 46*a*. In some embodiments, the exercise device 40 can comprise a base connection member 50 having one or more connection interfaces 58 each defining a centerline axis (not shown) that can be angled from approximately ninety to approximately one hundred and twenty degrees relative to axis A in a direction toward base member front edge 46*a*.

Finally, supporting base member 46 can comprise one or more base cut-outs 60 that can be formed through the supporting base member 46 around the perimeter of the supporting base member 46, as illustrated most clearly in FIGS. 1 and 3. The base cut-outs 60 can be sized and configured so as to secure therein one or more axial resistance bands or other similar exercise devices. This can allow the user to perform additional exercises when standing, kneeling, or sitting on the supporting base member 46.

Referring again to FIGS. 1-2, the exercise device 40 can comprise a pair of resilient members 44. The embodiments of the resilient members 44 shown in FIGS. 1-2 each comprise a first member 62 (also referred to herein as an insert member or carrying member), one or more stiffening members 64, and a second member 66 (also referred to herein as a handle member or retention member). In the illustrated embodiment and in every embodiment disclosed herein, each stiffening member can be formed from nylon, Delrin, polyvinyl chloride, or other suitable polymers, resilient materials, or fiber-based materials, such as fiberglass or glass-filled polymers, or any combination or composite thereof or of any other suitable material. Additionally, in the illustrated embodiment and in every embodiment disclosed herein, each stiffening member 64 can define a cylindrical cross-section, but may define any cross-sectional geometry such as a triangle, square, or any other polygonal or any other suitable geometry.

In the illustrated embodiment, the handle member 66 can comprise a handle retention portion 68 and a gripping portion 70. Without limitation, the retention portion of any embodiment described herein can be configured to provide lateral, or radial, support to the upper end of each of the stiffening members that are inserted therein. Further, without limitation, the gripping portion of any embodiment herein can be configured to provide a gripping surface for a user of the resilient members, to which a lateral force can be applied that will cause the resilient member to deflect, developing a resistance and effecting an exercising motion for the user. Additionally, other handles, bars, or grips can be secured to the handle member of any embodiment described herein to provide other gripping orientations and surfaces for the user. For example, without limitation, the handle member can be configured to secure a single rubber or metal handle, a rope handle, or a "W" shaped bar thereto for this purpose.

In the embodiment illustrated in FIGS. 1-2, the retention portion 68 and gripping portion 70 may be integrally formed from a single piece of material, which can be aluminum, a high strength polymer, or other suitable material. In some embodiments, retention portion 68 and gripping portion 70 may be formed from two different pieces of material and fixed together by adhesives, or one or more bolts, screws, rivets, or welds, or by any other suitable fastening method or combination of the foregoing. Either the retention portion 68 or gripping portion 70 may be formed from a material of the group comprising plastic, aluminum, steel, fiberglass, or any other suitable material. The retention portion 68 and gripping portion 70 can be rigid. In some embodiments, the retention portion 68 can be comprised of a material that has beneficial lubrication properties or a low coefficient of friction so as to permit the stiffening member or members 64 secured by the retention portion 68 to axially translate substantially unrestricted relative to the retention portion 68 when the resilient member 44 is deflected.

Figures 11, 12A, 12B, 13:
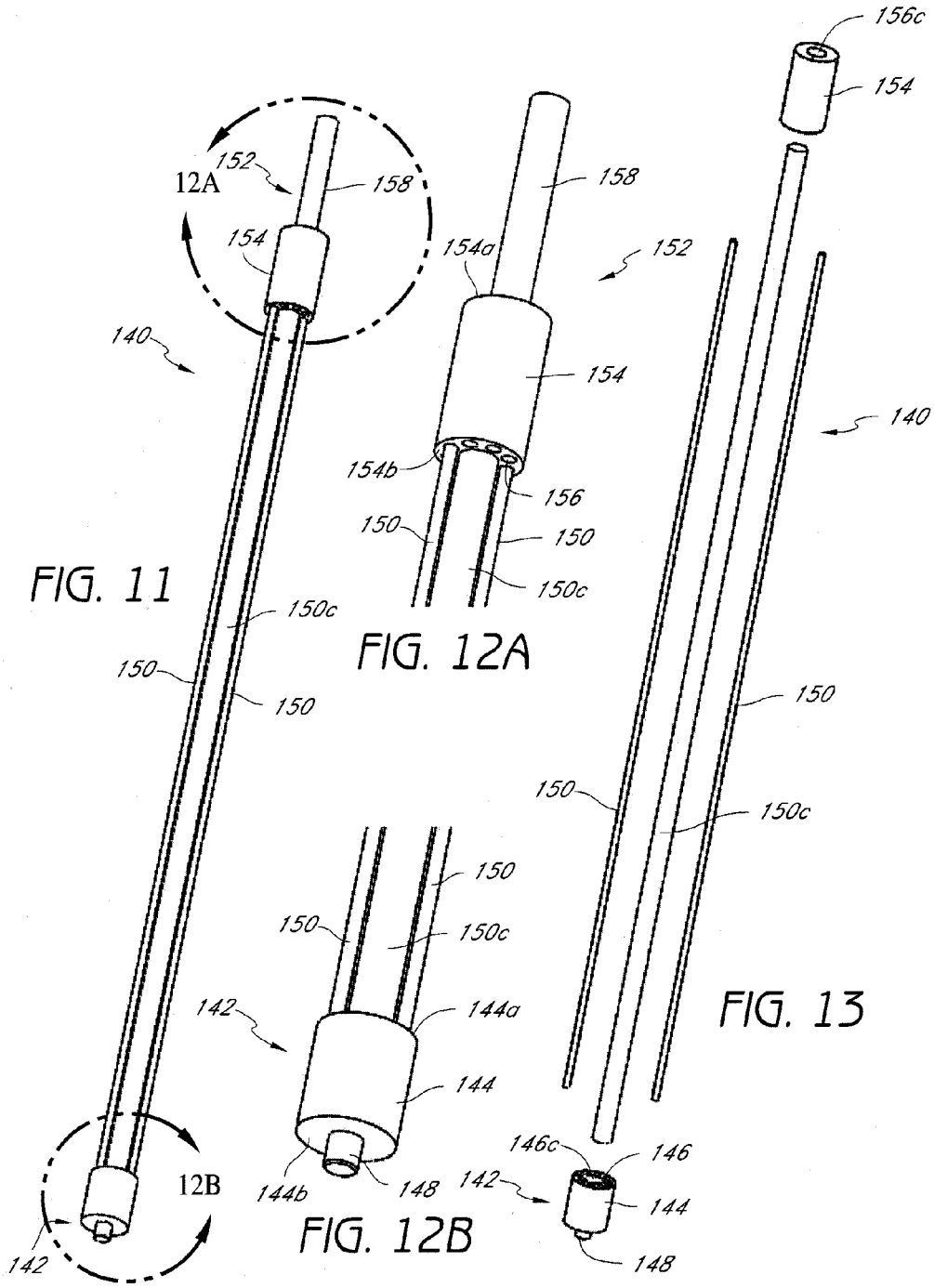
FIG. 11 is a perspective view of an embodiment of a resilient member.
FIG. 12A is an enlarged perspective view of a portion of the embodiment of the resilient member illustrated in FIG. 11 defined by curve 12A in FIG. 11.
FIG. 12B is an enlarged perspective view of a portion of the embodiment of the resilient member illustrated in FIG. 11 defined by curve 12B in FIG. 11.
FIG. 13 is an exploded perspective view of the embodiment of the resilient member illustrated in FIG. 11.
Figure 14B:
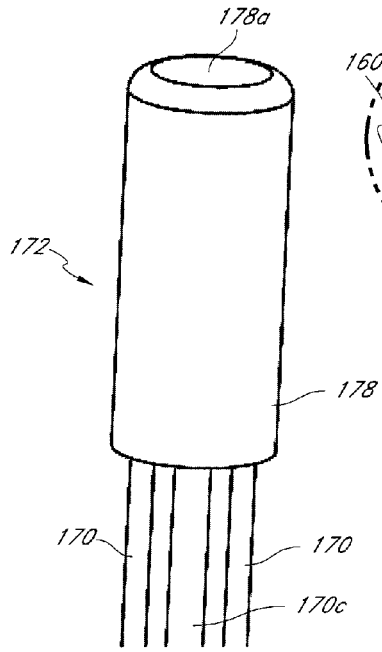
FIG. 14B is an enlarged perspective view of a portion of the embodiment of the resilient member illustrated in FIG. 14A defined by curve 14B in FIG. 14A.
Figure 14C:
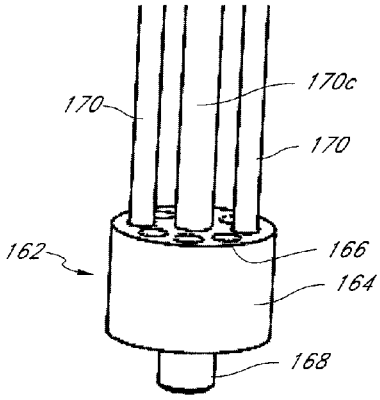
FIG. 14C is an enlarged perspective view of a portion of the embodiment of the resilient member illustrated in FIG. 14A defined by curve 14C in FIG. 14A.
Figure 14A:
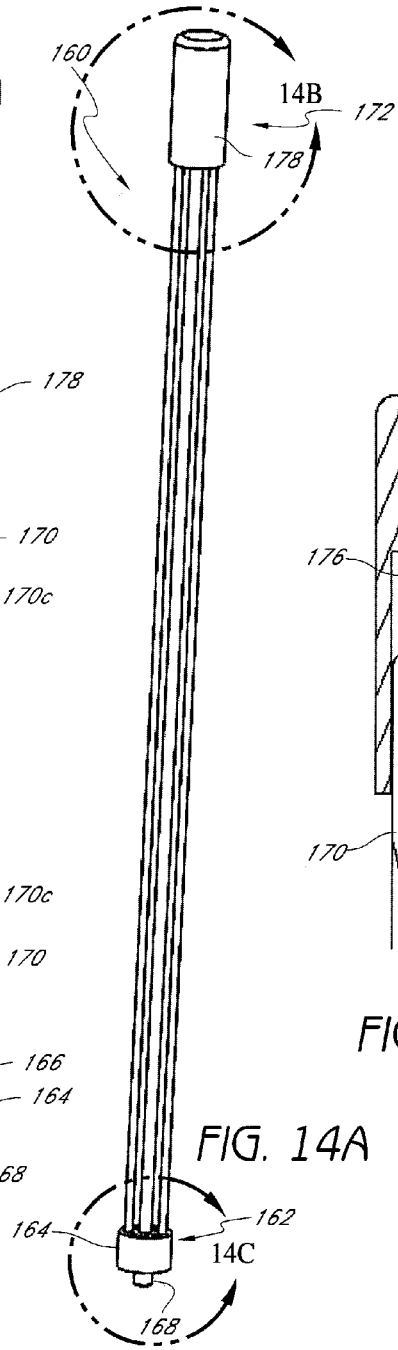
FIG. 14A is a perspective view of an embodiment of a resilient member.
Figure 14D:
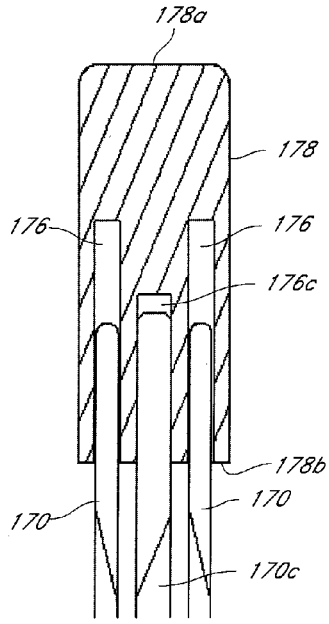
FIG. 14D is a section view of a portion of the embodiment of the resilient member illustrated in FIG. 14A taken through the axial center of such resilient member.

In the embodiment of the resilient member 62*a* illustrated in FIGS. 13 and 14, each insert 64 and each connection interface 56 can be threaded or comprise other suitable locking features so that, when the inserts 64 are inserted into the connection interfaces, the inserts 64 and, hence, the resilient members 62*a*, will not become inadvertently disengaged during use. Each insert 64 also serves another function—to provide a common interface with the connection interfaces. A resilient member with a non-circular cross-section could not be securely inserted into a cylindrical connection interface. An insert 64 with a circular cross-sectional portion can be affixed to the end of the non-circular resilient member so that the resilient member can be inserted into the cylindrical connection interface. Furthermore, an effective way to vary the resistance of the exercise can be to vary the cross-sectional thickness of the resilient member 64. Attaching an insert 64 with a portion that matches the geometry of the connection interfaces 56 to the end of each such varying resilient member would overcome the mismatch that would otherwise prevent the resilient members of varying cross-sectional configurations that do not match the configuration of the connection interfaces from inserting into the connection interfaces. Thus, each insert 64 provides an interface between the resilient member and the connection interfaces so that resilient members of varying diameter or cross-sectional geometry can be inserted in the same connection interface.

The embodiment of the resilient member 80 illustrated in FIGS. 4A-6C can comprise an insert member 82, one or more stiffening members 90, and a handle member 92. Each insert member 82 can comprise a retention portion 84 comprising a plurality of openings 86 through the top surface 84*a* that can be formed at a depth so as to not pass through the bottom surface 84*b* of the retention portion 84, and a connection portion 88 that can protrude from the bottom surface 84*b* of the retention portion 84. In some embodiments, the connection portion 88 can be an opening in the insert member 82 configured to be secured by a protrusion extending from the base or supporting base member. Additionally, the retention portion 84 and the connection portion 88 can be integrally formed from a single piece of material, or can be formed from multiple different pieces of the same or different material and joined together with welds, adhesive, screws, pins, threads, or other fastening means. In the illustrated embodiment, the retention portion 84 can be sized and configured to provide cantilever support to the first or lower end portion of each of a plurality of stiffening members 90 in each of the openings 86.

The retention portion 84 in the illustrated embodiment, or the retention portion in any embodiment described herein, can define a circular cross-section, but may define any suitable cross-section such as triangular, square, pentagonal, hexagonal, or other polygonal or desired shape. With the exception of the four openings 86 near the axial center of the insert member 82, the openings 86 can be sized and configured to define an inside surface that can be geometrically similar to, but slightly larger than, the end portion of the stiffening member 90 that can be supported in such opening 86 so that each of the stiffening members 90 can be removably inserted into each of those openings 86, yet sized and configured to eliminate excess lateral movement of the stiffening members 90 within the openings 86. Additionally, the retention portion in any embodiment described herein may comprise any desired or suitable number or configuration of openings.

However, in some embodiments, it can be preferred that the four stiffening members 90*c* positioned near the axial center of the insert member 82 be sufficiently tightly secured to the insert member 82 so that such stiffening members 90*c* cannot be inadvertently removed from the insert member 82 when the resilient members 80 are being used. Accordingly, in some embodiments, the four openings 86 positioned near the axial center of the insert member 82 can be sized and/or configured for a tight or even an interference fit with each of the four stiffening members 90*c* that are supported therein. Additionally, adhesive, screws, pins, threads, or other fastening means can be used to securely fasten each of the four stiffening members 90*c* positioned within each of the four openings 86 positioned at or near the axial center of the insert member 82 so as to prevent the stiffening members 90*c* from becoming removed from the openings 86 when an axial force is exerted on such stiffening members 90*c*.

In some embodiments, each opening 86 can define a circular cross-section. However, each opening 86 may define any suitable cross-section such as triangular, square, pentagonal, hexagonal, or other polygonal or desired shape. Similarly, the end portion of each of the stiffening members 90 that can be supported by each opening 86 can define a circular cross-section, but may define any suitable cross-section such as triangular, square, pentagonal, hexagonal, or other polygonal or desired shape.

Similarly, each handle member 98 can comprise a handle retention portion 94 comprising a plurality of openings 96 through the top surface 94*a* and the entire thickness of the handle retention portion 94. In the illustrated embodiment, the retention portion 94 can define a circular cross-section, but may define any suitable cross-section such as triangular, square, pentagonal, hexagonal, or other polygonal or desired shape. Each handle member 98 can also comprise a gripping portion 98 that can protrude axially from the top surface 94*a* of the handle retention portion 94. Additionally, in some embodiments, the holes 96*c* located near the axial center of the handle retention portion 94 can also penetrate through the bottom surface 94*b* of the handle member 98 and into a portion of the handle member 98 so as to align with the holes 96*c* located near the axial center of the handle retention portion 94.

In the illustrated embodiment, the handle retention portion 94 can be sized and configured to provide radial or lateral support to the upper end portion of each of a plurality of stiffening members 90 in each of the openings 96. In some embodiments, with respect to the stiffening members 90*c* located near the axial center of the handle retention portion 94, the handle retention portion 94 and openings 96 near the axial center of the handle retention portion 94 can be sized and configured to provide lateral, axial, and rotational support to the upper end portion of each of the four stiffening members 90*c* positioned near the axial center of the handle member 92 so as to restrain the stiffening members 90*c* from lateral, axial, and rotational movement relative to the handle member 92. Accordingly, in some embodiments, one or more of the four openings 96 positioned near the axial center of the handle member 92 can be sized and/or configured for a tight or even an interference fit with each of the four stiffening members 90*c* that are supported therein. Additionally, adhesive, screws, pins, threads, or other fastening means can be used to secure each of the four stiffening members 90*c* positioned within one or more of the four openings 96 positioned at or near the axial center of the insert member 92 so as to prevent the stiffening members 90*c* from becoming removed from the openings 96 when an axial force is exerted on such stiffening members 90*c*. Additionally, the handle retention portion in any embodiment described herein may comprise any desired or suitable number or configuration of openings, not limited to those described herein.

In some embodiments, with respect to the stiffening members 90*c* located near the axial center of the handle retention portion 94, the handle retention portion 94 can be sized and configured to provide lateral, axial, and rotational support to the upper end portion of only one of the four stiffening members 90*c* positioned near the axial center of the handle member 92. It may be preferable to provide axial support to only one of the stiffening members 90*c* located near the axial center of the handle retention portion 94 for a couple of reasons. First, it can be preferable to provide axial support to at least one of the stiffening members 90*c* located near the axial center of the handle retention portion 94 so that the handle member 92 will not become inadvertently removed from the stiffening members 90 when an axial force is exerted by a user on the handle member 92. Second, it may be preferable to permit three of the four centermost stiffening members 90 to freely translate in the axial direction because they are not collinear with the neutral bend axis (not shown) of the resilient member 80, but, rather, may be positioned off-center from the neutral bend axis (not shown). If each of the stiffening members 90 were axially restrained by the handle retention portion 94, because they are each offset from the neutral bend axis (not shown) of the resilient member 80, they may each experience an greatly increased stress when the resilient member 80 is deflected. This increased stress may cause each of such stiffening members 90 to buckle or to fail. However, the stiffening members 90 that are not axially restrained at their second portion can each have a neutral bend axis (not shown) that corresponds with their axial centerline, so as to avoid the heightened stresses that would otherwise be experienced by such stiffening members 90.

With the exception of the openings 96 for which axial restraint is desired, as discussed above, each of the other openings 96 can be sized and configured to define an inside surface that can be geometrically similar to, but slightly larger than, the end portion of the stiffening member 90 that can be supported in such opening 96 so that each of the stiffening members 90 can translate freely in the axial direction through each of those openings 96, yet sized and configured to eliminate excess lateral movement of the stiffening members 90 within the openings 96.

Figures 6A, 6B, 6C:
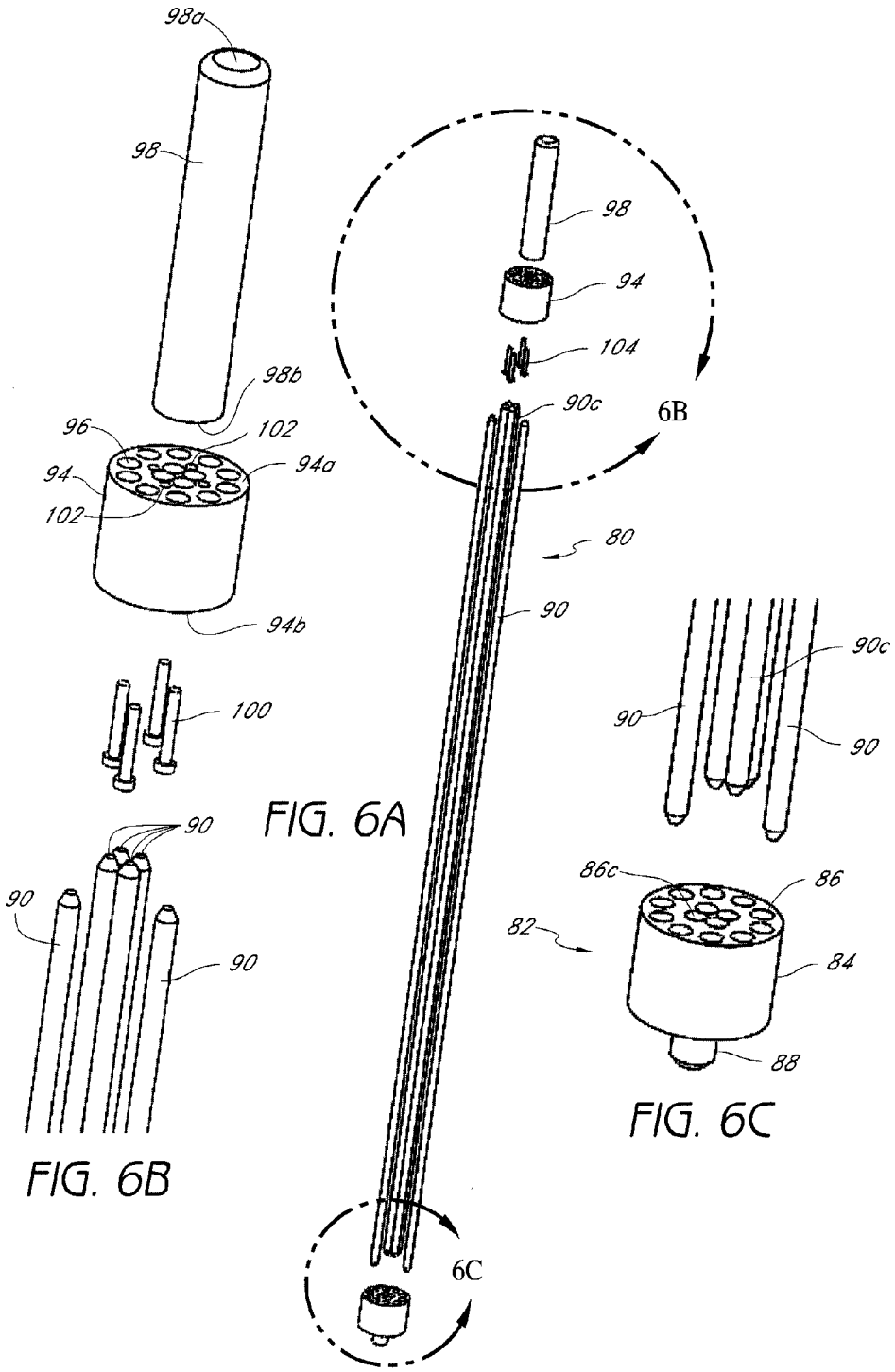
FIG. 6A is an exploded perspective view of the embodiment of the resilient member illustrated in FIG. 4A.
FIG. 6B is an enlarged perspective view of a portion of the embodiment of the resilient member illustrated in FIG. 6A defined by curve 6B in FIG. 6A.
FIG. 6C is an enlarged perspective view of a portion of the embodiment of the resilient member illustrated in FIG. 6A defined by curve 6C in FIG. 6A.

The handle member 98 can be secured to the handle retention portion 94 such that the bottom surface 94*b* of the handle member 98 can abut the top surface 94*a* of the handle retention portion 94. FIGS. 6A-6C are exploded perspective views of the embodiment of the resilient member illustrated in FIG. 4A. In the embodiment illustrated therein, the handle member 98 can be secured to the handle retention portion 94 by a plurality of bolts or screws 100 passing through through-holes 102 (that can be recessed) and threading into corresponding threaded holes (not shown) in the handle member 98. Alternatively, the handle member 98 can be secured to the handle retention portion 94 by any other suitable method, such as by, but not limited to, welds, fusion, or adhesion.

Figure 4B:
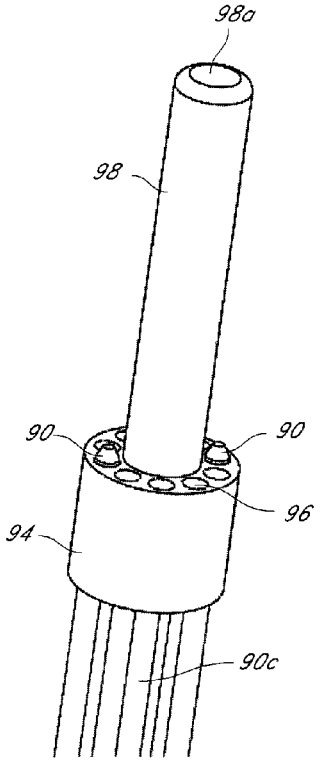
FIG. 4B is an enlarged perspective view of a portion of the embodiment of the resilient member illustrated in FIG. 4A defined by curve 4B in FIG. 4A.
Figure 4C:
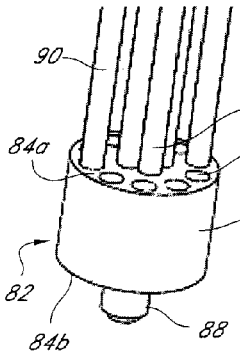
FIG. 4C is an enlarged perspective view of a portion of the embodiment of the resilient member illustrated in FIG. 4A defined by curve 4C in FIG. 4A.
Figure 4A:
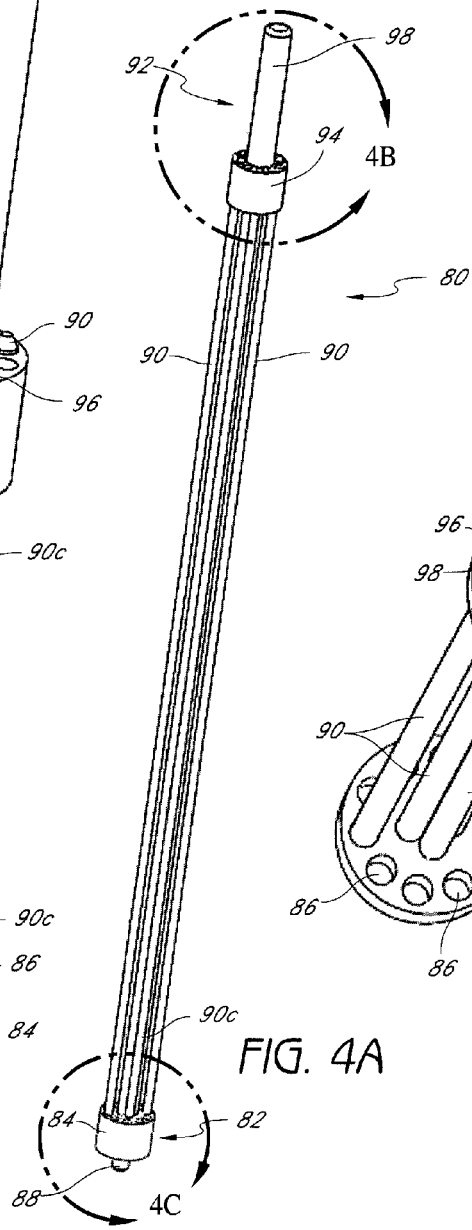
FIG. 4A is a perspective view of an embodiment of a resilient member.
Figure 5:
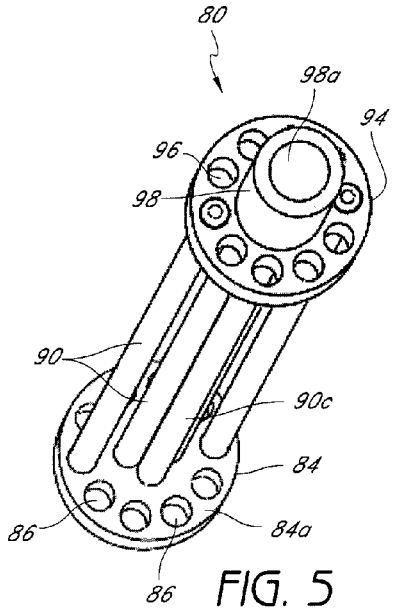
FIG. 5 is a perspective view of the embodiment of the resilient member illustrated in FIG. 4A.
Figure 7B:
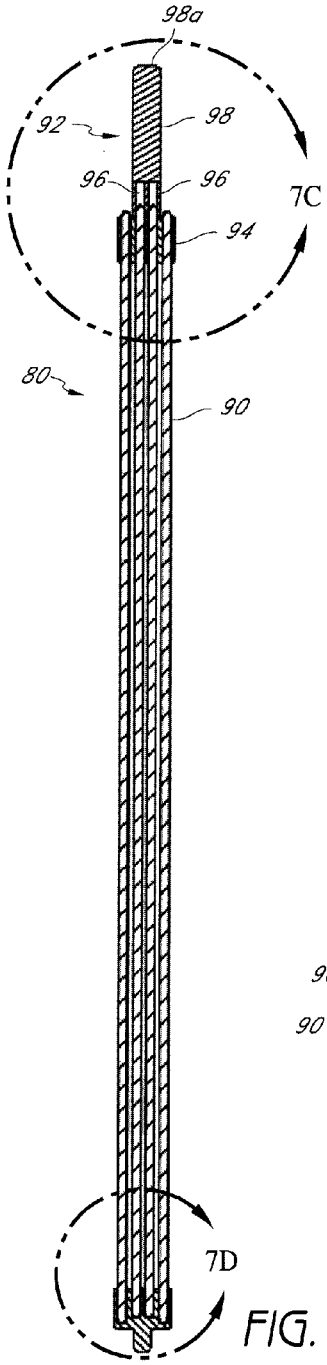
FIG. 7B is a section view of the embodiment of the resilient member illustrated in FIG. 7A taken along line 7B-7B in FIG. 7A.
Figure 7A:
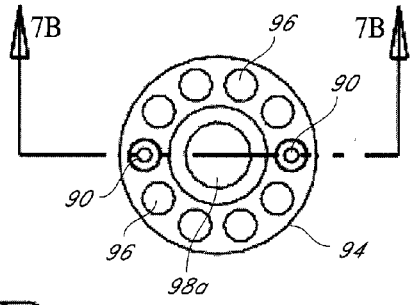
FIG. 7A is a top view of the embodiment of the resilient member illustrated in FIG. 4A.
Figure 7C:
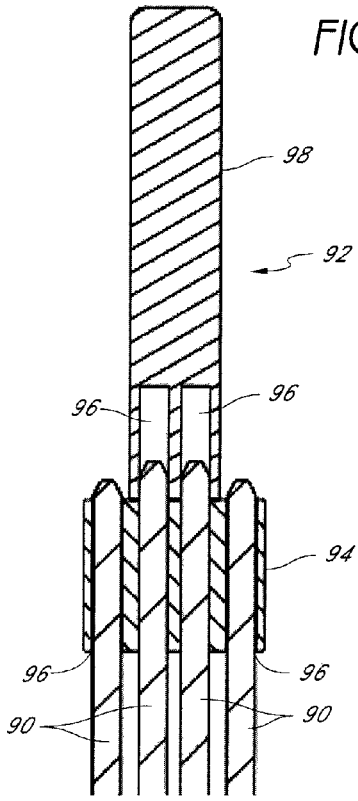
FIG. 7C is an enlarged section view of a portion of the embodiment of the resilient member illustrated in FIG. 7B defined by curve 7C in FIG. 7B.
Figure 7D:
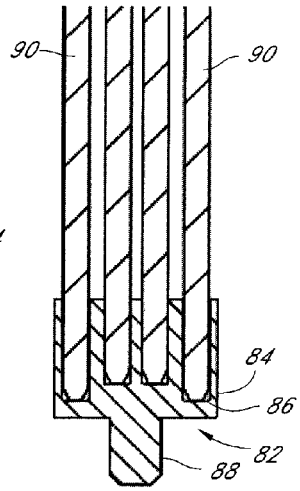
FIG. 7D is an enlarged section view of a portion of the embodiment of the resilient member illustrated in FIG. 7B defined by curve 7D in FIG. 7B.

FIG. 7B is a section view of the embodiment of the resilient member illustrated in FIG. 4A taken along line 7B-7B in FIG. 7A. As illustrated therein, the openings 96 in the handle member 98 can be sized such that, if axial restraint of the stiffening members 90*c* located near the axial center of the handle member 92 is not desired, there can be sufficient space for the stiffening members 90*c* to translate axially therein. Additionally, as illustrated therein, each of the stiffening members 90 can define a chamfer at both of the endmost edges to facilitate the insertion of such stiffening members 90 into the respective openings 86, 96.

Figures 8A, 8B, 8C, 8D:
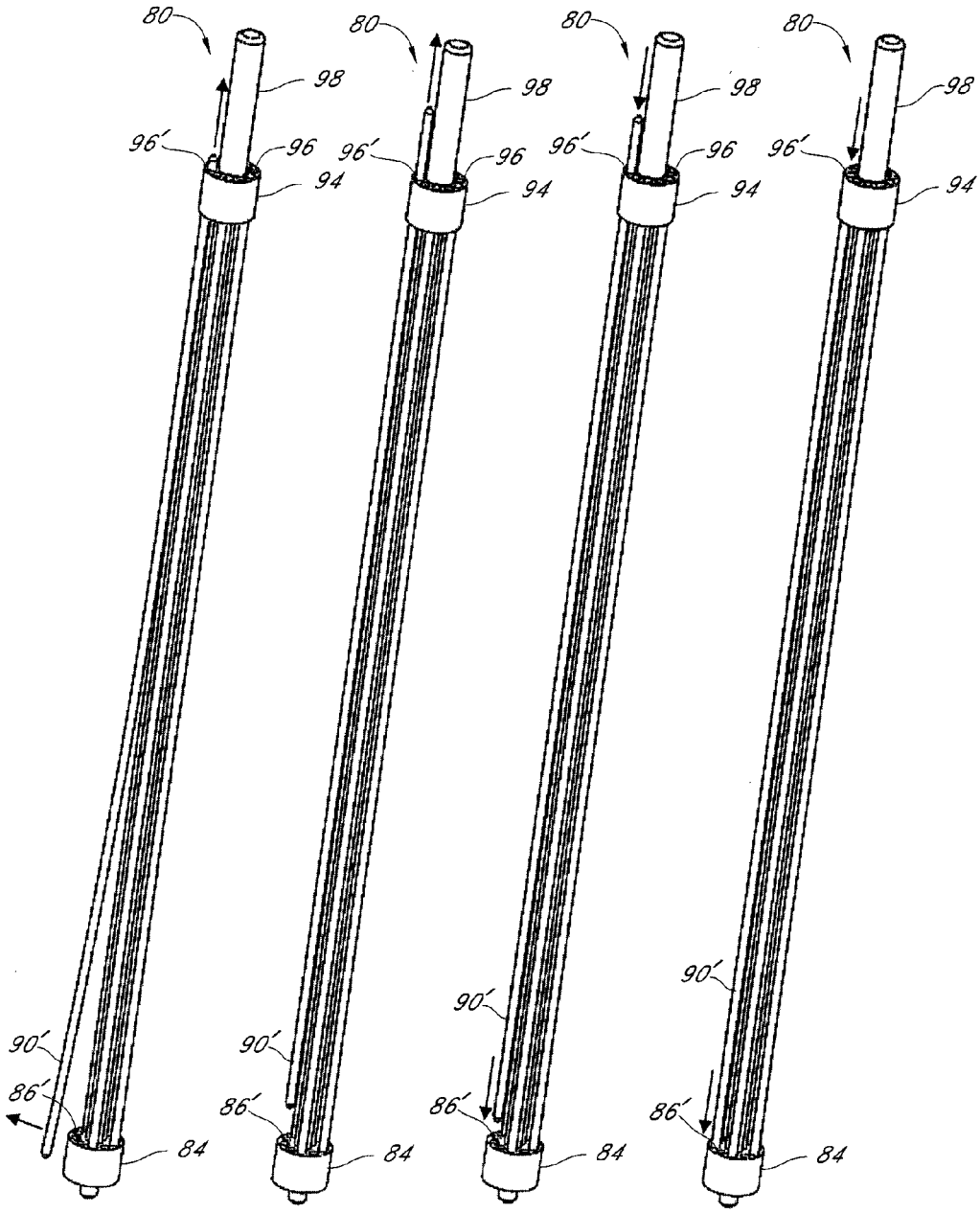
FIGS. 8A-8D are perspective views of the embodiment of the resilient member illustrated in FIG. 4A, illustrating the addition of an embodiment of a stiffening member to such resilient member.
Figure 9:
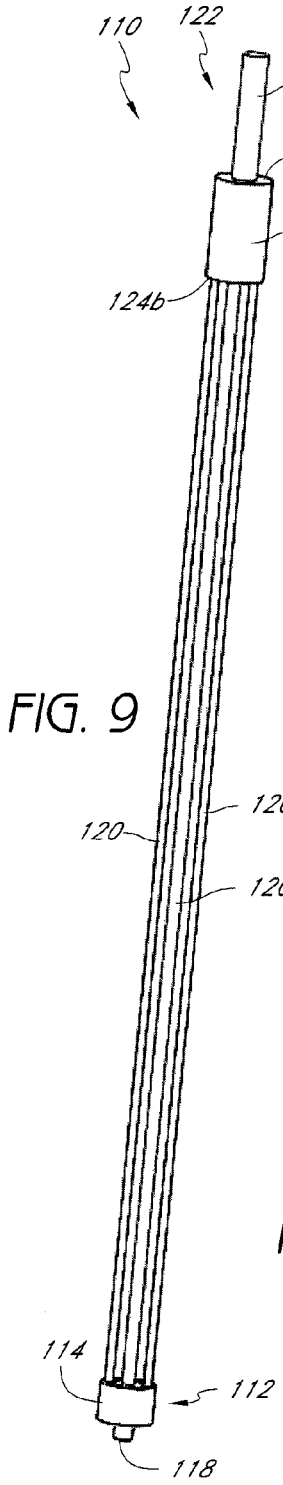
FIG. 9 is a perspective view of an embodiment of a resilient member.

FIGS. 8A-8D are perspective views of the embodiment of the resilient member 80 illustrated in FIG. 4A, illustrating the addition of an embodiment of a stiffening member 90 to such resilient member 80. As illustrated in FIG. 8A, the upper portion of the embodiment of the stiffening member 90' that is desired to be installed in the resilient member 80 can be first inserted through the opening 96' in the handle retention portion 94 in the upward direction. The bottom portion of the stiffening member 90' can be deflected outward due to the interference with the retention portion 84. As illustrated in FIG. 8B, the stiffening member 90' can be continued to be translated axially upward through the opening 96' in the handle retention portion 94 far enough such that the bottom edge of the stiffening members 90' can be above the top surface 84*a* of the retention portion 84. The bottom portion of the stiffening member 90' can be then allowed to straighten so that it can be inserted in the desired opening 86' in the retention portion 84. As illustrated in FIG. 8C, the stiffening member 90' can be translated axially downward through the opening 96' in the handle retention portion 94 such that the bottom portion of the stiffening member 90' can be translated downward into the opening 86' of the retention portion 84. As illustrated in FIG. 8D, the stiffening member 90' can be continued to be translated axially downward through the opening 96' in the handle retention portion 94 until the bottom portion of the stiffening member 90' can be fully engaged in the opening 86' of the retention portion 84. The resilient member 80 with the additional stiffening member 90' can be then ready to be used.

FIGS. 9 and 10A-10C are a perspective view and section views, respectively, of another embodiment of a resilient member 110. The embodiment of the resilient member 110 illustrated in FIGS. 9 and 10A-10C can comprise an insert member 112, one or more stiffening members 120, and a handle member 122. Each insert member 112 can comprise a retention portion 114 comprising a plurality of openings 116 through the top surface 114*a* that can be at a depth so as to not pass through the bottom surface 114*b* of the retention portion 114, and a connection portion 118 that can protrude from the bottom surface 114*b* of the retention portion 114. In the illustrated embodiment, the retention portion 114 can be sized and configured to provide cantilever support to the lower end portion of each of a plurality of stiffening members 120 in each of the openings 116. In the illustrated embodiment, the retention portion 114 can define a circular cross-section, but may define any suitable cross-section such as triangular, square, pentagonal, hexagonal, or other polygonal or desired shape. With the exception of the opening 116 at or near the axial center of the insert member 112, the openings 116 can be sized and configured to define an inside surface that can be geometrically similar to, but slightly larger than, the end portion of the stiffening member 120 that can be supported in such opening 116 so that each of the stiffening members 120 can be removably inserted into each of those openings 116, yet sized and configured to eliminate excess lateral movement of the stiffening members 120 within the openings 116.

However, in some embodiments, it can be preferred that the centermost stiffening member 120*c* be sufficiently tightly supported by the insert member 112 so that such stiffening members 120*c* cannot be inadvertently removed from the insert member 112 when the resilient members 110 are being used. Accordingly, in some embodiments, the centermost opening 116 can be sized and/or configured for a tight or even an interference fit with the stiffening member 120*c* that can be supported therein. Additionally, the centermost stiffening member 120*c* can be secured to the centermost opening 116*c* as described above so as to prevent the inadvertent removal of the stiffening member 120*c* when an axial force is exerted thereon. The stiffening members 120 can be of any geometry, material, or size as disclosed above. In the embodiment illustrated in FIGS. 10A-10C, the centermost stiffening member 120*c* can be sized to have a larger cross-sectional area and, hence, to be stiffer than the radially positioned stiffening members 120.

The handle member 122 can comprise a handle retention portion 124 and a gripping portion 128. In the illustrated embodiment, the handle retention portion 124 can be sized and configured to provide radial or lateral to the upper end portion of each of a plurality of stiffening members 120 that can be positioned in each of the openings 126. In some embodiments, as in the illustrated embodiment, the openings 126 in the handle retention portion 124 can be formed so as to not penetrate through the top surface of the handle retention portion 124. In some embodiments, with respect to the centermost stiffening member 120*c*, the centermost opening 126*c* in the gripping portion 128 can be sized and configured to provide lateral, axial, and rotational support to the upper end portion of the centermost stiffening member 120*c* so as to restrain the stiffening member 120*c* from lateral, axial, and rotational movement relative to the gripping portion 128. Accordingly, in some embodiments, the centermost opening 126*c* in the gripping portion 128 can be sized and/or configured for a tight or even an interference fit with the stiffening member 120*c* that can be supported therein. Additionally, the stiffening member 120*c* positioned within the centermost opening 126*c* can be fastened as described above so as to prevent the stiffening member 120*c* from becoming inadvertently removed from the opening in the handle gripping portion 128 when an axial force can be exerted on the gripping portion 128.

Figure 10A:
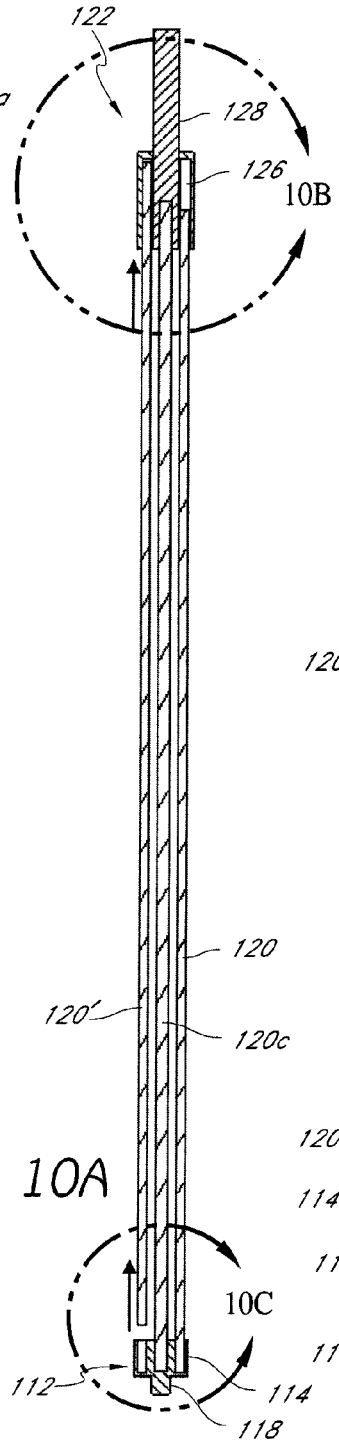
FIG. 10A is a section view of the embodiment of the resilient member illustrated in FIG. 9 taken through the axial center of such resilient member.
Figure 10B:
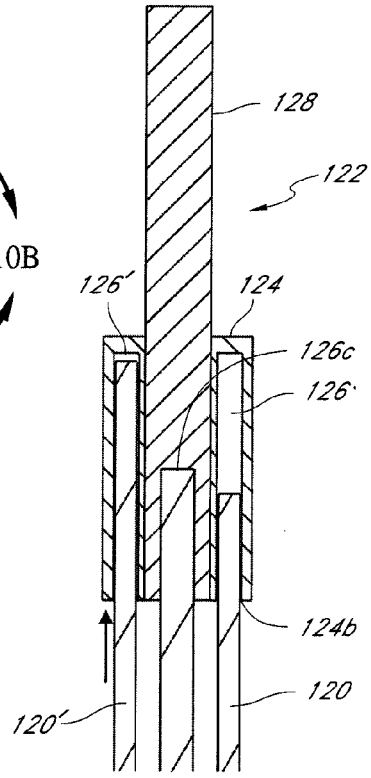
FIG. 10B is an enlarged section view of a portion of the embodiment of the resilient member illustrated in FIG. 10A defined by curve 10B in FIG. 10A.

As is illustrated most clearly in FIG. 10B, the gripping portion 128 can be positioned within an axial opening in the center of the retention portion 124. The gripping portion 128 can be secured to the retention portion 124 by any suitable method or mechanism, such as by, but not limited to, pins, rivets, bolts, screws, welds, adhesive, or other suitable forms of fusion or adhesion. Additionally, referring to FIG. 10B, the retention portion 124, the radially positioned openings 126 (i.e., the openings 126 surrounding the centermost opening 126*c*), and the stiffening members 120 are each sized so as to permit the stiffening members 120 to translate axially within such openings 126 without interference from the inside top surface of the opening 126 when the resilient member 110 can be deflected during use.

In some embodiments, the gripping portion 128 can be made from plastic, steel, aluminum, fiberglass, or any other material (that can be rigid) or composite thereof. Similarly, in some embodiments, the retention portion 124 can be made from plastic, steel, aluminum, fiberglass, or any other material (that can be rigid) or composite thereof, and can be comprised of a material that has beneficial lubrication properties or a low coefficient of friction so as to permit the stiffening member or members 120 secured by the retention portion 124 to axially translate substantially freely relative to the retention portion 124 when the resilient member 110 is deflected.

Figure 10C:
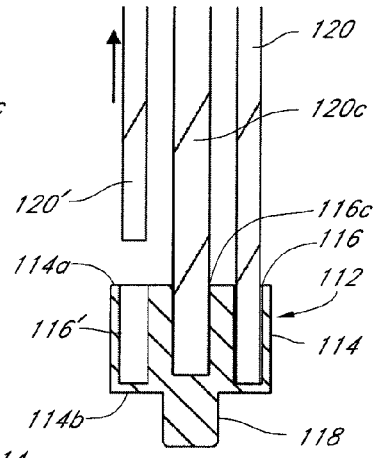
FIG. 10C is an enlarged section view of a portion of the embodiment of the resilient member illustrated in FIG. 10A defined by curve 10C in FIG. 10A.

Further, as illustrated in FIGS. 10A-10C, the radially positioned openings 126 can be configured so as to allow a user to easily add or remove a stiffening member 120' from the resilient member 110. To add or remove a stiffening member 120' from the resilient member 110, a user can first insert the upper portion of the desired stiffening member 120' into the desired opening 126' in an upward direction until the bottom edge of the stiffening member 120' can be higher than the top surface 114*a* of the insert member 112. The user then inserts the bottom portion of the stiffening member 120' all the way down into the corresponding opening 116' in the retention portion 114.

FIGS. 11A-12B, and 13 are perspective views and an exploded view, respectively, of another embodiment of a resilient member 140. The embodiment of the resilient member 140 illustrated in FIGS. 11-13 can comprise an insert member 142, one or more stiffening members 150, and a handle member 152. Each insert member 142 can comprise a retention portion 144 comprising a plurality of openings 146 through the top surface 144*a*, that can be at a depth so as to not pass through the bottom surface 144*b* of the retention portion 144, and a connection portion 148 that can protrude from the bottom surface 144*b* of the retention portion 144.

In the illustrated embodiment, the retention portion 144 can be sized and configured to provide cantilever support to the lower end portion of each of a plurality of stiffening members 150 in each of the openings 146. In the illustrated embodiment, the retention portion 144 can define a circular cross-section, but may define any suitable cross-section such as triangular, square, pentagonal, hexagonal, or other polygonal or desired shape. With the exception of the opening 146*c* at or near the axial center of the insert member 142, the openings 146 can be sized and configured to define an inside surface that can be geometrically similar to, but slightly larger than, the end portion of the stiffening member 150 that can be supported in such opening 146 so that each of the stiffening members 150 can be removably inserted into each of those openings 146, yet sized and configured to eliminate excess lateral movement of the stiffening members 150 within the openings 146.

However, it can be preferred that the centermost stiffening member 150*c* be sufficiently tightly secured to the insert member 142 so that such stiffening members 150*c* cannot be inadvertently removed from the insert member 142 when the resilient members 140 are being used. Accordingly, in some embodiments, the centermost opening 146 can be sized and/ or configured for a tight or even an interference fit with the stiffening member 150*c* that can be supported therein. Additionally, the centermost stiffening member 150*c* can be secured to the centermost opening 146*c* as described above so as to prevent the inadvertent removal of the stiffening member 150*c* when an axial force can be exerted thereon. The stiffening members 150 can be of any geometry, material, or size as disclosed above. In the embodiment illustrated in FIGS. 11-13, the centermost stiffening member 150*c* can be sized to have a larger cross-sectional area and, hence, to be stiffer than the radially positioned stiffening members 150.

In the illustrated embodiment, the handle member 152 can be comprised of a handle retention portion 154 and a gripping portion 158. The handle retention portion 154 can be sized and configured to provide radial or lateral to the upper end portion of each of a plurality of stiffening members 150 that can be positioned in each of the openings 156. In some embodiments, as in the illustrated embodiment, the openings 156 in the handle retention portion 154 can be configured so as to penetrate through the top surface of the handle retention portion 154. In some embodiments, with respect to the centermost stiffening member 150*c*, the centermost opening 156*c* in the retention portion 154 can be sized and configured to provide lateral, axial, and rotational support to the upper end portion of the centermost stiffening member 150*c* so as to restrain the stiffening member 150*c* from lateral, axial, and rotational movement relative to the retention portion 154. Accordingly, in some embodiments, the centermost opening 156*c* in the retention portion 154 can be sized and/or configured for a tight or even an interference fit with the stiffening member 150*c* that can be supported therein. Additionally, the stiffening member 150*c* positioned within the centermost opening 156*c* can be fastened as described above so as to prevent the retention portion 154 from inadvertently moving or rotating relative to the stiffening member 150*c* when an axial force is exerted on the handle gripping portion 158 or retention portion 154.

As shown most clearly in FIG. 13, in this embodiment, the gripping portion 158 can be essentially the upper portion of the centermost stiffening member 150*c* that has passed through a center opening in the retention portion 154 Additionally, referring to FIG. 12A, the retention portion 154, the radially positioned openings 156, and the stiffening members 150 are each sized so as to permit the stiffening members 150 to translate axially within such openings 156 without interference from the inside top surface of the opening 156 when the resilient member 140 is deflected during use.

In the illustrated embodiment, the gripping portion 158, which can be the upper portion of the stiffening member 150*c*, can be made from a resilient material such as nylon, Delrin, polyvinyl chloride, or other suitable polymers, resilient materials, or fiber-based materials, such as fiberglass or glass-filled polymers. Similarly, in some embodiments, the retention portion 154 can be made from plastic, steel, aluminum, fiberglass, or any other material (that can be rigid) or composite thereof, and can be comprised of a material that has beneficial lubrication properties or a low coefficient of friction so as to permit the stiffening member or members 150 secured by the retention portion 154 to axially translate substantially freely relative to the retention portion 154 when the resilient member 140 is deflected.

Further, as with the resilient member 110 described above, the radially positioned openings 156 are configured so as to allow a user to easily add or remove a stiffening member 150 from the resilient member 140. To add or remove a stiffening member 150 from the resilient member 140, a user can first insert the upper portion of the desired stiffening member 150 into the desired opening 156 in an upward direction until the bottom edge of the stiffening member 150 can be higher than the top surface 144*a* of the insert member 142. The user then inserts the bottom portion of the stiffening member 150 all the way down into the corresponding opening 156 in the retention portion 144.

FIGS. 14A-14C, and 14D are perspective views and a section view, respectively, of another embodiment of a resilient member 160. The embodiment of the resilient member 160 illustrated in FIGS. 14A-14D can comprise an insert member 162, one or more stiffening members 170, and a handle member 172. Each insert member 162 can comprise a retention portion 164 comprising a plurality of openings 166 through the top surface 164*a*, that can be at a depth so as to not pass through the bottom surface 164*b* of the retention portion 164, and a connection portion 168 that can protrude from the bottom surface 164*b* of the retention portion 164. In the illustrated embodiment, the retention portion 164 can be sized and configured to provide cantilever support to the lower end portion of each of a plurality of stiffening members 170 in each of the openings 166. In the illustrated embodiment, the retention portion 164 can define a circular cross-section, but may define any suitable cross-section such as triangular, square, pentagonal, hexagonal, or other polygonal or desired shape. In some embodiments, with the exception of the opening 166*c* at or near the axial center of the insert member 162, the openings 166 can be sized and configured to define an inside surface that can be geometrically similar to, but slightly larger than, the end portion of the stiffening member 170 that can be supported in such opening 166 so that each of the stiffening members 170 can be removably inserted into each of those openings 166, yet sized and configured to eliminate excess lateral movement of the stiffening members 170 within the openings 166.

However, the centermost stiffening member 170*c* can be sufficiently tightly secured to the insert member 162 so that such stiffening members 170*c* can be not inadvertently removed from the insert member 162 when the resilient members 160 are being used. Accordingly, in some embodiments, the centermost opening 166*c* can be sized and/or configured for a tight or even an interference fit with the stiffening member 170*c* that can be supported therein. Additionally, in some embodiments, the centermost stiffening member 170*c* can be secured to the centermost opening 166*c* as described above so as to prevent the inadvertent removal of the stiffening member 170*c* when an axial force is exerted thereon. The stiffening members 170 can be of any geometry, material, or size as disclosed above. In the embodiment illustrated in FIGS. 14A-14D, the centermost stiffening member 170*c* can be sized to have a larger cross-sectional area and, hence, to be stiffer than the radially positioned stiffening members 170.

In the illustrated embodiment, a handle member 172 can comprise only a gripping portion 178, which can also be configured to provide lateral and/or axial restraint to one or more stiffening members 170. In the illustrated embodiment, the openings 176 in the gripping portion 178 can be configured so as to not penetrate through the top surface of the gripping portion 178. In some embodiments, with respect to the centermost stiffening member 170*c*, the centermost opening 176*c* in the gripping portion 178 can be sized and configured to provide lateral, axial, and rotational support to the upper end portion of the centermost stiffening member 170*c* so as to restrain the stiffening member 170*c* from lateral, axial, and rotational movement relative to the gripping portion 178. Accordingly, in some embodiments, the centermost opening 176*c* in the gripping portion 178 can be sized and/or configured for a tight or even an interference fit with the stiffening member 170*c* that can be supported therein. Additionally, the stiffening member 170*c* positioned within the centermost opening 176*c* can be fastened as described above so as to prevent the stiffening member 170*c* from becoming inadvertently removed from the opening in the gripping portion 178 when an axial force is exerted on the gripping portion 178.

In the illustrated embodiment, the gripping portion 178 can be made from a substantially rigid material such as plastic, steel, aluminum, fiberglass, or any other material (that can be rigid) or composite thereof, and can be comprised of a material that has beneficial lubrication properties or a low coefficient of friction so as to permit the stiffening member or members 170 secured by the retention portion 174 to axially translate substantially freely relative to the retention portion 174 when the resilient member 160 is deflected. Alternatively, the gripping portion 178 can be comprised of any suitable material regardless of lubrication or frictional properties, and the openings 176, or the openings of any embodiment of the gripping portion described herein, can be coated or lined with a material having beneficial frictional or lubrication properties.

Further, as with the resilient member 110 described above, the radially positioned openings 176 can be configured so as to allow a user to easily add or remove a stiffening member 170 from the resilient member 160. To add or remove a stiffening member 170 from the resilient member 160, a user can first insert the upper portion of the desired stiffening member 170 into the desired opening 176 in an upward direction until the bottom edge of the stiffening member 170 can be higher than the top surface 164*a* of the insert member 162. The user then inserts the bottom portion of the stiffening member 170 all the way down into the corresponding opening 166 in the retention portion 164.

Figure 16:
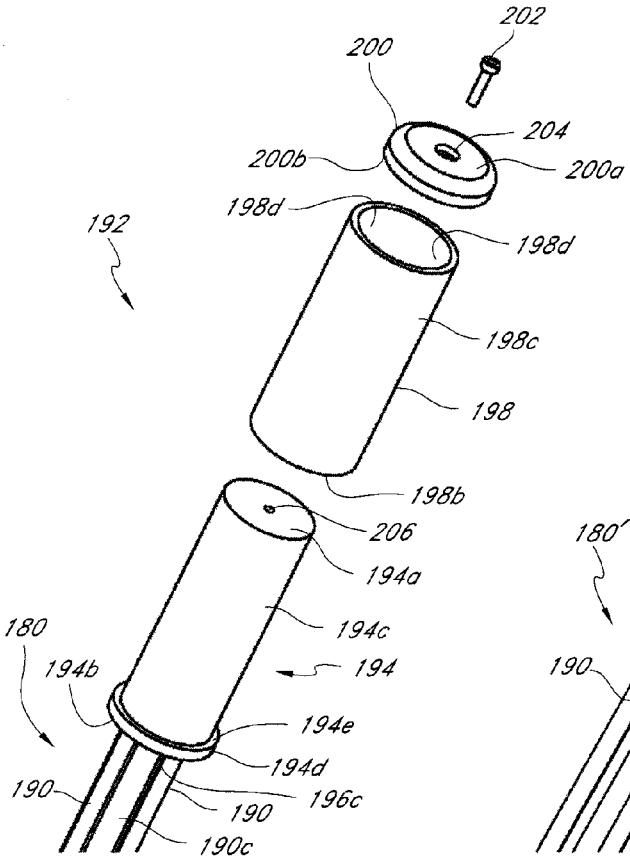
FIG. 16 is an exploded perspective view of the portion of the embodiment of the resilient member illustrated in FIG. 15B.

FIGS. 15A-15C, and 16 are perspective views and an exploded perspective view, respectively, of another embodiment of a resilient member 180. The embodiment of the resilient member 180 illustrated in FIGS. 15A-16 can be similar to the embodiment of the resilient member 160 described above, except that, in some embodiments, the handle member 192 can be configured to provide a substantially freely rotating gripping portion 196. As illustrated in FIG. 16, the handle member 192 can be comprised of a handle retention portion 194 and a gripping portion 198.

The handle retention portion 194 can be sized and configured to provide radial or lateral to the upper end portion of each of a plurality of stiffening members 190 that can be positioned in each of the openings 196. In the illustrated embodiment, the openings 196 in the handle retention portion 194 do not penetrate through the top surface of the handle retention portion 194. In some embodiments, with respect to the centermost stiffening member 190*c*, the centermost opening 196*c* in the retention portion 194 can be sized and configured to provide lateral, axial, and rotational support to the upper end portion of the centermost stiffening member 190*c* so as to restrain the stiffening member 190*c* from lateral, axial, and rotational movement relative to the retention portion 194. Accordingly, in some embodiments, the centermost opening 196*c* in the retention portion 194 can be sized and/or configured for a tight or even an interference fit with the stiffening member 190*c* that can be supported therein. Additionally, the stiffening member 190*c* positioned within the centermost opening 196*c* can be fastened as described above so as to prevent the stiffening member 190*c* from becoming inadvertently removed from the opening in the retention portion 194 when an axial force is exerted on the handle retention portion 194.

As is illustrated most clearly in FIG. 16, the handle retention portion 194 can define a cylindrical outer surface 194*c* that can be sized and configured to be similar to, but slightly smaller in diameter than, the inside surface 198*d* of the gripping portion 198 so that, when the gripping portion 198 can be inserted over the outside surface 194*c* of the handle retention portion 194, the gripping portion 198 can be substantially free to rotate about the handle retention portion 194. An extended portion 194*d* of the handle retention portion 194 can be sized and configured to provide a supporting surface 194*e*, to restrain the axial movement of the gripping portion 198 in the downward direction, while not substantially inhibiting the rotational movement of the gripping portion 198.

Similarly, a cap member 200, which can be bolted or screwed to the top of the handle retention portion 194 with bolt 202 passing through opening 204 in the cap member 200 and threading into threaded hole 206 in the handle retention portion 194 such that the bottom surface 200*b* of the cap member 200 abuts and can be secured against the top surface 194*a* of the handle retention portion 194. However, the cap member 200 may be secured to the handle retention portion 194 by any suitable method. The cap member 200 can be sized and configured to provide a supporting surface 200*b* to restrain the axial movement of the gripping portion 198 in the upward direction, while not substantially inhibiting the rotational movement of the gripping portion 198. The gripping portion 198, or any gripping portion described herein, can be made from plastic, rubber, aluminum, steel, fiberglass, or any other suitable material or combination or composite thereof.

Figure 17:
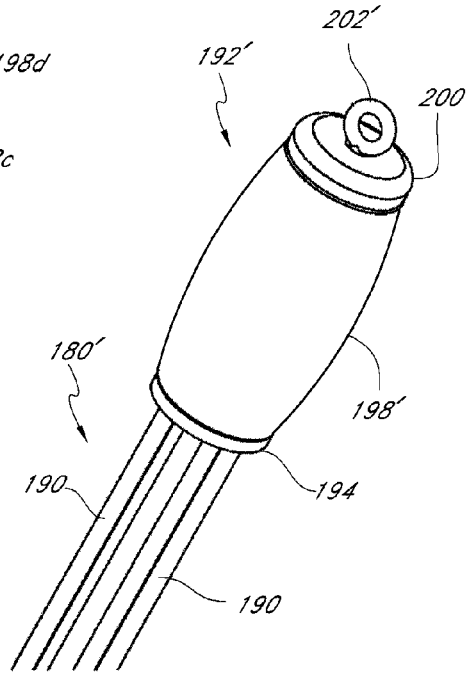
FIG. 17 is a perspective view of a portion of an embodiment of a resilient member.

FIG. 17 is a perspective view of a portion of an embodiment of a resilient member 180' that can be similar to the resilient member 180 described above, except for the following. First, the gripping portion 198' of the handle member 192' can define a curved outer surface. Further, the fastener 202' used to secure the cap 200 to the handle retention portion 194 comprises a loop through which a handle or other alternative grip can be attached, either directly or with the use of a carabiner or other linking member.

FIGS. 18A-18C, and 19 are perspective views and an exploded perspective view, respectively, of another embodiment of a resilient member 210. The embodiment of the resilient member 210 illustrated in FIGS. 18A-19 can comprise an insert member 212, one or more stiffening members 220, and a handle member 222. Each insert member 212 can be similarly configured as compared to other embodiments of the insert members described above.

The handle member 222 can comprise a handle retention portion 224 comprising openings 226. The handle member 222 can also comprise a gripping portion 228, and a sleeve member 230. The gripping portion 228 can be configured to fit within an opening 224*d* in the handle retention portion 224 in a similar fashion as described above with respect to resilient member 110. The sleeve member 230 can be size and configured such that the inner surface 230*d* of the sleeve member 230 has a similar size and shape as compared to, but slightly larger than, the outer surface 224*c* of the handle retention portion 224 so that the sleeve member 230 can be inserted over the handle retention portion 224. An extended portion 224*e* of the handle retention portion 224 can be sized and configured to provide a supporting surface 224*f*, to restrain the axial movement of the sleeve member 230 in the downward direction so that the bottom surface 230*b* of the sleeve member 230 does not move below the supporting surface 224*f* of the handle retention portion 224. Similar features or a similar or other suitable means can be used to prevent or inhibit the sleeve member 230 from moving in the upward direction once the sleeve member 230 can be positioned over the handle retention portion 224.

In the illustrated embodiment, the openings 226 can be configured so as to not penetrate through the top surface of the handle retention portion 224. In some embodiments, with respect to the centermost stiffening member 220*c*, the centermost opening 226*c* in the gripping portion 228 can be sized and configured to provide lateral, axial, and rotational support to the upper end portion of the centermost stiffening member 220*c* so as to restrain the stiffening member 220*c* from lateral, axial, and rotational movement relative to the gripping portion 228. Accordingly, in some embodiments, the centermost opening 226*c* in the gripping portion 228 can be sized and/or configured for a tight or even an interference fit with the stiffening member 220*c* that can be supported therein. Additionally, the stiffening member 220*c* positioned within the centermost opening 226*c* can be fastened as described above so as to prevent the stiffening member 220*c* from becoming inadvertently removed from the opening 226*c* in the handle gripping portion 228 when an axial force is exerted on the gripping portion 228.

Figure 18B:
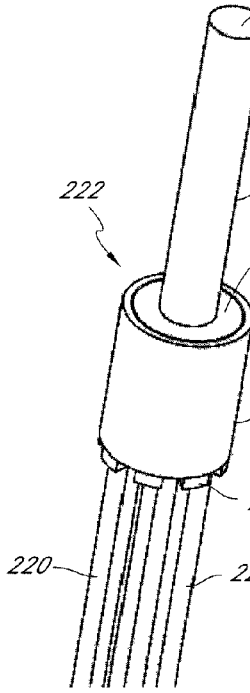
FIG. 18B is an enlarged perspective view of a portion of the embodiment of the resilient member illustrated in FIG. 18A defined by curve 18B in FIG. 18A.
Figure 18C:
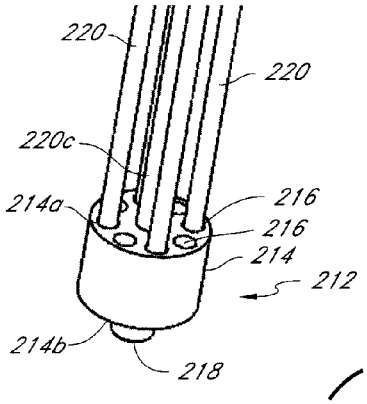
FIG. 18C is an enlarged perspective view of a portion of the embodiment of the resilient member illustrated in FIG. 18A defined by curve 18C in FIG. 18A.
Figure 18A:
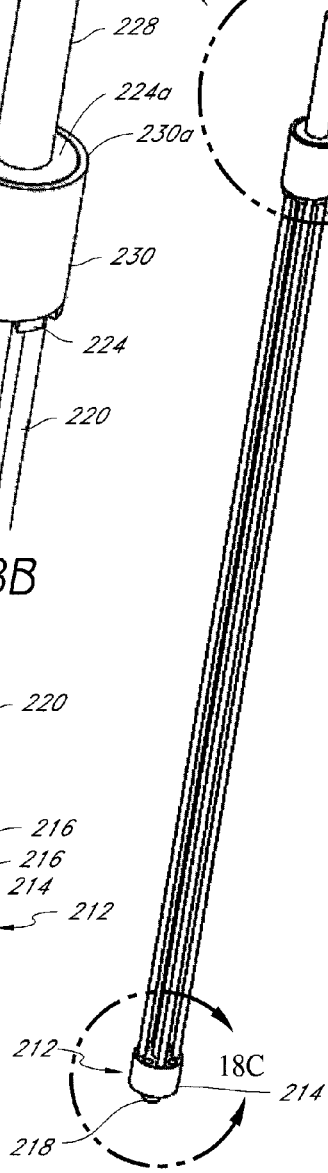
FIG. 18A is a perspective view of an embodiment of a resilient member.
Figure 19:
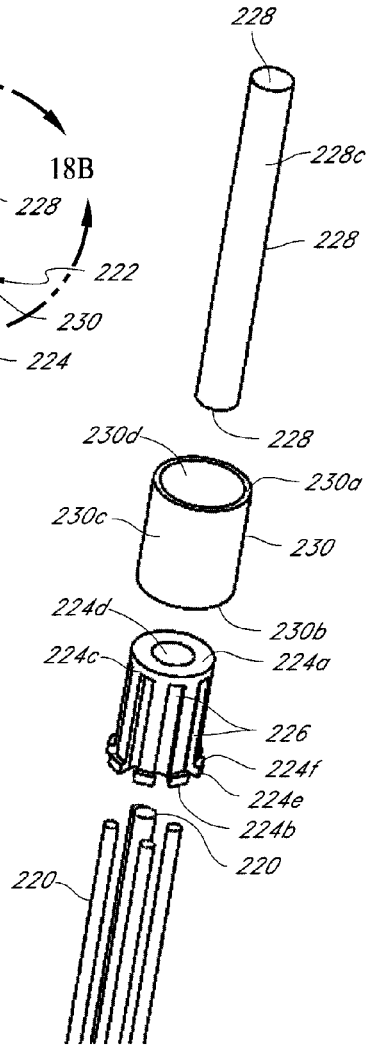
FIG. 19 is an exploded perspective view of the portion of the embodiment of the resilient member illustrated in FIG. 18B.
Figures 20A, 20B, 20C:
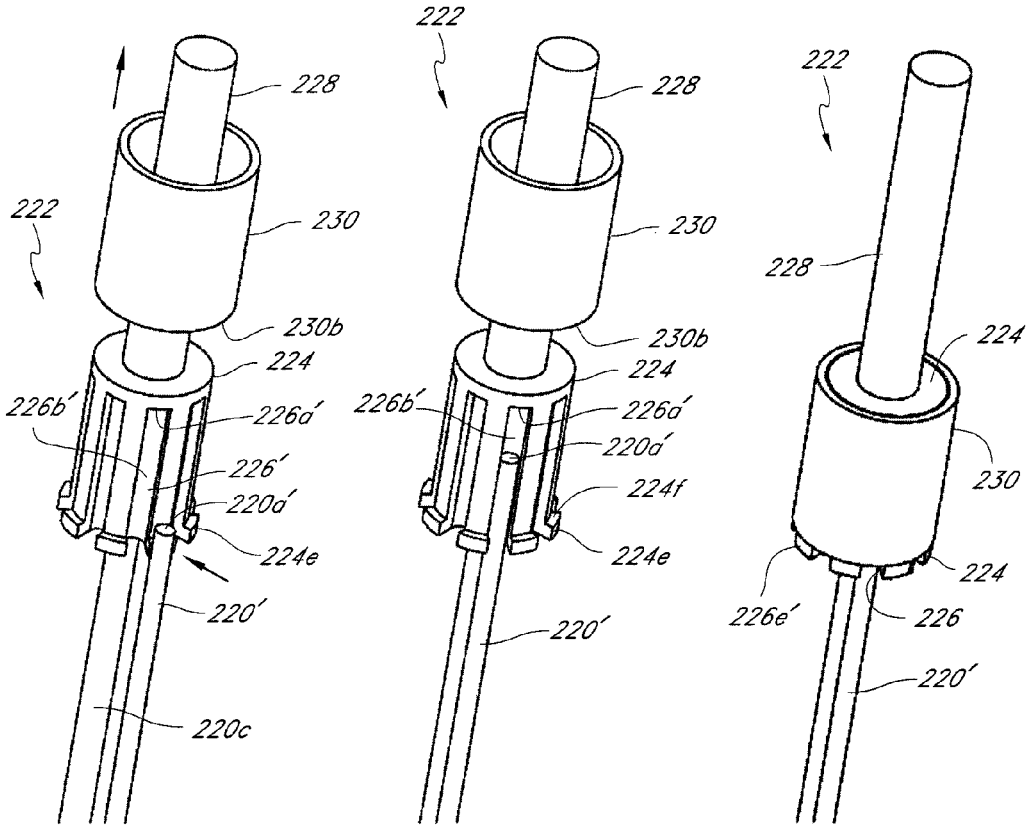
FIGS. 20A-20C are perspective views of the embodiment of the resilient member illustrated in FIG. 18A, illustrating the addition of an embodiment of a stiffening member to such resilient member.

FIGS. 20A-20C are perspective views of a portion of the embodiment of the resilient member 210 illustrated in FIGS. 18A-19, illustrating the addition of an embodiment of a stiffening member 220' to such resilient member 210. As illustrated therein, the radially positioned openings 226 can be configured so as to allow a user to easily add or remove a stiffening member 220' from the resilient member 210. In some embodiments, to add a stiffening member 220' to the resilient member 210, a user can first insert the bottom portion of the stiffening member 220' into the desired opening 216 in the insert member 214 (not shown). The user then slides the sleeve member 230 in the upward direction until the bottom surface 230*b* of the sleeve member 230 can be above the top surface 220*a'* of the stiffening member 220'. The user can then exert a lateral force on the top portion of the stiffening member 220', as indicated by the arrow in FIG. 20A, to push the top portion of the stiffening member 220' into the desired opening 226' until the outer surface of the stiffening member 220' abuts the inner surface 226*b'* of the desired opening 226', as illustrated in FIG. 20B. The user then slides the sleeve member 230 in the downward direction until the bottom surface 230*b* of the sleeve member 230 abuts the supporting surface 224*f* of the extended portion 224*e* of the handle retention portion 224, as illustrated in FIG. 20C. Additionally, the handle retention portion 224 can be configured to, or can comprise features such as, but not limited to, detents or flexible tabs that bias or cause the stiffening members 220 to be held within the openings 226 during the period of time that the sleeve member 230 can be slid upward.

Figure 21A:
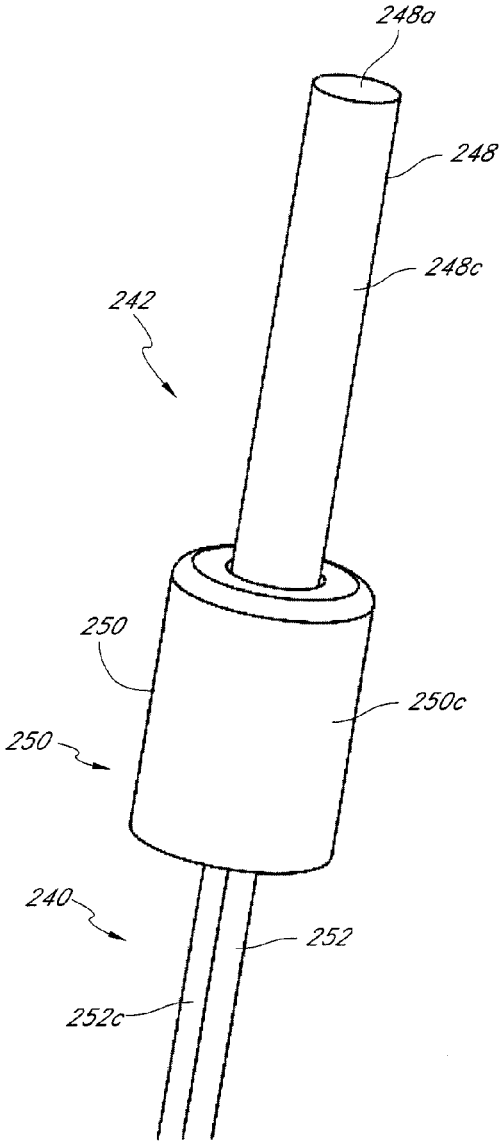
FIG. 21A is a perspective view of a portion of an embodiment of a resilient member.
Figure 21B:
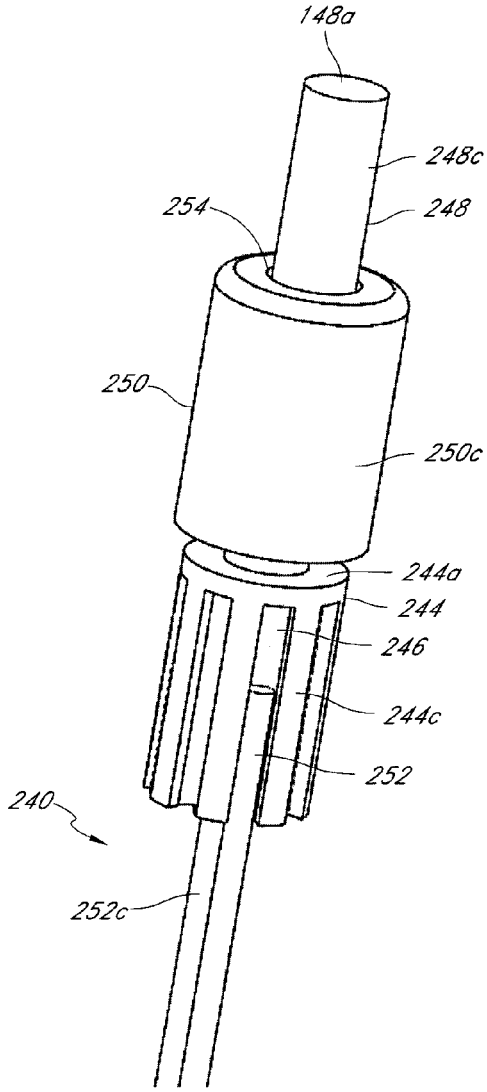
FIG. 21B is a partially exploded perspective view of the portion of the embodiment of the resilient member illustrated in FIG. 21A.

The embodiment of the resilient member 240 illustrated in FIGS. 21A-21B can be similar in most respects to the resilient member 210 described above, except that, in some embodiments, the sleeve member 250 illustrated in FIGS. 21A-21B can have a constricted upper portion that defines a throughhole 254 that can be sized and configured to have a diameter that can be slightly larger than the diameter of the outer surface 248*c* of the gripping portion 248. The constricted upper portion provides a supporting surface that prevents the sleeve member 250 from sliding down below the handle retention portion 244. In this configuration, there may not be any need for the extended portion 224*e* of the handle retention portion 224 that is illustrated in FIG. 20C.

Figure 22:
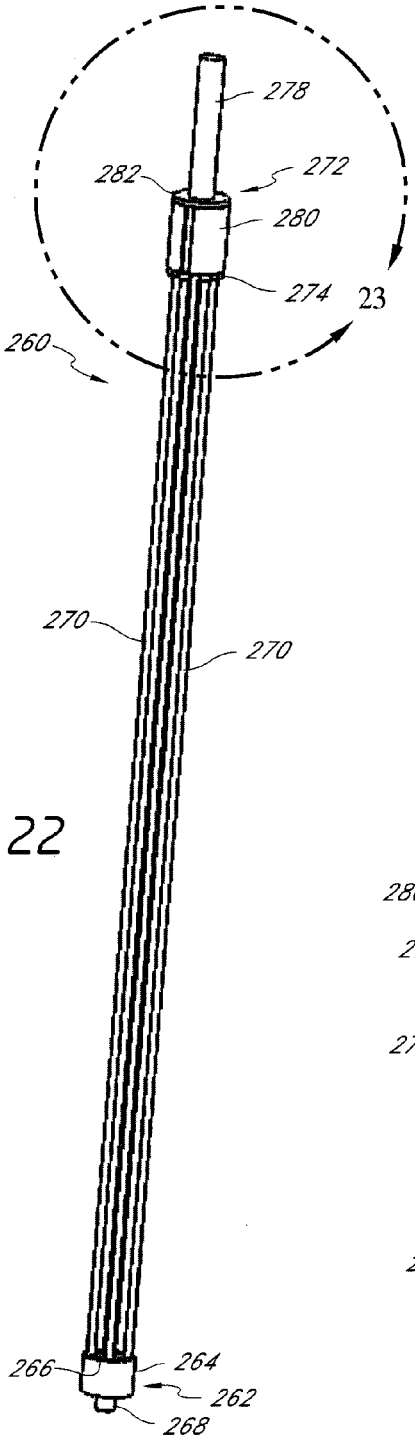
FIG. 22 is a perspective view of an embodiment of a resilient member.
Figure 23:
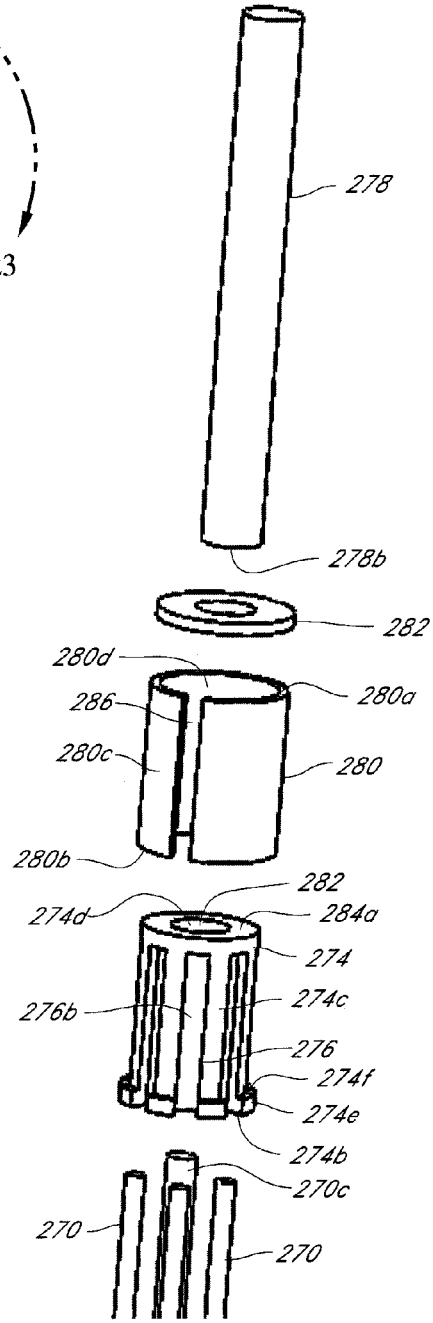
FIG. 23 is an enlarged, exploded perspective view of a portion of the embodiment of the resilient member illustrated in FIG. 22 defined by curve 23 in FIG. 22.

FIGS. 22 and 23 are a perspective view and an exploded perspective view of another embodiment of a resilient member 260. The resilient member 260 illustrated in FIGS. 22-23 can be similar to the resilient member 210 illustrated in FIG. 18A above, except as follows. The handle member 272 can comprise a handle retention portion 274 comprising openings 276. The handle member 272 also comprises a gripping portion 278, and a sleeve member 280. The gripping portion 278 can be configured to fit within an opening in the handle retention portion 274 in a similar fashion as described above with respect to resilient member 110. The sleeve member 280 can be size and configured such that the inner surface 280*d* of the sleeve member 280 has a similar size and shape as compared to, but slightly larger than, the outer surface 274*c* of the handle retention portion 274 so that the sleeve member 280 can be inserted over, and rotate about, the handle retention portion 274. An extended portion 274*d* of the handle retention portion 274 can be sized and configured to provide a supporting surface 274*e*, to restrain the axial movement of the sleeve member 280 in the downward direction so that the bottom surface 280*b* of the sleeve member 280 does not move below the supporting surface 274*f* of the handle retention portion 274. A similar or other suitable means can be used to prevent or inhibit the sleeve member 280 from moving in the upward direction once the sleeve member 280 can be positioned over the handle retention portion 274, as illustrated in FIG. 22B. An annular member 282 can then be positioned over the sleeve member 280. Alternatively, in some embodiments, the sleeve member 280 could comprise a constricted upper portion configured to inhibit it from translated axially downward beyond a desired position, similar to the sleeve member 250 described above.

Figures 24A, 24B, 24C:
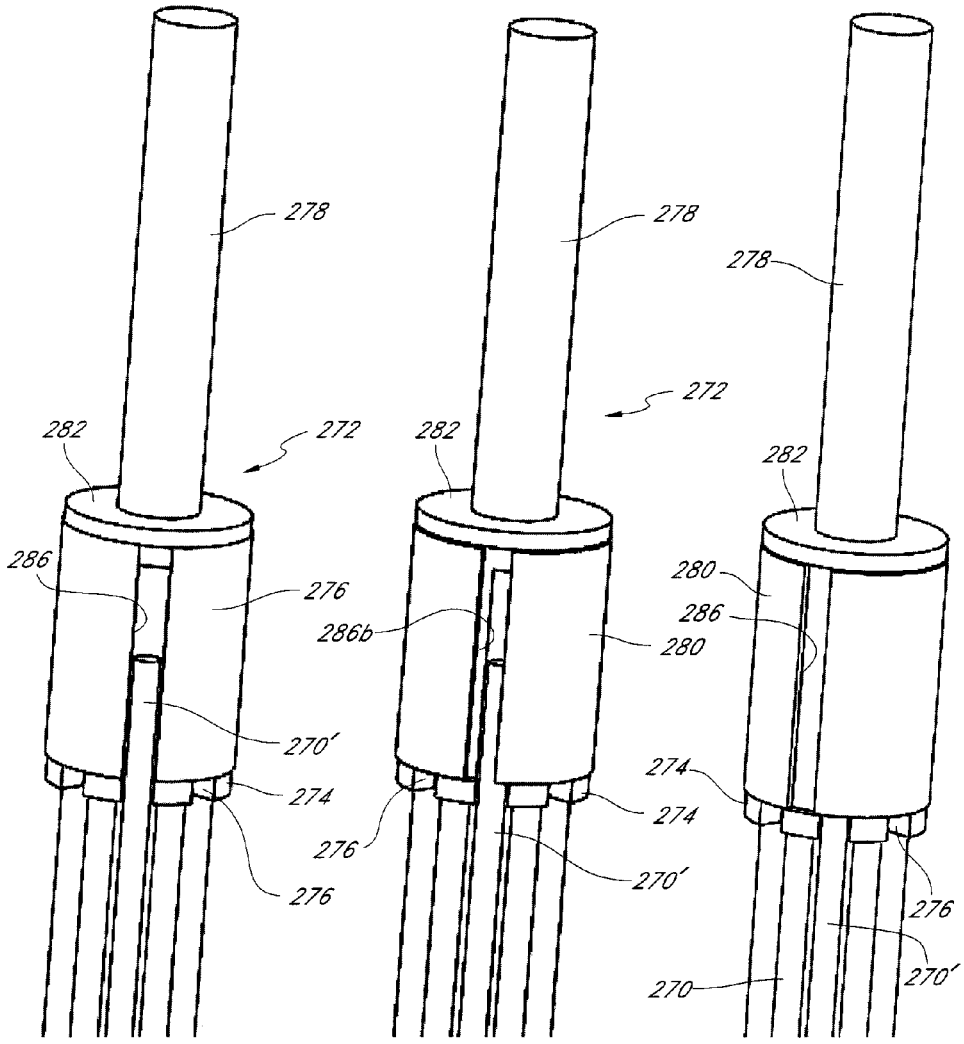
FIGS. 24A-24C are perspective views of the portion of the embodiment of the resilient member illustrated in FIG. 23, illustrating the addition of an embodiment of a stiffening member to such resilient member.
Figure 25B:
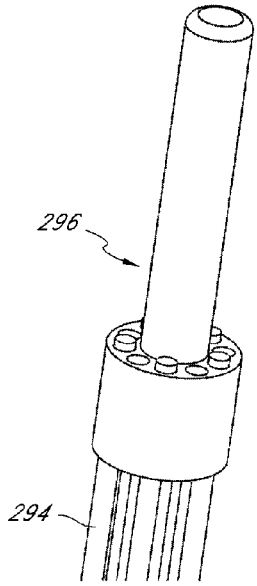
FIG. 25B is an enlarged perspective view of a portion of the embodiment of the resilient member illustrated in FIG. 25A defined by curve 25B in FIG. 25A.
Figure 25A:
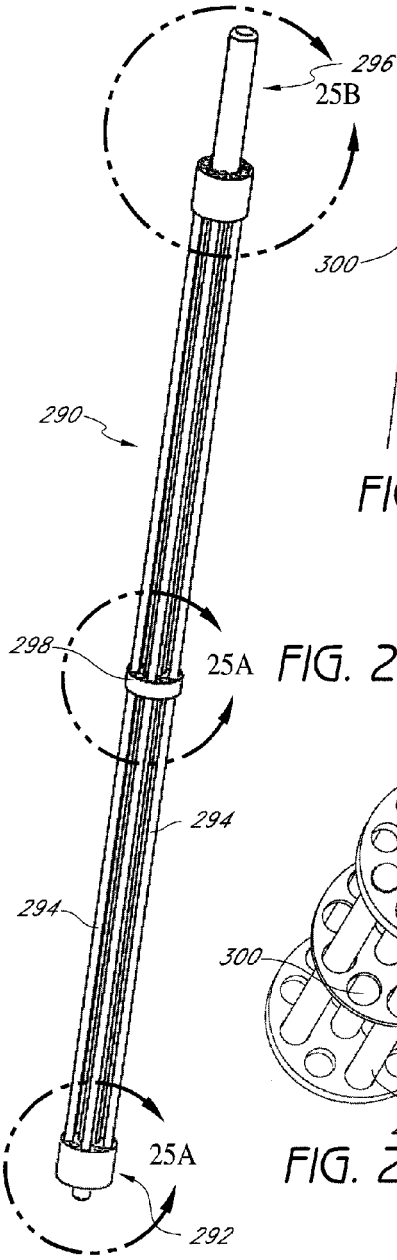
FIG. 25A is a perspective view of an embodiment of a resilient member.
Figure 25D:
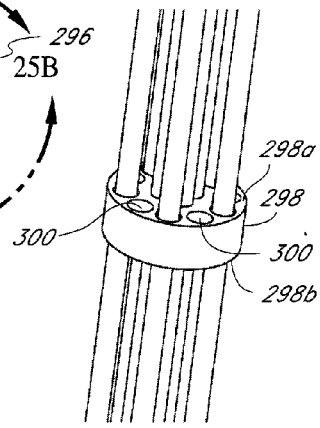
FIG. 25D is an enlarged perspective view of a portion of the embodiment of the resilient member illustrated in FIG. 25A defined by curve 25D in FIG. 25A.
Figure 25C:
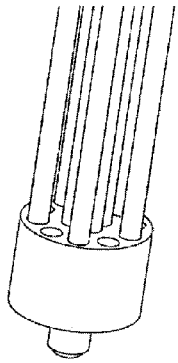
FIG. 25C is an enlarged perspective view of a portion of the embodiment of the resilient member illustrated in FIG. 25A defined by curve 25C in FIG. 25A.
Figure 26:
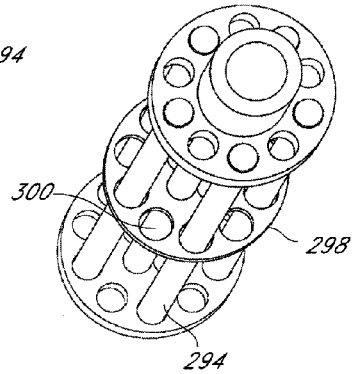
FIG. 26 is a perspective view of the embodiment of the resilient member illustrated in FIG. 25A.

FIGS. 24A-24C are perspective views of the portion of the embodiment of the resilient member 260 illustrated in FIG. 23, illustrating the addition of an embodiment of a stiffening member 270' to such resilient member 260. As illustrated therein, the radially positioned openings 276 and the sleeve member can be configured so as to allow a user to easily add or remove a stiffening member 270' to or from the resilient member 260.

To add a stiffening member 270' to the resilient member 270, a user can first insert the bottom portion of the stiffening member 270' into the desired opening 266 in the insert member 264 (not shown). The user then rotates the sleeve member 280 in either the clockwise or counter-clockwise direction until the slot 286 formed in the sleeve member 280 can be sufficiently aligned with the desired opening 276. The user can then exert a lateral force on the top portion of the stiffening member 270' to push the stiffening member 270' into the desired opening 276 until the outer surface of the stiffening member 270' abuts the inner surface 276*b* of the desired opening 276, as illustrated in FIG. 24A. The user can then rotate the sleeve member 280 in either the clockwise or counter-clockwise direction until the slot 286 formed in the sleeve member 280 can be no longer aligned with the desired opening 276, as illustrated in FIGS. 24B-24C and is, rather, generally aligned with the outer surface 274*c* of the handle retention portion 274. Additionally, the handle retention portion 274 can be configured to, or can comprise features such as, but not limited to, detents or flexible tabs that bias or cause the stiffening members 270 to be held within the openings 276 during the period of time that the slot 286 in the sleeve member 280 can be aligned with a opening 276 in the handle retention portion 274.

FIGS. 25A-25D and 26 are perspective views of an embodiment of a resilient member 290 that can be similar to resilient member 80 described above, except that the resilient member 290 further comprises a middle retention member 298 that can be configured to restrain the stiffening members 294 near the midpoint between the insert member 292 and the handle member 296. The radially positioned openings 300 in the middle retention member 298 (i.e., those positioned away from the center of the middle retention member 298) can be configured to provide lateral restraint to the stiffening members 294, without substantially axially restraining the stiffening members 294.

Figure 27:
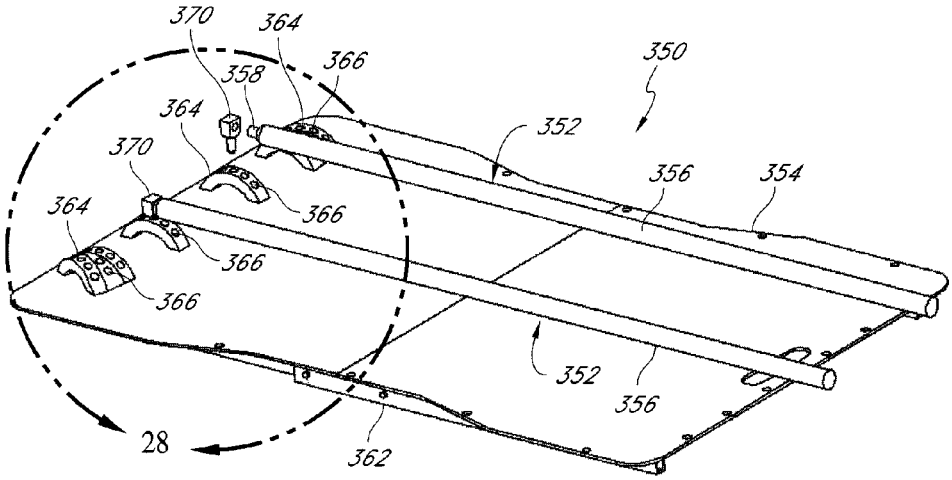
FIG. 27 is a perspective view of another embodiment of an exercise device.
Figure 28:
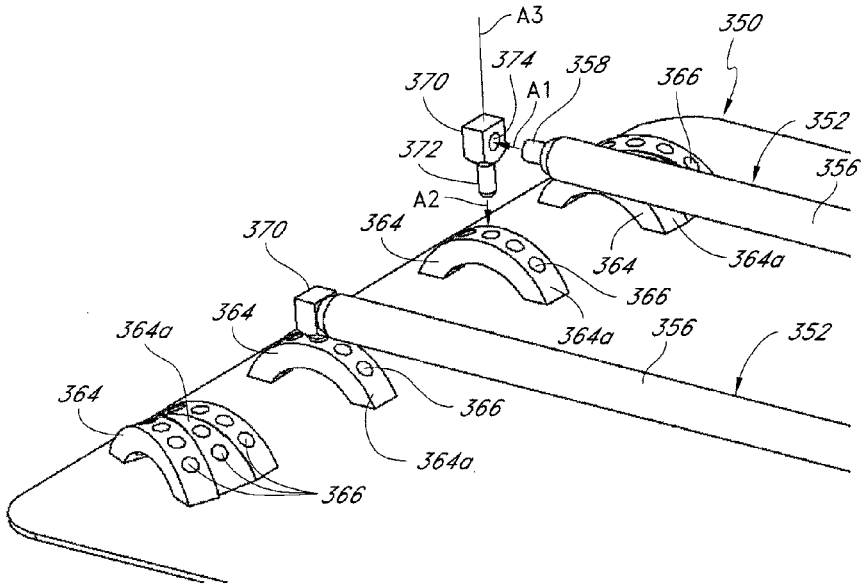
FIG. 28 is an enlarged perspective view of a portion of the embodiment of the exercise device shown in FIG. 28.

FIG. 27 is a perspective view of another embodiment of an exercise device 350. FIG. 28 is an enlarged perspective view of a portion of the embodiment of the exercise device 350 shown in FIG. 27. In some embodiments, the exercise device 350 can comprise one or more resilient members 352 and a base member 354. In the illustrated embodiment, and in any embodiment described herein, the base 354 (or any base described herein) can be configured to be free standing on a generally flat, horizontal surface so as to provide a supporting surface for a user of the exercise device in a standing, sitting, kneeling, or any other desired position. However, the exercise device 350 is not so limited. In some embodiments, the base 354 or any portion thereof can be attached to and, hence, supported by a horizontal, vertical or inclined surface, or can be configured to be free standing in a vertical or any angular orientation.

Figure 29:
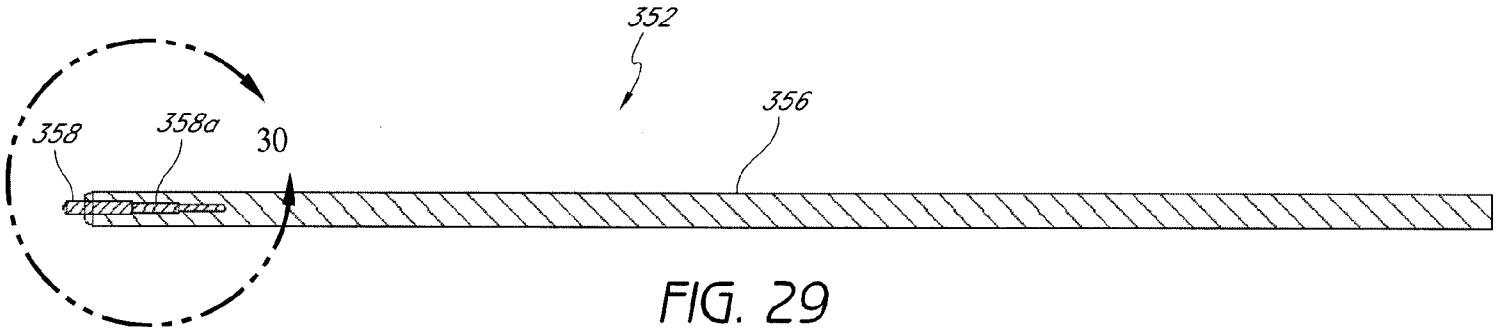
FIG. 29 is a sectional view of the embodiment of one of the resilient members shown in FIG. 27, taken through the longitudinal center of the resilient member.
Figure 30:
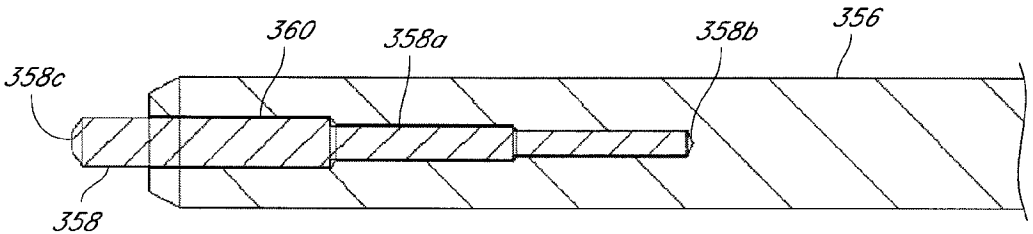
FIG. 30 is an enlarged sectional view of the embodiment of one of the resilient members shown in FIG. 27, taken through the longitudinal center of the resilient member.

FIGS. 29 and 30 are a sectional view and enlarged sectional view, respectively, of the embodiment of one of the resilient members 352 shown in FIG. 27, taken through the longitudinal center of the resilient member 352. In some embodiments, as in the illustrated embodiment, the resilient member 352 can comprise a stiffening member 356 and an insert member 358. The stiffening member 356 can comprise an opening 360 formed therein configured to receive the inner portion 358*a* of the insert member 358. In some embodiments, the opening 360 can be formed so that the axial centerline of the opening 360 can be collinear with the axial centerline of the stiffening member 356. In some embodiments, the opening 360 and the inner portion 358*a* of the insert member 358 can have an approximately matching geometry, and can be configured to define one or more tapered portions having a reduced cross-sectional area. In some embodiments, the opening 360 and the inner portion 358*a* can be tapered or otherwise be formed so that the cross-sectional area of the opening 360 and the inner portion 358*a* can be reduced. In some embodiments, the insert member 358 can be press fit within the opening 360, or otherwise adhered or secured within the opening 360.

The portion of the insert member 358 that extends past the end of the stiffening member 356 can be configured to be supported in a cantilevered disposition by an opening or connection interface of a base member 354, such as the connection interface 366. In some of the embodiments, the insert member 358 or portions thereof can define a generally circular cross-section. In some embodiments, the insert member 358 can define a square, triangular, ovular, polygonal, or other similar or desired cross-section. Similarly, in any of the embodiments described herein, splines, teeth, protrusions, channels, notches, or other features configured to inhibit the resilient member from rotating (i.e., spinning) within or relative to the connection interface, can be formed on one or more surfaces of the insert member and/or the connection interface to inhibit the resilient member from rotating (i.e., spinning) within or relative to the connection interface.

Additionally, some embodiments of the insert member 358 can define a stepped or tapered outer surface 358*a* having a cross-sectional area that can be less at the distal end 358*b* of the insert member 358 than at the proximal end 358*c* of the insert member 358. For example, in some embodiments, the outer surface 358*a* of the insert member 358 can be conically tapered toward the distal end 358*b* of the insert member 358 such that the portion of the insert member 358 and near the distal end 358*b* defines a cross-sectional area that can be less than the cross-sectional area of the portion of the insert member 358 near the proximal end 358*c* of the insert member 358. The outer surface 358*a* of the insert member can be linearly or nonlinearly tapered, or can define a stepped tapering surface as illustrated in FIGS. 29 and 30. The opening 360 formed in the stiffening member 358 can be formed so as to complement the geometry of the insert member 358.

The base member 354 can have a supporting frame 362. Any components comprising the base member 354 or supporting frame, or any other base member or supporting frame disclosed herein, can be formed from steel, aluminum, plastic, fiberglass, and/or any other suitable material, composite material, or combination thereof. Additionally, in some embodiments, generally arcuately shaped base connection members 364 can be supported by the base member 354. In some embodiments (not illustrated), the base connection member 364 can be generally spherically shaped. The base connection members 364 can be fixed to the base member 354, or can be supported by the base member 354 in a manner that permits the base connection members 364 to be rotationally adjustable relative to the base member 354. In some embodiments, a plurality of base connection members 364 can be supported by the base member 354, each being mounted at a different location and/or angular orientation relative to the base member 354.

The base connection members 364 can define one or more connection interfaces 366 that are configured to directly or indirectly support one or more resilient members 352. In the embodiment illustrated in FIGS. 27 and 28, the connection interfaces 366 can be cylindrically shaped openings formed at various locations on the base connection members 364, defining various angular orientations relative to the base 354 such that, when the resilient member 352 can be supported by a connection interface 366, the angular orientation of the longitudinal axis of the resilient member 352 relative to the base 354 can be adjusted by changing the connection interface 366 that defines the support for the resilient member 352.

Additionally, the base connection members 364 can be bolted, welded, or otherwise attached or mounted to the base member 354 in a wide range of angular orientations to further increase the range of the angular orientations of the connection interfaces 366, each of which can define a removable or non-removable support for a resilient member 352. Additionally, the angular orientation of the resilient member 352 can be further adjusted by using an insert interface 370 that can be configured to be supported by a connection interface 366. In some embodiments, the insert interface 370 can define an insert portion 372 that can have any of the same features, geometries, or other details of any of the other insert members disclosed herein. Additionally, in some embodiments, the insert interface 370 can define an opening 374 that can be configured to receive and provide cantilevered support to an insert member of a resilient member, such as insert member 358 of the resilient member 352. In some embodiments, the resilient member 352 can be inserted into the insert interface 370 by sliding the insert member 358 of the resilient member 352 into the opening 374 of the insert interface 370 in the direction defined by arrow A1. The insert interface 370 can be inserted into the connection interface 366 by sliding the insert portion 372 of the insert interface 370 into the connection interface 366. In some embodiments, the insert interface 370 can be configured to alter the angle of the resilient member 352 relative to the connection interface 366 by an angle between approximately 0° and 180°. In the illustrated embodiment, insert interface 370 can be configured to alter the angle of the resilient member 352 relative to the connection interface 366 by approximately 90°.

In some embodiments, the insert portion 372 of the insert interface 370 can be generally shaped so as to complement the geometry of a at least one of the openings, such as the generally cylindrically shaped opening 366. In this configuration, the insert interface 370 can be rotated about an axis A3 relative to the connection interface 366 so that the resilient member 352 can be rotated about axis A3 relative to the connection interface 366 and, hence, the base 354. In some embodiments, the insert interface 370 can be configured to prevent such rotatability.

Figure 31:
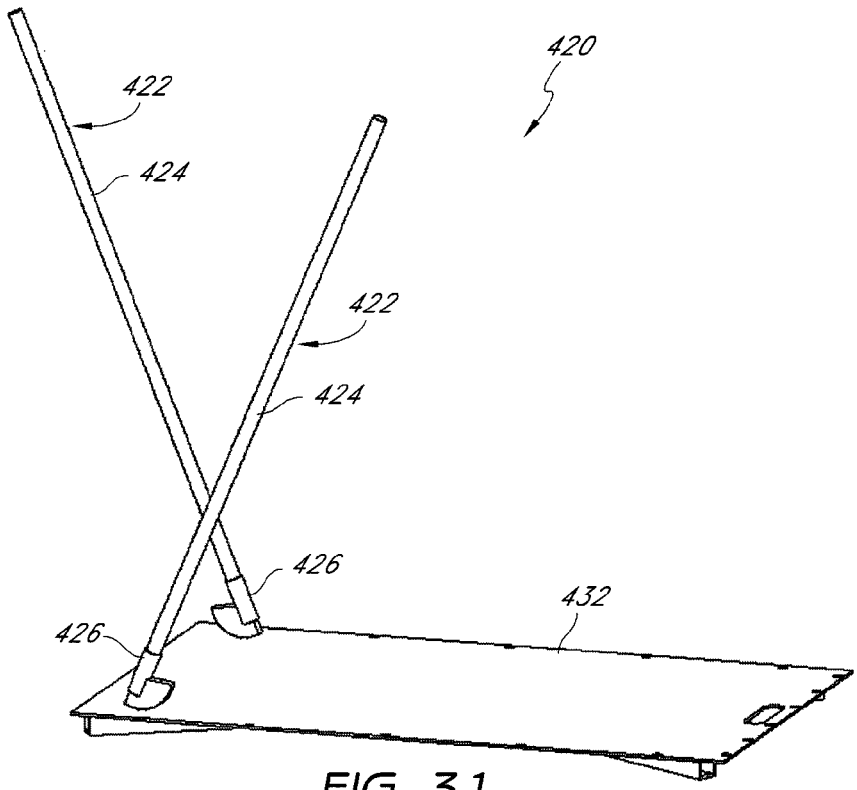
FIG. 31 is a perspective view of another embodiment of an exercise device.
Figure 32:
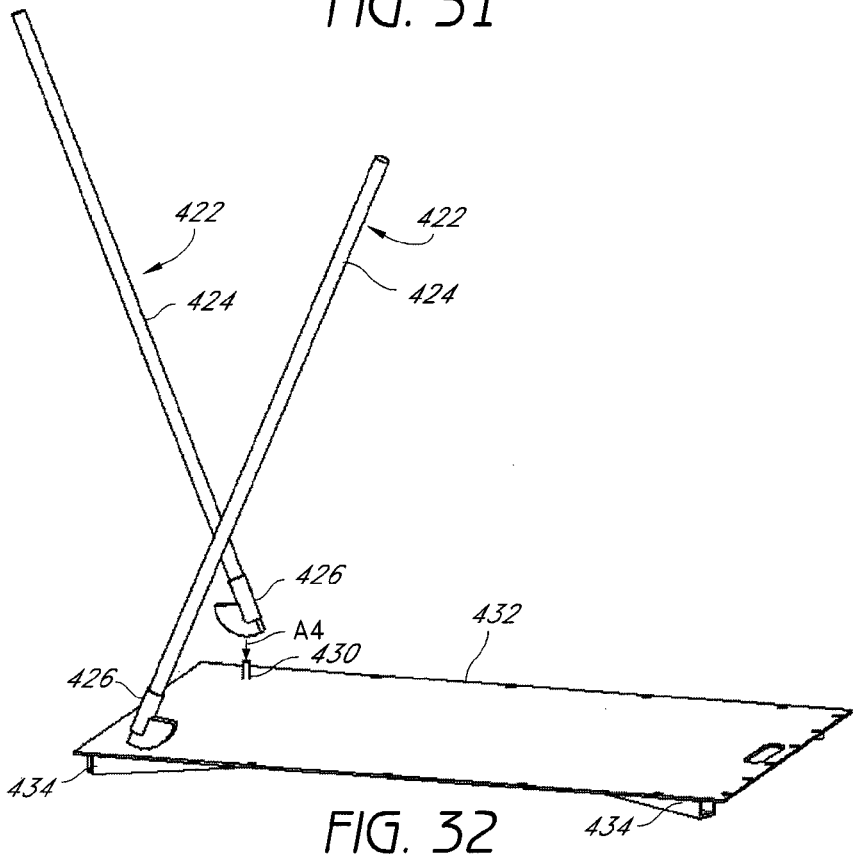
FIG. 32 is a perspective view of the embodiment of an exercise device shown in FIG. 31, showing one resilient member supported by the base member and another resilient member spaced apart from the base member.

FIGS. 31 and 32 are perspective views of another embodiment of an exercise device 420. In some embodiments, the exercise device 420 can comprise one or more resilient members 422, each comprising a stiffening member 424 and an insert member 426. The resilient member 422 can be configured to be supported by one of a plurality of connection interfaces 430 supported by a base member 432. In the illustrated embodiment, the base 432 can have a supporting frame 434 and can be configured to be free standing on a generally flat, horizontal surface so as to provide a supporting surface for a user of the exercise device in a standing, sitting, kneeling, or any other desired position. However, the exercise device 350 is not so limited. In some embodiments, the base 354 or any portion thereof can be attached to and, hence, supported by a horizontal, vertical or inclined surface, or can be configured to be free standing in a vertical or any angular orientation.

In some embodiments, the connection interfaces 430 can be generally cylindrically or conically shaped, and can be welded, screwed, bolted, or otherwise supported by the base member 432. In some embodiments, the connection interfaces 430 can be rigid and can be formed from steel, stainless steel, aluminum, a composite material, or any other suitable material or combination of materials.

Figure 35:
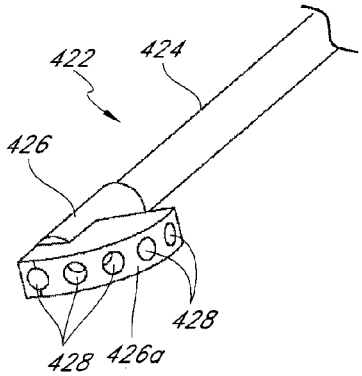
FIG. 35 is a perspective view of a portion of the embodiment of the resilient member shown in FIG. 31.
Figure 34:
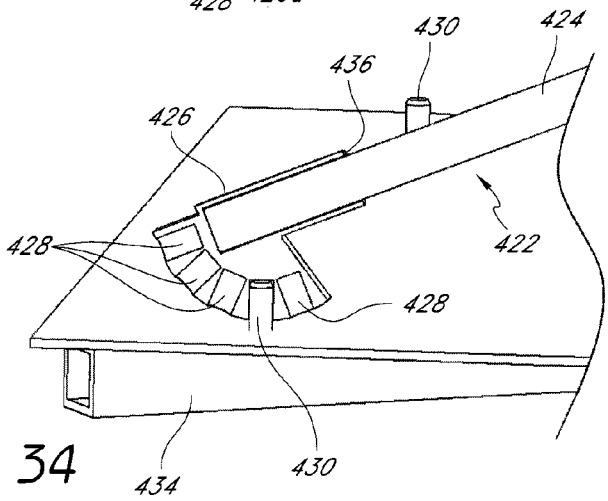
FIG. 34 is an enlarged view of a portion of FIG. 33.
Figure 33:
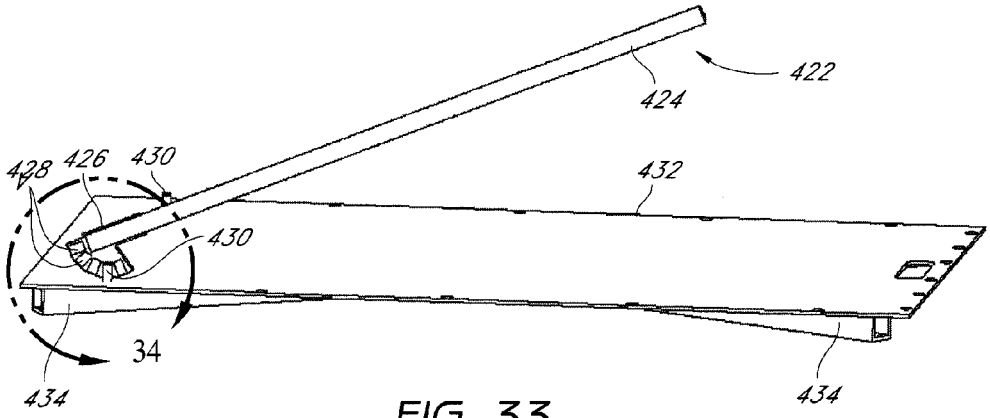
FIG. 33 is a perspective view of the embodiment of an exercise device shown in FIG. 31, wherein the embodiment of the resilient member shown in FIG. 31 is shown in a section view and in a different orientation relative to the base member as compared to the embodiment of the resilient member shown in FIG. 31.

FIG. 33 is a perspective view of the embodiment of the exercise device 420, wherein the embodiment of the resilient member 422 is shown in a section view and in a different orientation relative to the base member 432 as compared to the embodiment of the resilient member 422 shown in FIG. 31. FIG. 34 is an enlarged view of a portion of the exercise device 420 shown in FIG. 33, and FIG. 35 is a perspective view of a portion of the embodiment of the resilient member 422 shown in FIG. 31.

With reference to FIGS. 31-35, the resilient member 422 can be mounted to or supported by the connection interface 430 and, hence, the base member 432, by sliding the insert member 426 of the resilient member 422 onto the connection interface 430 such that the connection interface 430 can be received by one of the openings 428 (also referred to herein as support openings) formed in the interface member 426. In particular, with reference to FIG. 32, the resilient member 422 can be removably mounted to the connection interface 430 by moving the resilient member 422 in the direction defined by arrow A4 relative to the connection interface 430 so that the connection interface 430 can be received by one of the openings 428 formed in the connection interface 426. In some embodiments, the angular orientation of the resilient member (which can be defined by the longitudinal axis of the resilient member) relative to the base member 432 can be adjusted by changing the opening 428 defining the removable support for the resilient member 422.

In the illustrated embodiment, the connection interfaces 430 can be supported by the base member 432 in a generally perpendicular orientation relative to the base member 432. However, the configuration of the exercise device 420 is not so limited. In some embodiments, the connection interfaces 430 can be supported by the base member 432 at any of a wide range of desired angular orientations relative to the base member 432. In some embodiments, a plurality of connection interfaces 430 can be supported by the base member 432, each being mounted at a different location and/or angular orientation relative to the base member 432. Additionally, in some embodiments, one or more of the connection interfaces 430 can be movably supported by the base member 432 so that a user can adjust the location and/or angular orientation of the connection interface 430 relative to the base member 432, similar to the adjustable base members such as, without limitation, adjustable base members 40*a*, 40*b*, and 40*c* described in U.S. Patent Application Publication No. US 2007/0072752, which is incorporated by reference herein.

Each interface member 426 can define any desired number of openings 428 formed in the interface member 426, formed at any desired angular orientation relative to the stiffening member 424 of each resilient member 422. In the illustrated embodiment, the surface 426*a* or portions of the surface 426*a* of the interface member 426 can be generally arcuate. In some embodiments, the surface 426*a* or portions of the surface 426*a* of the interface member 426 can be generally planar, spherical, curved (arcuately or otherwise), or can define any desired surface contour. In some embodiments, the interface member 426 can be formed from the same material or materials that are used to form the stiffening member 424, and can be integrally formed therewith or formed in a separate process and joined therewith.

In some embodiments, the openings 428 formed in the insert member 426 or portions thereof can define a square, triangular, ovular, polygonal, or other similar or desired cross-section. In some embodiments, splines, teeth, protrusions, channels, notches, or other features configured to inhibit the resilient member 424 from rotating (i.e., spinning) within or relative to the connection interface 430, can be formed on one or more surfaces of the insert member 426 (including, without limitation, one or more surfaces of the openings 428) and/or the connection interface 430 to inhibit the resilient member 422 from rotating (i.e., spinning) within or relative to the connection interface 430. In some embodiments, the openings 428 formed in the insert member 426 or portions thereof can be configured to permit the resilient member 422 to rotate relative to the connection interface 430.

Figures 36, 37, 38:
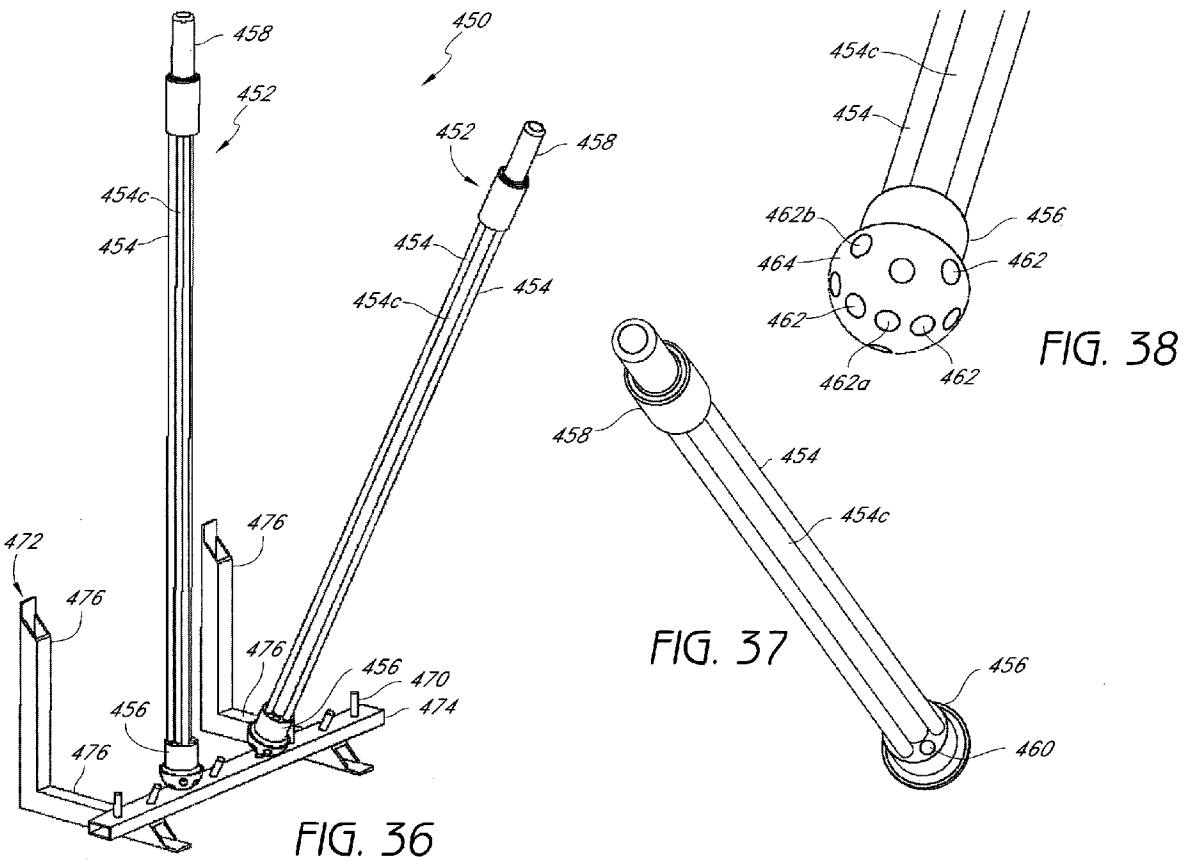
FIG. 36 is a perspective view of another embodiment of an exercise device.
FIG. 37 is a perspective view of the embodiment of the resilient member shown in FIG. 36.
FIG. 38 is a perspective view of a portion of the embodiment of the resilient member shown in FIG. 36.

FIG. 36 is a perspective view of another embodiment of an exercise device 450. FIGS. 37 and 38 are a perspective view and an enlarged perspective view of a portion, respectively, of the embodiment of the resilient member 452 shown in FIG. 36. In some embodiments, one or more of the components of the exercise device 450 can have the same or similar features, materials, geometries, or other details or configurations as any of the other components (similar or otherwise) of the other embodiments described herein.

The resilient member 452 can be configured to support a center stiffening member 454*c* as well as to removably support additional stiffening members 454. With reference to FIGS. 36-38, each of the resilient members 452 can further comprise a first member or insert member 456 and a second member or handle 458. Each of the stiffening members 454 can be generally resilient or bendable along a substantial or entire portion of its length and can be either removably or non-removably supported by the openings 460 formed in the insert member 456. The handle 458 can also be configured to comprise openings (not illustrated) to either removably or non-removably support the stiffening members 454. Additionally, in some embodiments, the openings in the handle member 458 can be configured to permit one or more of the stiffening members 454 to translate axially within its respective opening.

With reference to FIG. 38, the insert member 456 can define one or more openings formed in the surface 464 at different locations and/or angular orientations relative to a longitudinal axis of the resilient member 452. In some embodiments, the surface 464 can be spherical. Some of the openings 462 (also referred to herein as support openings), such as but not limited to opening 462*a*, can be formed at an angle that can be approximately co-linear with the longitudinal axis of the resilient member 452. Additionally, in some embodiments, any of the openings 462 can be formed at any of a wide range of angular orientations relative to the centerline axis of the resilient member 452. In some embodiments, the openings 462 can be formed that an angle that can be between approximately 0° and approximately 90°, or more, relative to the centerline axis of the resilient member 452.

With reference to FIG. 36, each of the resilient members 452 can be supported by inserting each of the resilient members 452 onto a protrusion 470 supported by the base member 472 such that the protrusion 470 can be received by one of the openings 462 formed in the insert member 456. The protrusions 470 can be configured to support each of the resilient members 452 so that at least the insert member 456 of the resilient member 452 supported by the protrusion 470 can be prevented from rotating (i.e., pivoting) relative to the protrusion 470 and hence, the base 472.

Thus, by varying the opening 462 and/or the protrusion 470 that defines the removable support for the resilient member 452, a user can adjust the location and/or angular orientation of the resilient member 452 relative to the base 472 or the user. In some embodiments, the base member 472 can be removably or non-removably attached to or supported by a horizontal, vertical, or other supporting surface such as, but not limited to, a floor or ground surface, a wall, a door, or other suitable structure using bolts, screws, clamps, or any other suitable fastening mechanism. In some embodiments, the base member 472 can be configured to be free standing.

In some embodiments, the base portion 474 can be removably or non-removably attached to or supported by a horizontal, vertical, or other supporting surface such as, but not limited to, a floor or ground surface, a wall, a door, or other suitable structure using bolts, screws, clamps, or any other suitable fastening mechanism, without the inclusion of the frame members 476, resulting in a simpler apparatus with fewer component parts. The base portion 474, if so supported or attached without the frame members 476, can be configured to define a wider contact surface area relative to the supporting surface, such as by forming or attaching support tabs or wings to the base portion 474 so as to improve the stability and attachment strength of the base portion 474 when transverse forces are applied thereto as the resilient members 452 are deflected from a longitudinal axis of the relaxed resilient member 452 (i.e., flexed or bent).

Figure 39:
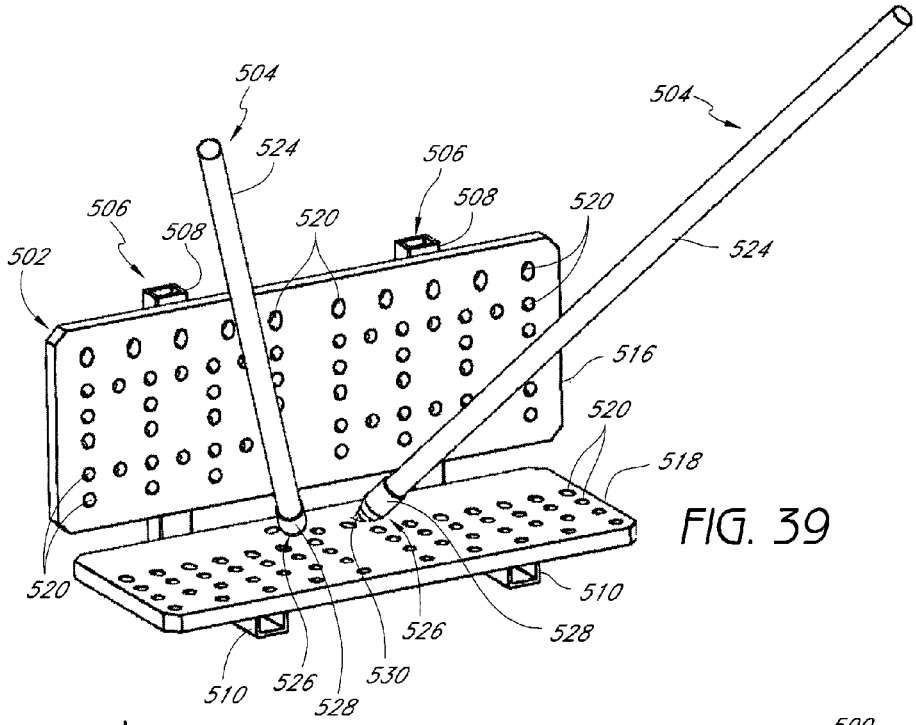
FIG. 39 is a perspective view of another embodiment of an exercise device.
Figure 40:
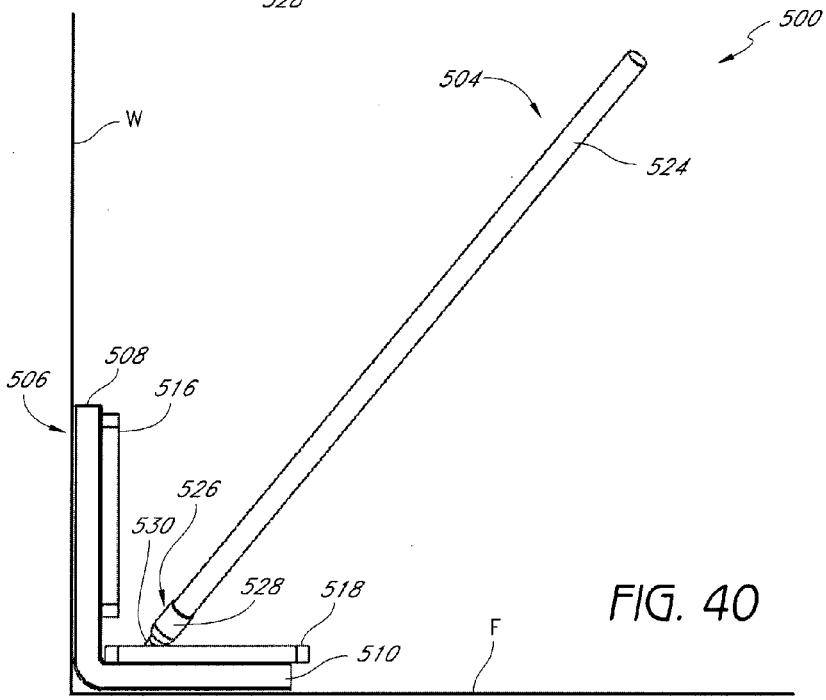
FIG. 40 is a side view of the embodiment of the exercise device shown in FIG. 39.

FIGS. 39 and 40 are a perspective view and a side view, respectively, of another embodiment of an exercise device 500. In some embodiments, one or more of the components of the exercise device 500 can have the same or similar features, materials, geometries, or other details or configurations as any of the other components (similar or otherwise) of the other embodiments described herein. The exercise device a 500 can define a base member 502 and one or more resilient members 504 removably or non-removably supported by the base member 502. The base member 502 can be formed from one or more frame members 506, each comprising a first frame member 508 and a second frame member 510. The base member 502 can be removably or non-removably attached to or supported by a horizontal, vertical, or other supporting surface such as, but not limited to, a floor or ground surface (denoted by F in FIG. 40), a wall (denoted by W in FIG. 40), a door, or other suitable structure using bolts, screws, clamps, or any other suitable fastening mechanism. In some embodiments, the base member 502 can be configured to be free standing.

The base member 502 can have a first base portion 516 and a second base portion 518, each comprising one or more openings 520, each of which can define a removable or non-removable support for a resilient member 504. The openings 520 can be formed at any of a wide ranging variety of locations and/or angular orientations on the first base portion 516 and second base portion 518. Thus, by varying the opening 520 that defines the removable support for the resilient member 504, a user can adjust the location and/or angular orientation of the resilient member 504 (which can be defined by the longitudinal axis of the resilient member) relative to the base 502 or the user.

Each of the resilient members 504 can define one or more stiffening members 524 and an insert member 526. The insert members 526 can each define a support portion 528, which can be configured to receive and provide cantilever support to one or more stiffening members 524, and an insertion portion 530, which can be configured to be received by some or all of the openings 520 formed in the base member 502. The geometry of the insertion portion 530 can be configured to approximately match the geometry of one or more of the openings 520 formed in the base member 502. In some embodiments, the shape and size of each of the openings 520, which can be cylindrical, conical, or otherwise, can be approximately the same or similar from one opening 520 to the next. The size and geometry of the insertion portion 530 of the insert member 526 can be independent of the size and geometry of the support portion 528 of each insert member such that each insert member 526 can be configured to support one or more of a wide range of sizes and shapes of stiffening members 524 without affecting the size and shape of the insert portion 530. In this configuration, a wide range of shapes and sizes of stiffening members 524 can be supported by a uniformly shaped set of the openings 520.

Figure 42:
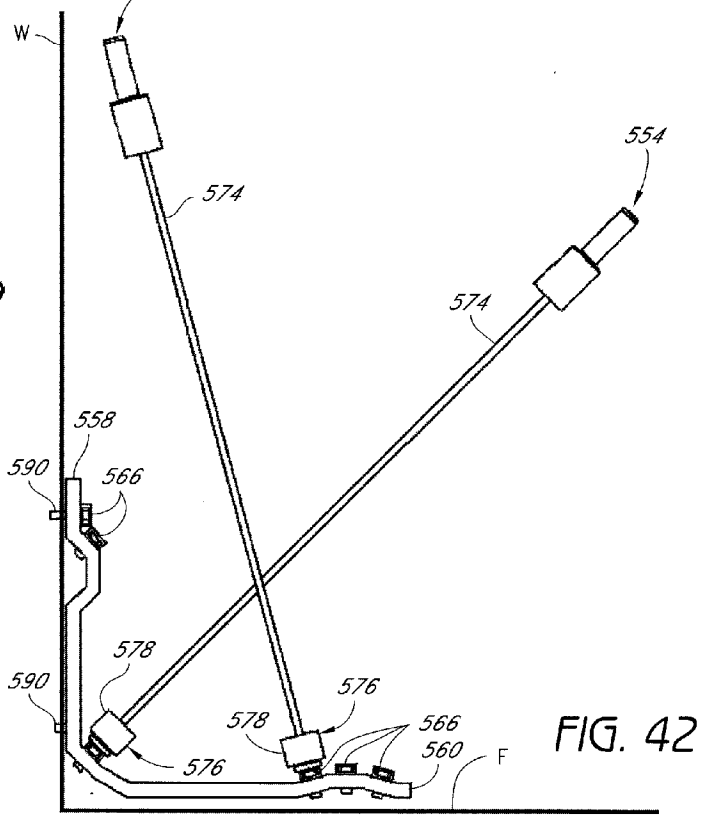
FIG. 42 is a side view of the embodiment of the exercise device shown in FIG. 41.
Figure 41:
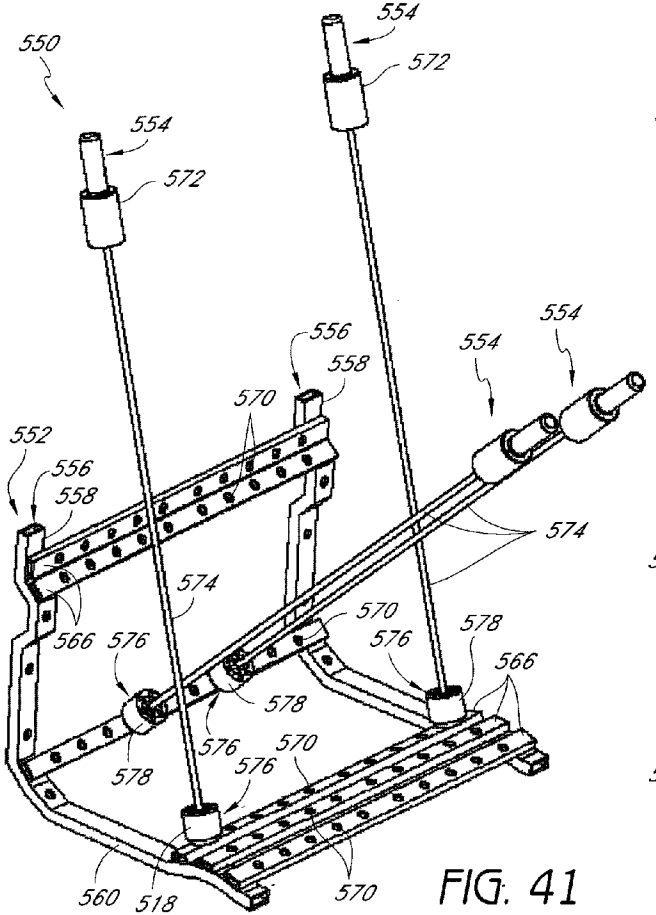
FIG. 41 is a perspective view of another embodiment of an exercise device.

FIGS. 41 and 42 are a perspective view and a side view, respectively, of another embodiment of an exercise device 550. In some embodiments, one or more of the components of the exercise device 550 can have the same or similar features, materials, geometries, or other details or configurations as any of the other components (similar or otherwise) of the other embodiments described herein. The exercise device 550 can define a base member 552 and one or more resilient members 554 removably or non-removably supported by the base member 552. The base member 552 can be formed from one or more frame members 556, each comprising a first frame member 558 and a second frame member 560. The base member 552 can be removably or non-removably attached to or supported by a horizontal, vertical, or other supporting surface such as, but not limited to, a floor or ground surface (denoted by F in FIG. 42), a wall (denoted by W in FIG. 42), a door, or other suitable structure using bolts, screws, clamps, or any other suitable fastening mechanism. In some embodiments, the base member 552 can be configured to be free standing.

The base member 552 can have one or more base portions 566, each being bolted, welded, or otherwise attached to or supported by the frame members 556 at a different location and/or angular orientation as compared to one another. Each of the one or more base portions 566 can comprise one or more openings 570. Each of the one or more openings 570 can define a removable or non-removable support for a resilient member 554. The openings 570 can be formed at any of a wide ranging variety of locations and, in some embodiments, angular orientations, on each base portion 566. Thus, by varying the opening 570 that defines the removable support for the resilient member 554, a user can adjust the location and/or angular orientation of the resilient member 554 (which can be defined by the longitudinal axis of the resilient member) relative to the base 552 or the user.

Each of the resilient members 554 can define one or more stiffening members 574 and an insert member 576. The insert members 576 can each define a support portion 578, which can be configured to receive and provide cantilever support to one or more stiffening members 574, and an insertion portion (not illustrated), which can be configured to be received by some or all of the openings 570 formed in the base member 552. The geometry of the insertion portion (not illustrated) can be configured to approximately match the geometry of one or more of the openings 570 formed in the base member 552. In some embodiments, the shape and size of each of the openings 570, which can be cylindrical, conical, or otherwise, can be approximately the same or similar from one opening 570 to the next. The size and geometry of the insertion portion (not illustrated) of the insert member 576 can be independent of the size and geometry of the support portion 578 of each insert member such that each insert member can be configured to support one or more of a wide range of sizes and shapes of stiffening members 574 without affecting the size and shape of the insert portion of the insert member 576. In this configuration, a wide range of shapes and sizes of stiffening members 574 can be supported by a uniformly shaped set of the openings 570.

Figure 43:
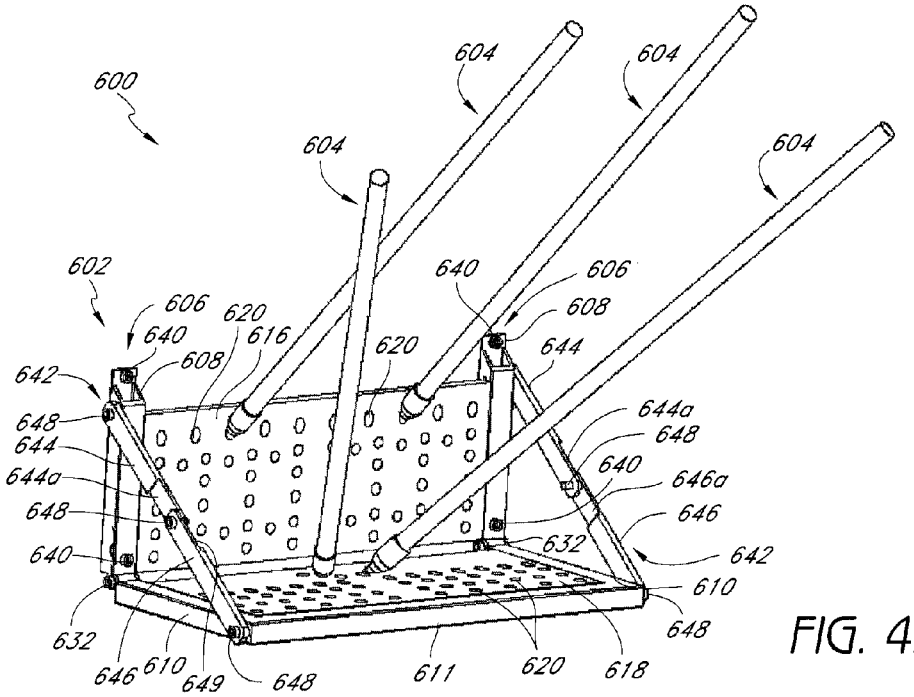
FIG. 43 is a perspective view of another embodiment of an exercise device.
Figure 44:
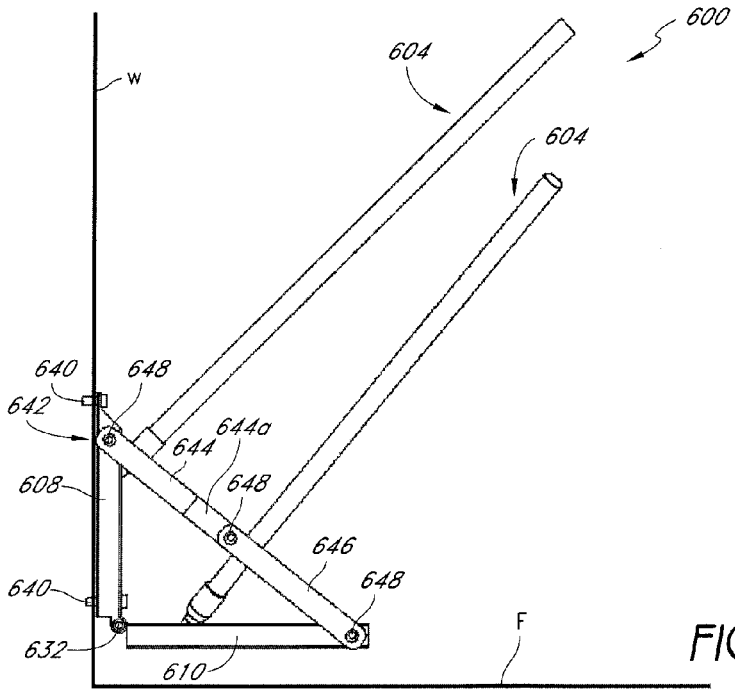
FIG. 44 is a side view of the embodiment of the exercise device shown in FIG. 43.

FIGS. 43 and 44 are a perspective view and a side view, respectively, of another embodiment of an exercise device 600. In some embodiments, one or more of the components of the exercise device 600 can have the same or similar features, materials, geometries, or other details or configurations as any of the other components (similar or otherwise) of the other embodiments described herein. The exercise device 600 can define a base member 602 and one or more resilient members 604 removably or non-removably supported by the base member 602. The base member 602 can be formed from one or more frame members 606, each comprising a first frame member 608 and a second frame member 610. The base member 602 can be removably or non-removably attached to or supported by a horizontal, vertical, or other supporting surface such as, but not limited to, a floor or ground surface (denoted by F in FIG. 44), a wall (denoted by W in FIG. 44), a door, or other suitable structure using bolts, screws, clamps, or any other suitable fastening mechanism. In some embodiments, the base member 602 can be configured to be free standing.

The base member 602 can have one or more base portions 616, each being bolted, welded, or otherwise attached to or supported by the frame members 606. Each of the one or more base portions 616 can comprise one or more openings 620. Each of the one or more openings 620 can define a removable or non-removable support for a resilient member 604. The openings 620 can be formed at any of a wide ranging variety of locations and/or angular orientations on each base portion 616. Thus, by varying the opening 620 that defines the removable support for the resilient member 604, a user can adjust the location and/or angular orientation of the resilient member 604 (which can be defined by the longitudinal axis of the resilient member) relative to the base 602 or the user.

Each of the resilient members 604 can define one or more stiffening members and an insert member. The insert members can be configured to be received by some or all of the openings 620 formed in the base member 602. The geometry of the insertion portion of each insert member can be configured to approximately match the geometry of one or more of the openings 620 formed in the base member 602. In some embodiments, the shape and size of each of the openings 620, which can be cylindrical, conical, or otherwise, can be approximately the same or similar from one opening 620 to the next. The size and geometry of the insertion portion of the insert member can be independent of the size and geometry of the support portion of each insert member such that each insert member can be configured to support one or more of a wide range of sizes and shapes of stiffening members without affecting the size and shape of the insert portion of the insert member. In this configuration, a wide range of shapes and sizes of stiffening members can be supported by a uniformly shaped set of the openings 620.

Each of the frame members 606 can further comprise a hinge 632 between the first frame member 608 and a second frame member 610 that can be configured to permit the second frame member 610 to rotate relative to the first frame member 608. The hinge configuration can permit the base member 602 to be folded or collapsed during periods of nonuse, so that the exercise device 600 can occupy a smaller volume of space so as to be more easily stored. Hinged members 644 and 646 can be rotationally supported by the first and second frame members 608, 610, respectively, to limit the range of rotation of the second frame member 610 relative to the first frame member 608, and can provide additional structural support to the base member 602. The hinged members 644 and 646 can be attached to the first and second frame members 608, 610 using fasteners 648. The recessed portions 644*a* and 648*a* of the first and second frame members 608, 610, respectively, can be configured to permit the hinged members fold up nearly completely so that the second frame member 610 can lie approximately adjacent to the first frame member 608 in the stowed configuration. Fasteners 640 can be used to fix the first frame member 608 two and 80 desired or suitable support structure.

Figure 45:
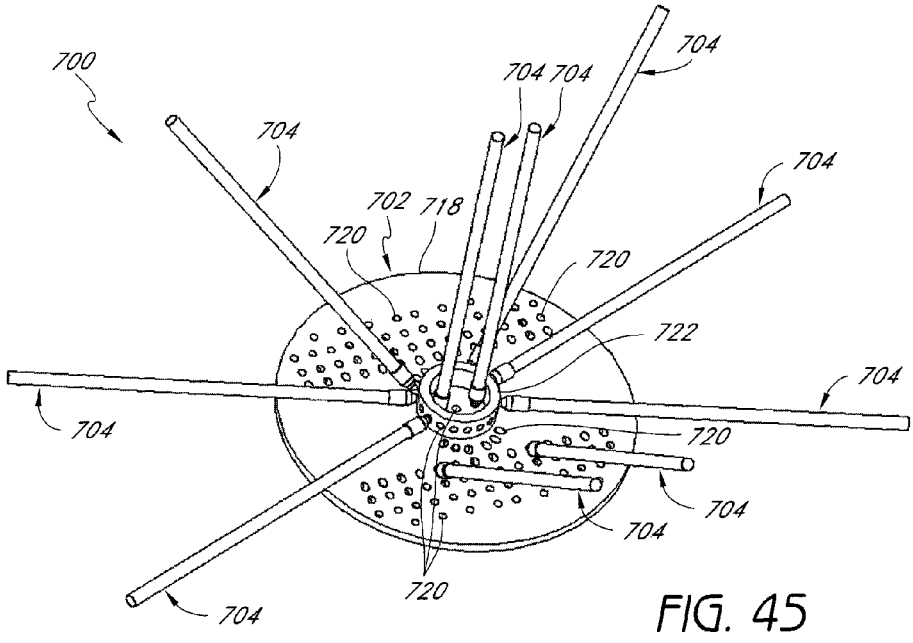
FIG. 45 is a perspective view of another embodiment of an exercise device.
Figure 46:
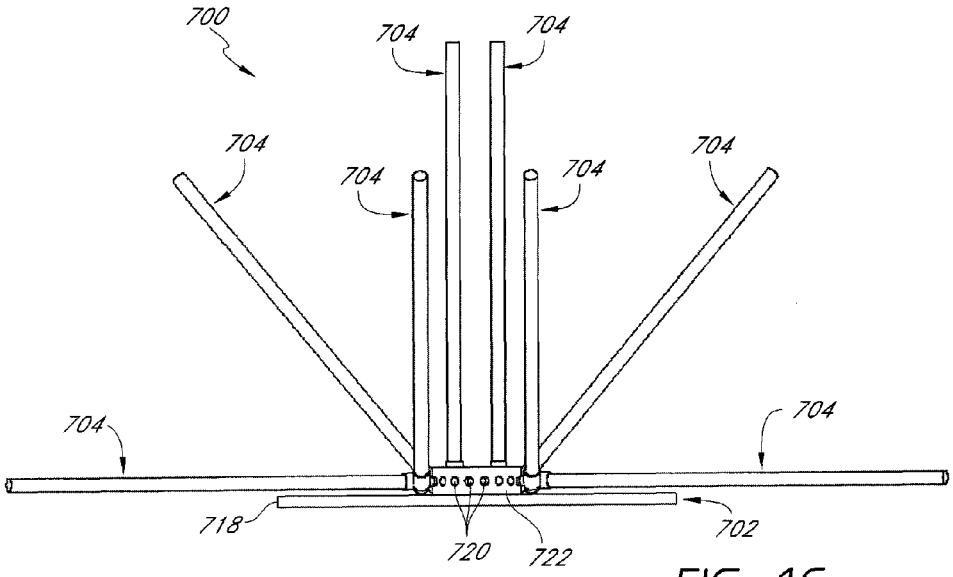
FIG. 46 is a side view of the embodiment of the exercise device shown in FIG. 45.

FIGS. 45 and 46 are a perspective view and a side view, respectively, of another embodiment of an exercise device 700. In some embodiments, one or more of the components of the exercise device 700 can have the same or similar features, materials, geometries, or other details or configurations as any of the other components (similar or otherwise) of the other embodiments described herein. The exercise device 700 can define a base member 702 and one or more resilient members 704 removably or non-removably supported by the base member 702. In some embodiments, the base member 702 can be removably or non-removably attached to or supported by a horizontal, vertical, or other supporting surface such as, but not limited to, a floor or ground surface (denoted by F in FIG. 46), a wall (denoted by W in FIG. 46), a door, or other suitable structure using bolts, screws, clamps, or any other suitable fastening mechanism. In some embodiments, the base member 702 can be configured to be free standing.

The base member 702 can have one or more first base portions 718, each of which can comprise one or more openings 720, and a second base portion 722, which can also comprise one or more openings 720. Each of the one first base portions 718 can define any circular (as illustrated), square, rectangular, polygonal, or other suitable or desired shape. The second base member 722 can have a circular, annular, square, rectangular, polygonal, or other desired or suitable cross-sectional shape. The exercise device 700 can be configured to permit multiple users to use the exercise device 700 simultaneously.

Each of the one or more openings 720 can define a removable or non-removable support for a resilient member 704.

The openings 720 can be formed at any of a wide ranging variety of locations and/or angular orientations on the first base portion 718. Thus, by varying the opening 720 that defines the removable support for the resilient member 704, a user can adjust the location and/or angular orientation of the resilient member 704 (which can be defined by the longitudinal axis of the resilient member) relative to the base 702 or the user.

Each of the resilient members 704 can define one or more stiffening members and an insert member. The insert members can be configured to be received by some or all of the openings 720 formed in the base member 702. The geometry of the insertion portion of each insert member can be configured to approximately match the geometry of one or more of the openings 720 formed in the base member 702. In some embodiments, the shape and size of each of the openings 720, which can be cylindrical, conical, or otherwise, can be approximately the same or similar from one opening 720 to the next. The size and geometry of the insertion portion of the insert member can be independent of the size and geometry of the support portion of each insert member such that each insert member can be configured to support one or more of a wide range of sizes and shapes of stiffening members without affecting the size and shape of the insert portion of the insert member. In this configuration, a wide range of shapes and sizes of stiffening members can be supported by a uniformly shaped set of the openings 720.

Figure 48:
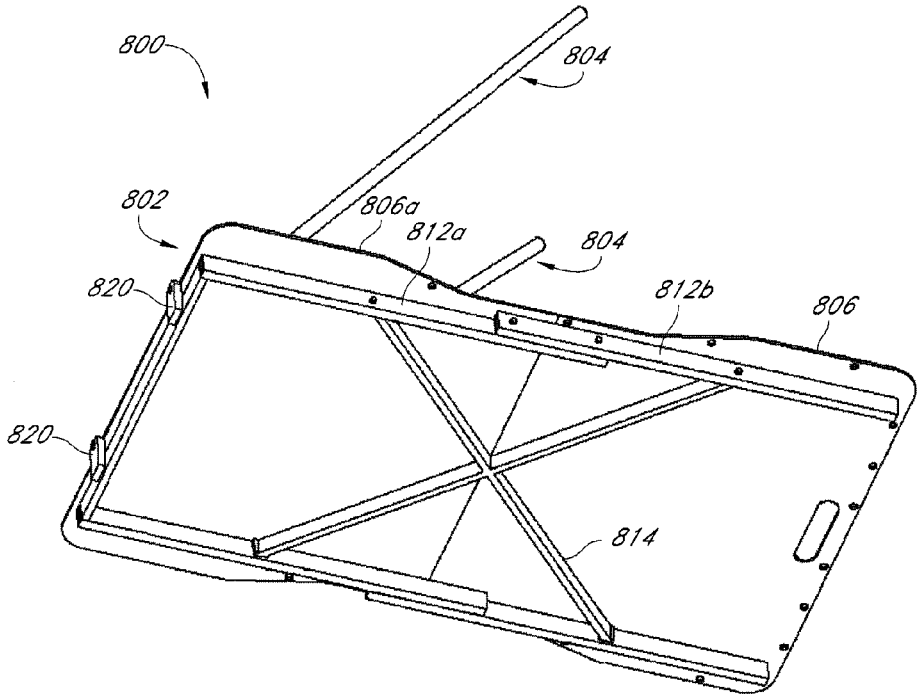
FIG. 48 is a perspective view of the bottom portion of the embodiment of an exercise device shown in FIG. 47.
Figure 47:
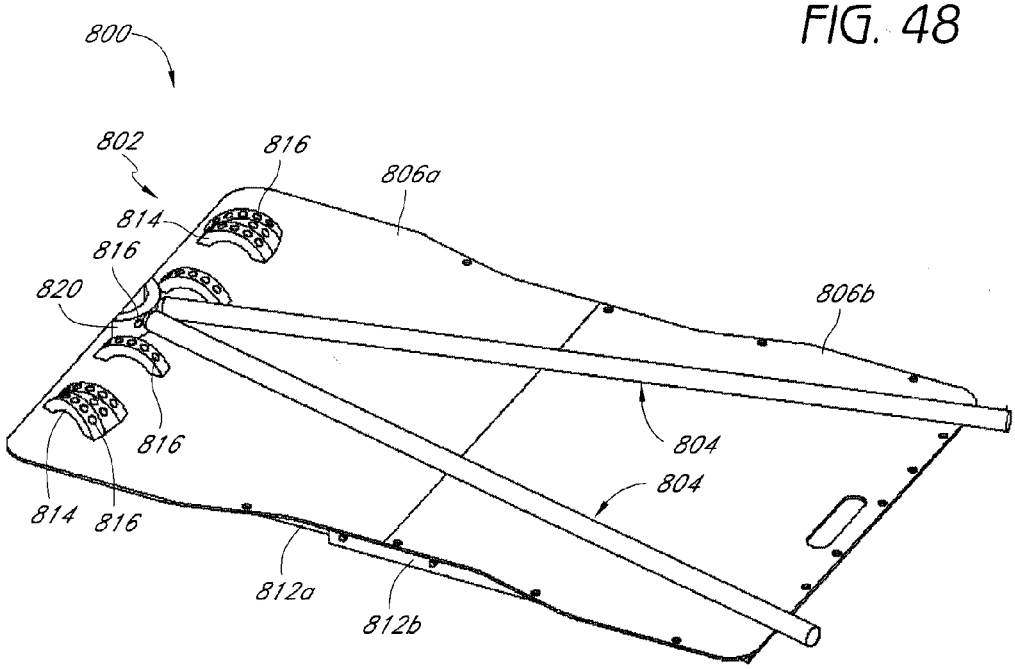
FIG. 47 is a perspective view of the top portion of another embodiment of an exercise device.

FIGS. 47 and 48 are perspective views of the top and bottom portions, respectively, of another embodiment of an exercise device 800. In some embodiments, one or more of the components of the exercise device 800 can have the same or similar features, materials, geometries, or other details or configurations as any of the other components (similar or otherwise) of the other embodiments described herein. In some embodiments, the exercise device 800 can comprise a base member 802 and one or more resilient members 804. In some embodiments, the base member 802 can comprise first and second base portions 806*a*, 806*b*, respectively.

In the illustrated embodiment, and in any embodiment described herein, the base 802 (or any base described herein) can be configured to be free standing on a generally flat, horizontal surface so as to provide a supporting surface for a user of the exercise device in a standing, sitting, kneeling, or any other desired position. However, the exercise device 800 is not so limited. In some embodiments, the base 802 or any portion thereof can be attached to and, hence, supported by a horizontal, vertical or inclined surface, or can be configured to be free standing in a vertical or any angular orientation.

The base member 802 can have a supporting frame 812. Any components comprising the base member 802 or supporting frame 812, or any other base member or supporting frame disclosed herein, can be formed from steel, aluminum, plastic, fiberglass, and/or any other suitable material, composite material, or combination thereof. Additionally, in some embodiments, generally arcuately shaped base connection members 814 can be supported by the base member 802. In some embodiments (not illustrated), the base connection member 814 can be generally spherically shaped. The base connection members 814 can be fixed to the base member 802, or can be supported by the base member 802 in a manner that permits the base connection members 814 to be rotationally adjustable relative to the base member 802. In some embodiments, a plurality of base connection members 814 can be supported by the base member 802, each being mounted at a different location and/or angular orientation relative to the base member 802.

The base connection members 814 can define one or more connection interfaces 816 that are configured to support one or more resilient members 804. In the embodiment illustrated in FIGS. 47-48, the connection interfaces 816 can be cylindrically shaped openings formed at various locations on the base connection members 814, defining various angular orientations relative to the base 802 such that the angular orientation of the longitudinal axis of the resilient member 804 relative to the base 802 can be adjusted by changing the connection interface 816 that defines the support for the resilient member 804.

Additionally, the base connection members 814 can be bolted, welded, or otherwise attached or mounted to the base member 802 in a wide range of angular orientations to further increase the range of the angular orientations of the connection interfaces 816, each of which can define a removable or non-removable support for a resilient member 804.

The first and second base portions 806*a*, 806*b* can be assembled together by fastening the overlapping portions of the frame 812*a* with the overlapping portions of the frame 812*b*. Configuring the base member 802 to comprise to removably attachable base portions 806*a*, 806*b* can permit the base member 802 to break down to a smaller size during periods of nonuse of the exercise device 800. An additional cross-brace 814 can be bolted or otherwise removably attached to the first and second base portions 806*a*, 806*b* to provide additional stiffness and support to the base member 802. One or more horizontal base connection members 820 can also be supported by the base member 802 to provide additional connection interfaces 816 to support the one or more resilient members 804.

Figure 49:
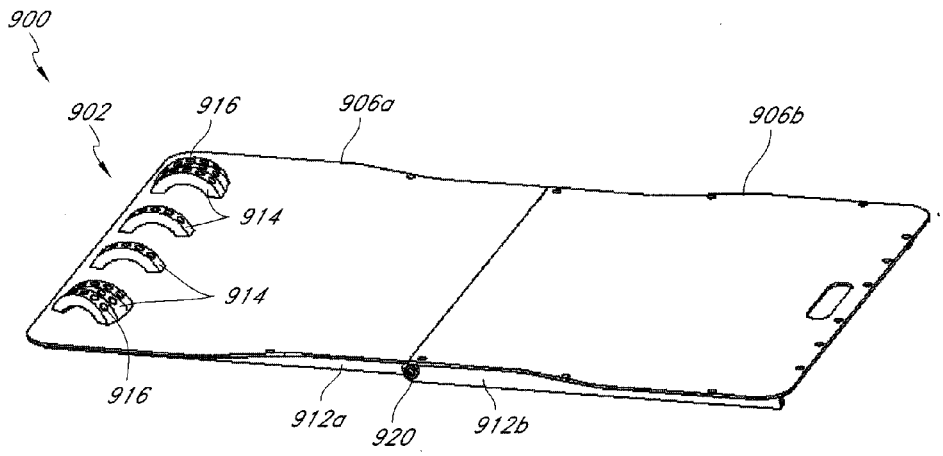
FIG. 49 is a perspective view of another embodiment of an exercise device, showing the exercise device in an operational position.
Figure 50:
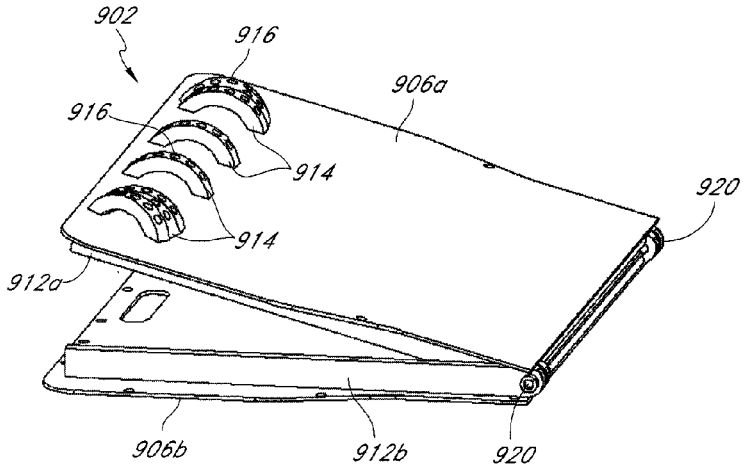
FIG. 50 is a perspective view of the embodiment of the exercise device shown in FIG. 49, showing the exercise device in a partially collapsed or folded position.

FIG. 49 is a perspective view of another embodiment of an exercise device, showing the exercise device in an operational position. FIG. 50 is a perspective view of the embodiment of the exercise device shown in FIG. 49, showing the exercise device in a partially collapsed or folded position. In some embodiments, one or more of the components of the exercise device 900 can have the same or similar features, materials, geometries, or other details or configurations as any of the other components (similar or otherwise) of the other embodiments described herein. In some embodiments, the exercise device 900 can comprise a base member 902 and one or more resilient members (not illustrated). In some embodiments, the base member 902 can comprise first and second base portions 906*a*, 906*b*, respectively.

In the illustrated embodiment, and in any embodiment described herein, the base 902 (or any base described herein) can be configured to be free standing on a generally flat, horizontal surface so as to provide a supporting surface for a user of the exercise device in a standing, sitting, kneeling, or any other desired position. However, the exercise device 900 is not so limited. In some embodiments, the base 902 or any portion thereof can be attached to and, hence, supported by a horizontal, vertical or inclined surface, or can be configured to be free standing in a vertical or any angular orientation.

The base member 902 can have a supporting frame 912. Any components comprising the base member 902 or supporting frame 912, or any other base member or supporting frame disclosed herein, can be formed from steel, aluminum, plastic, fiberglass, and/or any other suitable material, composite material, or combination thereof. Additionally, in some embodiments, generally arcuately shaped base connection members 914 can be supported by the base member 902. In some embodiments (not illustrated), the base connection member 914 can be generally spherically shaped. The base connection members 914 can be fixed to the base member 902, or can be supported by the base member 902 in a manner that permits the base connection members 914 to be rotationally adjustable relative to the base member 902. In some embodiments, a plurality of base connection members 914 can be supported by the base member 902, each being mounted at a different location and/or angular orientation relative to the base member 902.

The base connection members 914 can define one or more connection interfaces 916 that are configured to support one or more resilient members (not illustrated). In the embodiment illustrated in FIGS. 49-50, the connection interfaces 916 can be cylindrically shaped openings formed at various locations on the base connection members 914, defining various angular orientations relative to the base 902 such that the angular orientation of the longitudinal axis of the resilient member 904 relative to the base 902 can be adjusted by changing the connection interface 916 that defines the support for the resilient member 904.

Additionally, the base connection members 914 can be bolted, welded, or otherwise attached or mounted to the base member 902 in a wide range of angular orientations to further increase the range of the angular orientations of the connection interfaces 916, each of which can define a removable or non-removable support for a resilient member 904. The first and second base portions 906*a*, 906*b* can be joined together by a rotatable hinge 920 that permits the base 902 to be collapsed to a stowed position. FIG. 50 illustrates the base member 902 in a partially stowed position for clarity. The base member 902 can be configured to be fully collapsed to break down to a smaller size during periods of nonuse of the exercise device 900. An additional cross-brace (not illustrated) can be bolted or otherwise removably attached to the first and second base portions 906*a*, 906*b* to provide additional stiffness and support to the base member 902.

Other sizes, shapes, and configurations of the base, resilient members, base interface members, connection interfaces, or any other components or combination of components described herein or known in the art or to one of ordinary skill in the art can be used with the exercise device of this disclosure. For example, the components and assemblies described in U.S. Patent Application Publication No. US 2007/0072752, published Mar. 29, 2006, can be used to practice the exercise device of this disclosure. The entirety of U.S. Patent Application Publication No. US 2007/0072752, is expressly incorporated by reference herein and made a part of the present specification as if fully set forth herein.

Although the embodiments in this disclosure have been disclosed in the context of a certain preferred embodiments and examples, it will be understood by those skilled in the art that the embodiments of the present disclosure extend beyond the specifically disclosed embodiments to other alternative embodiments and/or uses of the embodiments of the present disclosure and obvious modifications and equivalents thereof. In addition, while a number of variations of the embodiments of the present disclosure have been shown and described in detail, other modifications, which are within the scope of the embodiments of the present disclosure, will be readily apparent to those of skill in the art based upon this disclosure. It is also contemplated that various combinations or subcombinations of the specific features and aspects of the embodiments may be made and still fall within the scope of the embodiments of the present disclosure. Accordingly, it should be understood that various features and aspects of the disclosed embodiments can be combined with or substituted for one another in order to form varying modes of the disclosed embodiments of the present disclosure. Thus, it is intended that the scope of this disclosure herein disclosed should not be limited by the particular disclosed embodiments described above.

What is claimed is:

1. A device for exercising the muscles in a user's body, the device comprising:

a first base connection portion comprising a curved surface and a plurality of openings therein;

a second base connection portion comprising a curved surface and a plurality of openings therein; and one or more resilient members, each configured to be supportable in a cantilevered disposition by any one of the openings of the first and second base connection portions;

wherein:

each resilient member is configured to produce a resistance force when a user bends at least a portion of the resilient member from the longitudinal axis of the relaxed position of the resilient member; and the first and second base connection portions are directly or indirectly attached to a support surface.

2. The device of claim 1, wherein two or more of the openings in the first base connection portion are oriented at different angular orientations from one another, and/or are angled so as to be approximately normal to the curved surface of the first base connection portion.

3. The device of claim 1, wherein:

at least one of the one or more resilient members comprises a substantially rigid first end portion and a bendable second portion;

the first end portion is configured to be received by any one of the openings of the first and second base connection portions such that the first end portion is prevented from pivoting relative to the respective opening; and the first end portion is configured to support the second portion of the resilient member in a cantilevered disposition.

4. The device of claim 1, wherein two or more of the openings of the first base connection portion are oriented at two or more different angles relative to a user of the device.

5. The device of claim 1, further comprising a third base connection portion comprising a curved surface and a plurality of openings therein, wherein the openings are each configured to support at least the first portion of the resilient member such that at least the first portion of the resilient member is prevented from pivoting relative to the respective opening.

6. The device of claim 5, wherein the third base connection portion is positioned at an angular orientation that is different than the angular orientation of the first or the second base connection portion.

7. The device of claim 1, wherein at least one opening of the first or second base connection portions is cylindrically shaped.

8. The device of claim 1, wherein the first and second base connection portions are supported by a base.

9. The device of claim 8, wherein the base is foldable.

10. The device of claim 8, wherein the base comprises a generally flat, generally horizontally oriented surface to support the user of the device.

11. The device of claim 1, wherein one or more of the resilient members comprises two or more bendable stiffening members.

12. The device of claim 1, wherein the device is configured such that the resistance force that can be generated by bending the resilient members can be varied without changing the size or shape of the openings.

13. The device of claim 1, wherein:

at least one of the one or more resilient members comprises a first end portion and a second portion, wherein at least the second portion is bendable; and such resilient member is configured such that the second portion of such resilient member is supportable at any one of one or more non-zero angles relative to the connection interface, so that the longitudinal axis defined by the second portion of the resilient member in a relaxed state defines any one of one or more non-zero angles relative to a longitudinal axis defined by the respective connection interface.

14. The device of claim 1, wherein one or more of the openings comprises one or more protrusions, channels, or other features configured to prevent the resilient member from spinning relative to the opening.

15. The device of claim 1, further comprising an insert member configured to be supported by any of the plurality of openings of the first and second base connection portions and to support one of the one or more resilient members at an angular orientation that is different than the angular orientation of the connection interface supporting the insert member.

16. The device of claim 15, wherein the insert member comprises an opening therein and an insert portion configured to be received by the connection interface supporting the insert member, the opening having a centerline that is oriented at an angle relative to a centerline of the insert portion that is greater than approximately 0 degrees but less than or equal to approximately 90 degrees.

17. The device of claim 1, wherein at least one of the resilient members is configured such that the second portion of such resilient member is supportable at any one of two or more non-zero angles relative to the connection interface, so that the longitudinal axis defined by the second portion of the resilient member in a relaxed state defines any one of two or more non-zero angles relative to a longitudinal axis defined by the respective connection interface.

18. The device of claim 1, wherein the second base connection portion is spaced apart from the first base connection portion.

19. The device of claim 1, wherein one or more of the resilient members comprises an insert member configured to be supported by at least one of the connection interfaces and a stiffening member extending from the insert member in a cantilevered disposition, and wherein an outside surface of at least an end portion of the stiffening member is surrounded by a rigid material.

20. The device of claim 1, wherein the support surface is a base configured to support a user in a standing, kneeling, sitting, or other position.

21. The device of claim 1, wherein the support surface is a floor or a wall.

22. A device for exercising the muscles in a user's body, the device comprising:

a base member, wherein at least a portion of the base member comprises a curved surface;

a resilient member comprising a first portion and a second portion; and two or more connection interfaces supported by the base member, the two or more connection interfaces being positioned about the curved surface so as to provide two or more supports for the resilient member at two or more different angular orientations so that the resilient member can be supported at any of two or more different angular orientations without deflecting the resilient member from a relaxed position of the resilient member;

wherein:

each connection interface is configured to support at least the first portion of the resilient member such that at least the first portion of the resilient member is prevented from pivoting relative to the base member;

the second portion of each resilient member is configured to define a longitudinal axis disposed generally longitudinally through at least a portion of the second portion when the second portion is in a relaxed state; and the resilient member is configured to produce a resistance force when a user bends at least a portion of the second portion of the resilient member from the longitudinal axis of the relaxed position of the second portion of the resilient member.

23. The device of claim 22, wherein each connection interface comprises an opening extending into the base member through the curved surface.

24. The device of claim 22, further comprising a second base member positioned at a second location relative to a user that is different than a location of any other base member.

25. The device of claim 24, further comprising a third base member positioned at a third location relative to a user that is different than a location of any other base member.

26. The device of claim 22, wherein the base member comprises a generally spherically curved surface.

27. The device of claim 22, wherein the base member is directly or indirectly supported by a support surface having a normal axis that is perpendicular thereto, and at least one of the plurality of connection interfaces is supported by the base member at an angle that is from approximately 15 degrees to approximately 45 degrees relative to the normal axis.

28. The device of claim 22, wherein the base member is directly or indirectly supported by a support surface having a normal axis that is perpendicular thereto, and at least one of the plurality of connection interfaces is supported by the base member at an angle that is from approximately 45 degrees to approximately 90 degrees relative to the normal axis.

29. The device of claim 22, wherein the base member is supported by a base.

30. The device of claim 29, wherein the base is foldable.

31. The device of claim 29, wherein the base comprises a generally flat, generally horizontally oriented surface to support the user of the device.

32. The device of claim 22, wherein the resilient member comprises two or more bendable stiffening members.

33. The device of claim 22, wherein the base member is configured to be supported by a vertical surface.

34. The device of claim 22, wherein the base member is attached to a support structure.

35. The device of claim 22, wherein the device is configured such that the resistance force that can be generated by bending the resilient members can be varied without changing the size or shape of the connection interfaces.

36. The device of claim 22, wherein the resilient member is configured such that a handle member can be supported thereby, the handle member being configured to at least allow the user to vary the orientation of his or her hand relative to the resilient member.

37. The device of claim 22, wherein the resilient member is configured such that the second portion of the resilient member is supportable at any one of one or more non-zero angles relative to the connection interface such that the longitudinal axis defined by the second portion of the resilient member in a relaxed state defines any one of one or more non-zero angles relative to a longitudinal axis defined by the respective connection interface.

38. The device of claim 37, wherein at least one of the non-zero angles relative to the longitudinal axis defined by the respective connection interface is from approximately 15 degrees to approximately 45 degrees.

39. The device of claim 22, wherein one or more of the connection interfaces comprises one or more features to prevent the resilient member from spinning relative to the connection interface.

40. The device of claim 22, wherein one or more of the connection interfaces comprises one or more of splines, teeth, protrusions, channels, and notches to prevent the resilient member from spinning relative to the opening.

41. The device of claim 22, wherein the device is configured such that the second portion of the resilient member is supportable at any one of one or more non-zero angles relative to the connection interface such that the longitudinal axis defined by the second portion of the resilient member in a relaxed state defines any one of one or more non-zero angles relative to a longitudinal axis defined by the respective connection interface, and wherein one or more of the connection interfaces comprises one or more features to prevent the resilient member from rotating relative to the connection interface.

42. The device of claim 22, wherein the resilient member is configured such that the second portion of the resilient member is supportable at any one of two or more non-zero angles relative to the connection interface such that the longitudinal axis defined by the second portion of the resilient member in a relaxed state defines any one of two or more non-zero angles relative to a longitudinal axis defined by the respective connection interface.

43. The device of claim 22, wherein one or more of the resilient members comprises an insert member configured to be supported by at least one of the connection interfaces and a stiffening member extending from the insert member in a cantilevered disposition.

44. The device of claim 43, wherein an outside surface of at least an end portion of the stiffening member is surrounded by a rigid material.

45. The device of claim 22, wherein the base member is supported by a support surface that is provided by at least one of a base configured to support a user in a standing, kneeling, sitting, or other position, a wall, and a floor.

46. A method of exercising the muscles of one's body, comprising:

supporting a first base member directly or indirectly on a support surface, the first base member comprising a plurality of connection interfaces positioned about a curved surface of the first base member;

supporting an end portion of a first resilient member by at least one of the connection interfaces of the first base member so that the first resilient member extends from the connection interface, the connection interfaces each being configured such that at least the end portion of the first resilient member supported thereby is prevented from pivoting relative to the connection interface when a force is applied to the first resilient member;

grasping the first resilient member with one's hand; and exerting a force on the first resilient member so as to deflect at least a portion of the first resilient member from the longitudinal axis of the relaxed position of the first resilient member and effect an exercising of one or more muscles in the user's body; wherein:

two or more of the connection interfaces are positioned about the curved surface of the first base member so as to provide two or more supports for the resilient member at two or more different angular orientations.

47. The method of claim 46, further comprising a second base member at a different location than the first base member, the second base member comprising a plurality of connection interfaces positioned about a curved surface of the second base member.

48. The method of claim 47, further comprising supporting an end portion of a second resilient member in at least one of the connection interfaces of the second base member so that the second resilient member extends from the respective connection interface, the connection interfaces each being configured such that at least an end portion of the second resilient member supported thereby is prevented from pivoting relative to the connection interface when a force is applied to the second resilient member.

49. The method of claim 46, further comprising adjusting the angular orientation of the centerline of the connection interface defining a support for the first resilient member from a first angular orientation to a different, second angular orientation relative to the user by disengaging the first resilient member from the connection interface defining the support for the first resilient member and supporting the first resilient member by another connection interface of the first base member.

50. The method of claim 46, further comprising adjusting the angular orientation of the first base member about an axis that is perpendicular to the support surface by rotating the first base member from a first angular orientation to a different second angular orientation.

51. The method of claim 46, further comprising adjusting the location of the connection interface defining a support for the first resilient member from a first location to a different, second location relative to the user by disengaging the first resilient member from the connection interface defining the support for the first resilient member and supporting the first resilient member by a connection interface of a second base member, the second base member being positioned at a location relative to a user that is different than the location of the first base member.

52. The method of claim 46, comprising adjusting the angular orientation of the centerline of the first resilient member from either a first angular orientation or a second angular orientation to a third angular orientation relative to a user, wherein the orientation of the third angular orientation is different than the orientation of the first angular orientation and the second angular orientation.

53. The method of claim 46, wherein the support surface is vertically oriented.

54. The method of claim 46, comprising supporting an end portion of a first resilient member by at least one of the connection interfaces of the first base member so that the first resilient member in a relaxed state extends from the connection interface at a non-zero angle relative to a longitudinal axis of the connection interface.

* * * * *